US010845730B2

(12) United States Patent
Naito et al.

(10) Patent No.: US 10,845,730 B2
(45) Date of Patent: Nov. 24, 2020

(54) LIQUID CONTAINER AND LIQUID CONSUMPTION DEVICE

(71) Applicant: Seiko Epson Corporation, Tokyo (JP)

(72) Inventors: Naoki Naito, Ikeda-machi (JP); Ryota Takahashi, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/384,513

(22) Filed: Apr. 15, 2019

(65) Prior Publication Data

US 2019/0317426 A1 Oct. 17, 2019

(30) Foreign Application Priority Data

Apr. 17, 2018 (JP) ..... 2018-078792

(51) Int. Cl.
*B41J 2/175* (2006.01)
*G03G 15/08* (2006.01)
*G03G 21/16* (2006.01)

(52) U.S. Cl.
CPC ..... *G03G 15/0865* (2013.01); *G03G 21/1676* (2013.01)

(58) Field of Classification Search
None
See application file for complete search history.

(56) References Cited

U.S. PATENT DOCUMENTS

2001/0017641 A1* 8/2001 Kobayashi ..... B41J 2/17503 347/85
2007/0052769 A1 3/2007 Kubo et al.

FOREIGN PATENT DOCUMENTS

| | | | | |
|---|---|---|---|---|
| EP | 1 764 223 A2 | | 3/2007 | |
| EP | 1 854 633 B1 | | 12/2010 | |
| EP | 2 481 595 A2 | | 8/2012 | |
| EP | 2 748 006 B1 | | 10/2015 | |
| JP | 60145855 A | * | 8/1985 | ..... B41J 2/17513 |
| JP | S60-145855 | | 8/1985 | |
| JP | 2006-044153 A | | 2/2006 | |
| JP | 2014-046624 A | | 3/2014 | |

* cited by examiner

*Primary Examiner* — Erica S Lin
*Assistant Examiner* — Tracey M McMillion
(74) *Attorney, Agent, or Firm* — Oliff PLC

(57) ABSTRACT

A liquid container is configured to be fitted to the carriage of a liquid consumption device including the carriage where a head is provided and that jets, while making the carriage reciprocate, a liquid from the head so as to consume and stores the liquid to be supplied to the head. The liquid container includes: a liquid storage portion configured to store the liquid inside; an undulation reduction portion provided in the liquid storage portion and including a wall surface configured to reduce the undulation of the liquid and be directed in the direction of gravity in a fitting posture where the liquid container is fitted to the carriage; and a support portion configured to support the undulation reduction portion such that the undulation reduction portion is allowed to swing with the liquid and that the movement of the wall surface along the direction of gravity is restricted.

12 Claims, 44 Drawing Sheets

LIQUID CONTAINER AND LIQUID CONSUMPTION DEVICE

This application claims priority based on Japanese Patent Application No. 2018-78792 filed on Apr. 17, 2018, the entire disclosure of which is hereby incorporated by reference.

BACKGROUND

1. Technical Field

The present disclosure relates to liquid containers.

2. Related Art

As one aspect of a liquid consumption device, an inkjet printer is known which jets an ink serving as an example of a liquid toward a medium so as to form a printed image on the medium. In the following description, an inkjet printer is simply referred to as a "printer". For example, JP-A-60-145855 discloses a printer which includes a head that jets an ink and a carriage where the head is provided and in which a liquid container, such as a cartridge, that stores the ink supplied to the head is fitted to the carriage. In the printer as described above, the ink is normally jetted from the head so as to consume the ink while the carriage is made to reciprocate with respect to the medium.

In the printer as described above, the ink may undulate within the liquid container by an inertial force produced when the carriage reciprocates. When the ink undulates as described above, the ink may collide with the wall surface of the liquid container such that air bubbles are produced in the ink. When the air bubbles are supplied to the head together with the ink, it is likely that a failure in the jetting of the ink occurs and thus that dots are removed in a printed image.

In a technology disclosed in JP-A-60-145855 described above, various members for reducing the undulation of the ink, such as an object and a chip that are immersed in the ink and are formed in the shape of a sponge or a net and a plate-shaped member and a liquid that float on the ink, are arranged within the liquid container. However, it is likely that such members follow the movement of the undulation of the liquid so as not to sufficiently reduce the undulation of the liquid. When the member for reducing the undulation of the ink is arranged within the liquid container, the ink remains adhered to the surface of the member, with the result that the ink may be left within the liquid container. Moreover, depending on the position of the arrangement of the member or the posture of the arrangement thereof, the flow of the ink within the liquid container is inhibited, with the result that a failure in the supply of the ink to a liquid consumption device may occur. As described above, in the liquid container which is fitted to the carriage of the liquid consumption device, there is still room for improvement in the reduction of the undulation of the liquid within the liquid container.

SUMMARY

According to one aspect of the present disclosure, a liquid container is provided. The liquid container is configured to be fitted to a carriage of a liquid consumption device which includes the carriage where a head is provided and which jets, while making the carriage reciprocate, a liquid from the head so as to consume the liquid. The liquid container is configured to store the liquid to be supplied to the head. The liquid container includes a liquid storage portion configured to store the liquid inside, an undulation reduction portion provided in the liquid storage portion and including a wall surface configured to reduce undulation of the liquid and configured to direct in a direction of gravity in a fitting posture where the liquid container is fitted to the carriage, and a support portion configured to support the undulation reduction portion such that, in the liquid storage portion, the undulation reduction portion is allowed to swing together with the liquid and that a movement of the wall surface along the direction of gravity in the fitting posture is restricted.

DETAILED DESCRIPTION

1. First Embodiment

1-1. Overall Configuration of Liquid Consumption Device

Figure 1:
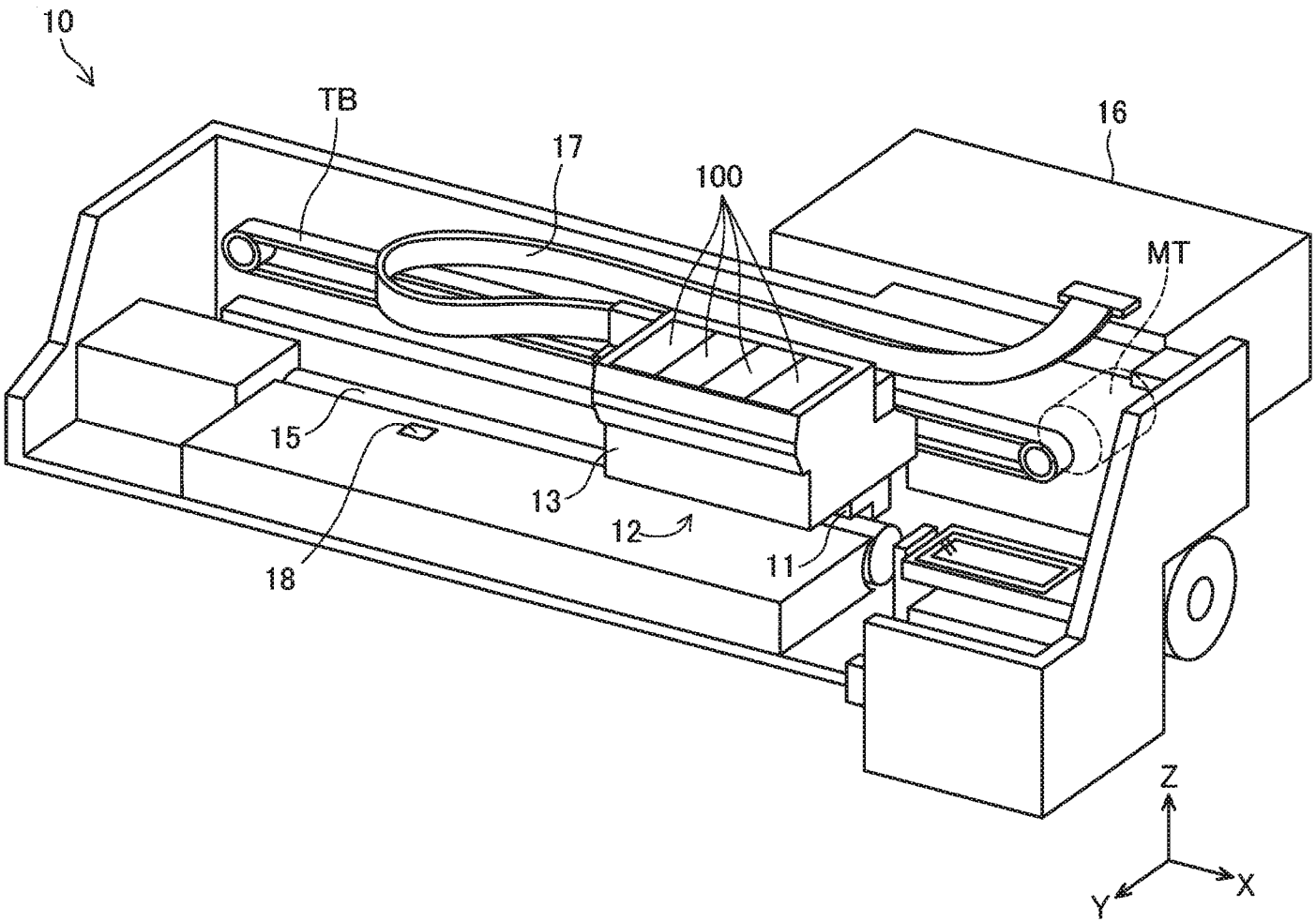
FIG. 1 is a schematic perspective view showing the configuration of a liquid consumption device.

FIG. 1 is a schematic perspective view showing the configuration of a liquid consumption device 10 in a first embodiment. In FIG. 1, the liquid consumption device 10 in a normal usage posture is shown. The normal usage posture of the liquid consumption device 10 means a state where the liquid consumption device 10 is arranged on a horizontal plane. In the following description, unless otherwise specified, the liquid consumption device 10 is assumed to be in the normal usage posture.

In FIG. 1, X, Y, and Z axes are provided, which are coordinate axes indicating three directions orthogonal to each other. The X axis direction and the Y axis direction indicate directions parallel to the horizontal plane. The X axis direction coincides with the direction of the width of the liquid consumption device 10. The X axis direction includes a +X direction that extends from the left side to the right side and a −X direction that extends from the right side to the left side when a user faces the liquid consumption device 10. The Y axis direction coincides with a forward/backward direction of the liquid consumption device 10. The Y axis direction includes a +Y direction that extends from the side of the back surface of the liquid consumption device 10 to the side of the front surface thereof toward which the user faces the liquid consumption device 10 and a −Y direction that extends from the side of the front surface to the side of the back surface. The Z axis direction indicates a direction parallel to a vertical direction, that is, the direction of gravity. The Z axis direction coincides with the direction of the height of the liquid consumption device 10, and includes a +Z direction which extends upward from below and a −Z direction which extends downward from above. In the drawings referenced in the following description, the X, Y, and Z axes are provided as necessary.

The liquid consumption device 10 is configured as an inkjet printer. The liquid consumption device 10 jets an ink serving as an example of a liquid toward a medium, such as a recording sheet, so as to form a printed image on the medium. The ink jetted by the liquid consumption device 10 is a pigment ink which contains a pigment as a precipitation component. The "precipitation component" means a component which is precipitated in a lower part of the liquid by gravity when the liquid is left stationary for a long period of time, for example, a few hours or more. In the following description, the ink which is consumed by the liquid consumption device 10 is simply referred to as the "liquid". In other embodiments, the liquid which is consumed by the liquid consumption device 10 does not need to be a pigment ink, and may be, for example, a dye ink which does not contain a precipitation component.

The liquid consumption device 10 includes a head 11 and a carriage 12. The head 11 jets the liquid toward the medium. The head 11 jets the liquid from an unillustrated nozzle by a known method, such as the application of a pressure to the liquid with a piezoelectric element. In the first embodiment, the head 11 is provided on the lower surface of the carriage 12, and jets the liquid from the nozzle which is opened toward the medium arranged below the carriage 12.

The carriage 12 reciprocates together with the head 11 with respect to the medium. In the first embodiment, the direction of reciprocation of the carriage 12 is a direction which intersects the direction of gravity. More specifically, the direction of reciprocation of the carriage 12 is a direction along a horizontal direction and is also a direction along the X axis direction. In the present specification, the expression "along a certain direction" is not limited to a state where something is completely parallel to the direction, includes a state where something is inclined with consideration given to an error, a tolerance and the like, and includes a posture which is inclined at, for example, about ±10° with respect to the certain direction.

The carriage 12 is connected to a motor MT through a timing belt TB. The carriage 12 reciprocates by the rotational drive force of the motor MT transmitted through the timing belt TB. The direction of reciprocation of the carriage 12 is the main scanning direction of the liquid consumption device 10.

Liquid containers 100 for storing the liquid supplied to the head 11 are fitted to the carriage 12. The carriage 12 includes a holder 13 above the head 11 on which a plurality of liquid containers 100 may be mounted. In the first embodiment, the plurality of liquid containers 100 are arranged on the holder 13 with the direction of reciprocation of the carriage 12 set as the direction of the arrangement thereof. In the first embodiment, the liquid containers 100 are configured as a cartridge and are fitted to the holder 13 so as to be removable. The liquid containers 100 are fitted to the holder 13, with the Z axis direction set as the direction of the fitting. The configurations of the holder 13 and the liquid containers 100 will be described later.

The liquid consumption device 10 includes a transport roller 15 which configures a transport portion of the medium. In the first embodiment, the transport roller 15 is arranged below the carriage 12 along the X axis direction. The transport roller 15 is rotated by power transmitted from an unillustrated transport motor so as to transport the medium along the Y axis direction below the head 11. The direction of transport of the medium below the head 11 is the sub-scanning direction of the liquid consumption device 10. In the first embodiment, the liquid consumption device 10 is able to perform printing not only on sheets of an A4 size and smaller, but also on sheets larger than the A4 size.

The liquid consumption device 10 further includes a control portion 16 which controls the individual mechanisms described above. The control portion 16 is configured with a computer which includes one or a plurality of processors and a main storage unit. In the control portion 16, programs and commands read on the main storage unit are executed by the processor, and thus various functions are achieved. Instead of being configured with such a computer, the control portion 16 may be realized by combining a Plurality of circuits for realizing the individual functions. The control portion 16 is connected to the head 11 through a flexible cable 17. In printing processing on the medium, the control portion 16 transports the medium below the carriage 12, and jets, while making the carriage 12 reciprocate on the medium, the liquid toward the medium from the head 11 so as to consume the liquid.

The liquid consumption device 10 includes a liquid detector portion 18. The liquid detector portion 18 is connected to the control portion 16. The control portion 16 uses the liquid detector portion 18 so as to optically detect, with an optical element, the remaining state of the liquid within the liquid containers 100 mounted on the carriage 12. In the first embodiment, the liquid detector portion 18 includes, as an example of the optical element, an optical sensor which includes a light emitting element and a light receiving element. A method of detecting the remaining state of the liquid in the liquid containers 100 will be described later.

Figure 2:
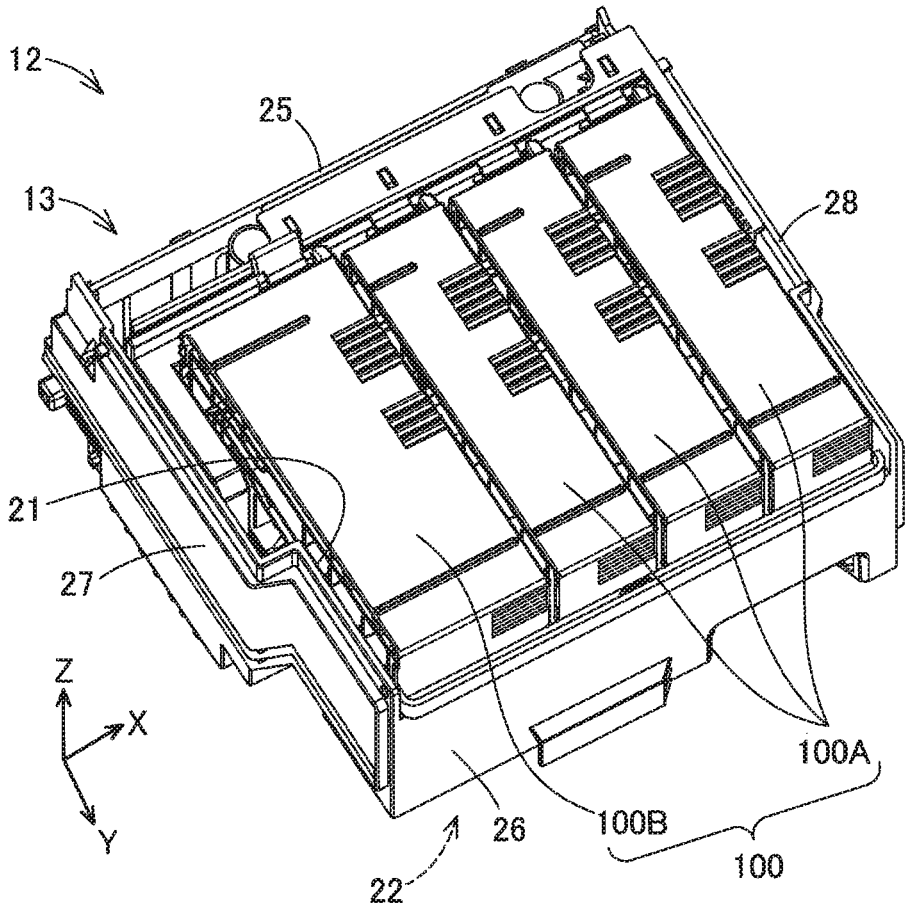
FIG. 2 is a schematic perspective view showing a carriage in a state where liquid containers are fitted thereto.

1-2. Configuration of Holder Included in Carriage:

FIG. 2 is a schematic perspective view when the carriage 12 in a state where the liquid containers 100 are fitted to the holder 13 is seen from above. The holder 13 is opened in the +Z direction and includes a concave portion 21 in which the liquid containers 100 are stored. The concave portion 21 is arranged along the horizontal direction, and is formed by partition into a substantially rectangular shape with a bottom wall 22 which configures a bottom portion and which is formed in a substantially quadrangular shape, and four side walls 25 to 28 which surround the bottom wall 22 and which extend from the outer peripheral edge of the bottom wall 22 in the +Z direction. In FIG. 2, the bottom wall 22 is not seen and thus is indicated by a sign with a broken lead line.

The first side wan 25 and the second side wall 26 are opposite each other through the liquid containers 100 in the Y axis direction. The first side wall 25 is located on the side of the −Y direction with respect to the liquid containers 100. The second side wall 26 is located on the side of the +Y direction with respect to the liquid containers 100. The third side wall 27 and the fourth side wall 28 are opposite each other through the liquid containers 100 in the X axis direction. The third side wall 27 is located on the side of the −X direction with respect to the liquid containers 100, and the fourth side wall 28 is located on the side of the +X direction with respect to the liquid containers 100.

The bottom wall 22 and the four side walls 25 to 28 are not limited to flat walls, and may include projections and recesses or may include a curved surface. The side walls 25 to 28 do not need to be orthogonal to the bottom wall 22 as long as they intersect the bottom wall 22. In the present specification, the expression "two walls or surfaces intersect each other" means that the two walls or surfaces are in a position relationship in which they are not parallel to each other. Besides a case when the two surfaces or walls are in direct contact with each other, even when they are separated from each other without being in direct contact with each other or when the extension of one surface or wall intersects the extension of the other surface or wall, they are interpreted to intersect each other. An angle formed by the two surfaces or walls which intersect each other may be any One of a right angle, an obtuse angle, and an acute angle.

The liquid containers 100 are formed in the shape of a substantially rectangular parallelepiped and are arranged in the holder 13 along the horizontal direction. The liquid containers 100 are arranged in the X axis direction such that the longitudinal direction of the upper surfaces which are directed in the +Z direction coincides with the V axis direction. In the example of FIG. 2, the four liquid containers 100 are fitted to the holder 13. In the following description, the posture of the arrangement of the liquid containers 100 in a state where the liquid containers 100 are fitted to the holder 13 of the carriage 12 is referred to as a "fitting posture". In the following description on the liquid containers 100, unless otherwise specified, the liquid containers 100 are assumed to be in the fitting posture.

The liquid containers 100 fitted to the liquid consumption device 10 include two types of liquid container 100A and liquid container 100B. In the example of FIG. 2, on the holder 13, three liquid containers 100A are arranged on the side of the +X direction, and one liquid container 100B is arranged on the side of the −X direction. The lengths of the liquid container 100A in the Y axis direction and the Z axis direction are substantially the same as the lengths of the liquid container 100E in the Y axis direction and the Z axis direction. On the other hand, the width of the liquid containers 100A the X axis direction is smaller than the width of the liquid container 100B in the X axis direction. By this size difference, the maximum amount of liquid which is able to be stored in the liquid container 100A is smaller than the maximum amount of liquid which is able to be stored in the liquid container 100B. In the liquid containers 100A where the amount of liquid which is able to be stored is smaller, for example, the inks of cyan, magenta, and yellow are individually stored, and in the liquid container 100B where the amount of liquid which is able to be stored is larger, for example, the ink of black for which the consumed amount is predicted to be the largest is stored. The configuration of the liquid containers 100A will be described in the first embodiment, and the configuration of the liquid container 100B will be described in a second embodiment subsequent to the first embodiment.

Figure 3:
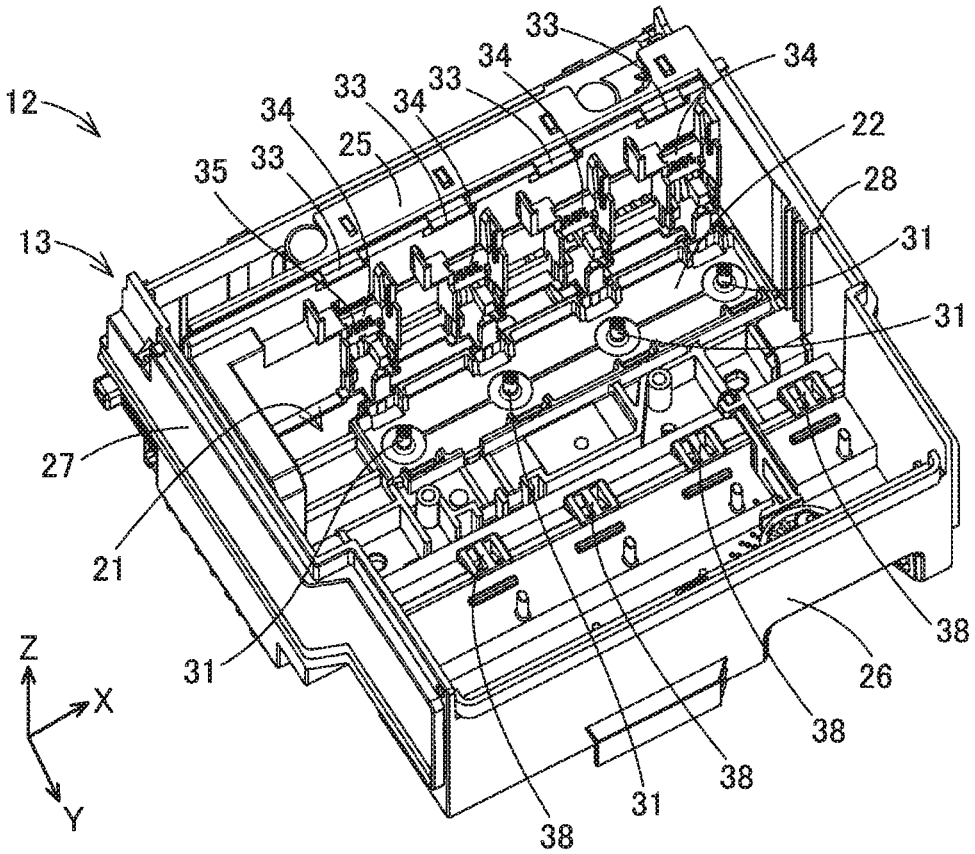
FIG. 3 is a schematic perspective view showing the carriage in a state where the liquid containers are removed therefrom.

FIG. 3 is a schematic perspective view when the carriage 12 in a state where the liquid containers 100 are removed from the holder 13 is seen from above. On the bottom wall 22 of the holder 13, liquid introduction needles 31 are provided. The liquid introduction needles 31 protrude from the bottom wall 22 in the +Z direction. The liquid introduction needles 31 are respectively connected to the corresponding supply portions of the liquid containers 100 which will be described later, and guide the liquids stored in the liquid containers 100 to the head 11. The number of liquid introduction needles 31 provided within the concave portion 21 is equal to the number of liquid containers 100 mounted on the holder 13. In the example of FIG. 3, the four liquid introduction needles 31 are provided in the holder 13. The liquid introduction needles 31 are respectively provided in places to which the liquid containers 100 to be connected are fitted and are aligned on the bottom wall 22 along the X axis.

On the first side wall 25 of the holder 13, engagement portions 33 and contact point mechanisms 34 are provided. The engagement portions 33 and the contact point mechanisms 34 are respectively provided for each of the liquid containers 100 mounted on the holder 13. In the example of FIG. 3, the holder 13 includes the four engagement portions 33 and the four contact point mechanisms 34. The engagement portions 33 are aligned along the X axis direction. The contact point mechanisms 34 are arranged along the X axis.

The engagement portions 33 are provided on an end portion of the first side wall 25 in the +Z direction. The engagement portions 33 engage with engaged portions of the liquid containers 100 which will be described later so as to restrict the movement of the liquid containers 100 fitted to the holder 13 in the +Z direction. In the first embodiment, the engagement portions 33 are configured as claw portions which protrude from the first side wall 25 in the +Y direction and make contact with the engaged portions of the liquid containers 100 from above in the −Z direction so as to engage therewith. The engaged portions of the liquid containers 100 engage with the engagement portions 33 of the holder 13, and thus the fitting of the liquid containers 100 to the holder 13 is completed. In a state where the fitting of the liquid containers 100 to carriage 12 is completed, the engagement of the engaged portions of the liquid containers 100 and the engagement portions 33 of the holder 13 is released, and thus it is possible to remove the liquid containers 100 from the holder 13.

The contact point mechanisms 34 are provided below the engagement portions 33 on the first side wall 25. The contact portions of the liquid containers 100 which will be described later are electrically connected through the contact point mechanisms 34 to the control portion 16 of the liquid consumption device 10. The contact point mechanisms 34 include a plurality of pad-shaped device side terminals 35. The device side terminals 35 include device side contact portions which are electrically connected to the contact portions of the liquid containers 100 which will be described later. In the first embodiment, the form of the device side terminals 35 is not limited to the pad-shaped terminals. For example, the device side terminals 35 may be configured as pin-shaped terminals which extend from the bottom wall 22 along the first side wall 25 in the +Z direction and which include the device side contact portions at end portions in the +Z direction on the side of the +Y direction.

In the bottom wall 22 of the holder 13, window portions 38 are formed. The window portions 38 are respectively provided so as to correspond to the liquid containers 100 fitted to the holder 13. The window portions 38 are formed in such positions that when the liquid containers 100 are fitted to the holder 13, the window portions 38 are overlaid, in the Z axis direction, on the liquid detection portions of the liquid containers 100 which will be described later. When the carriage 12 is moved along the X axis direction, the window portions 38 are passed through the positions which are overlaid, in the Z axis direction, on the liquid detector portion 18 shown in FIG. 1. Light which is emitted by the liquid detector portion 18 in order to detect the remaining state of the liquid within the liquid container 100 is passed through the window portion 38 so as to reach the light detection portion of the liquid container 100 which will be described later.

Figure 4:
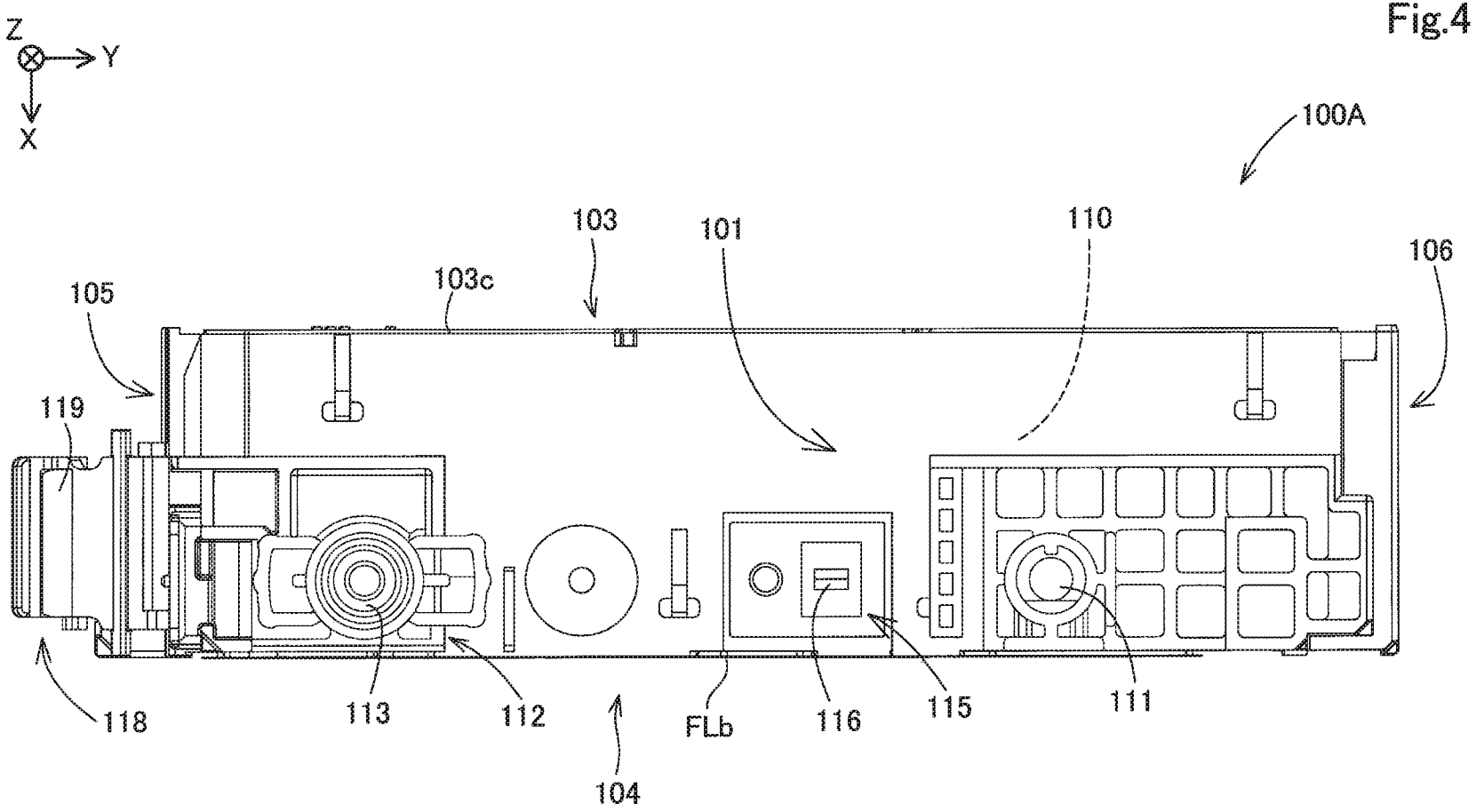
FIG. 4 is a schematic bottom view of the liquid container of a first embodiment.
Figure 5:
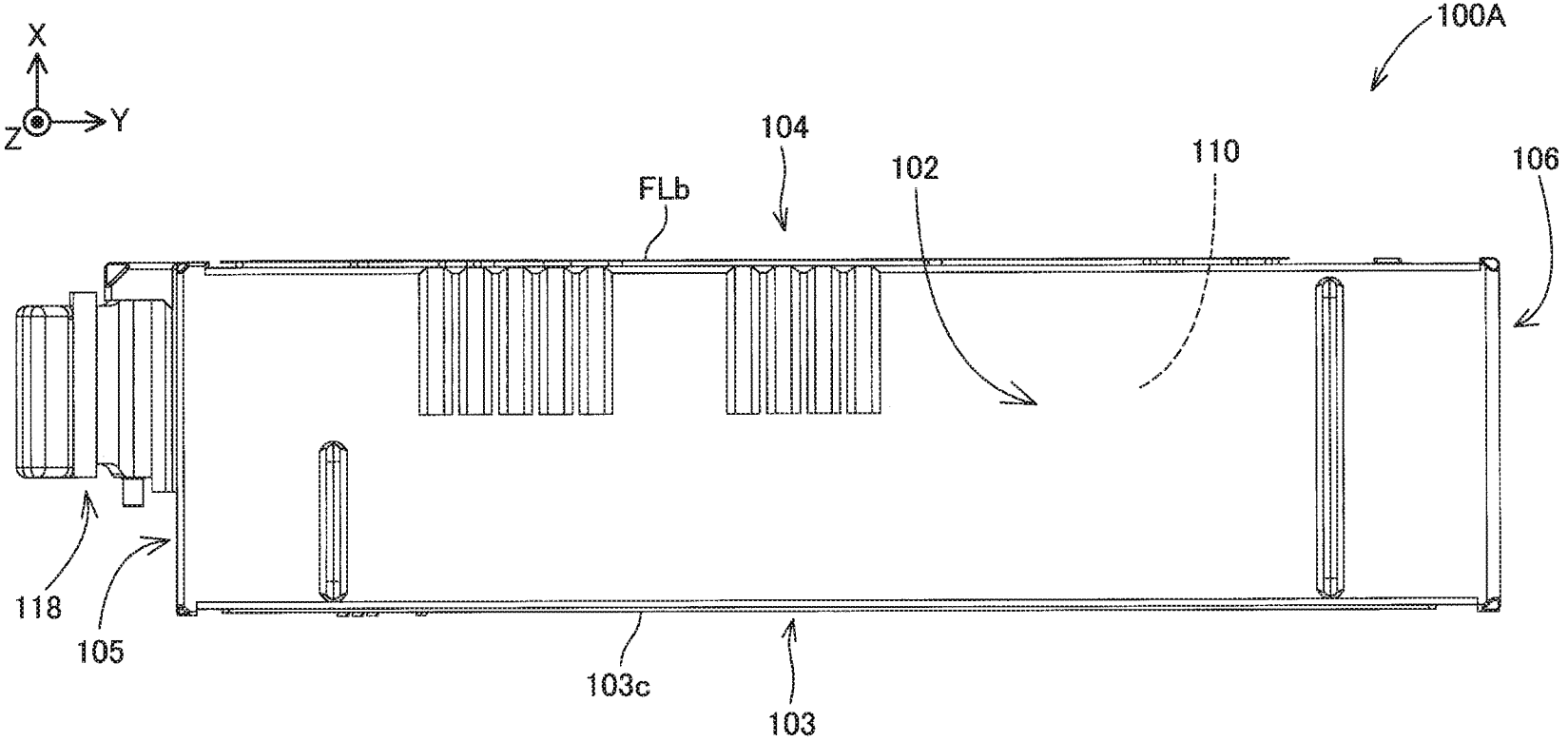
FIG. 5 is a schematic top view of the liquid container of the first embodiment.
Figure 6:
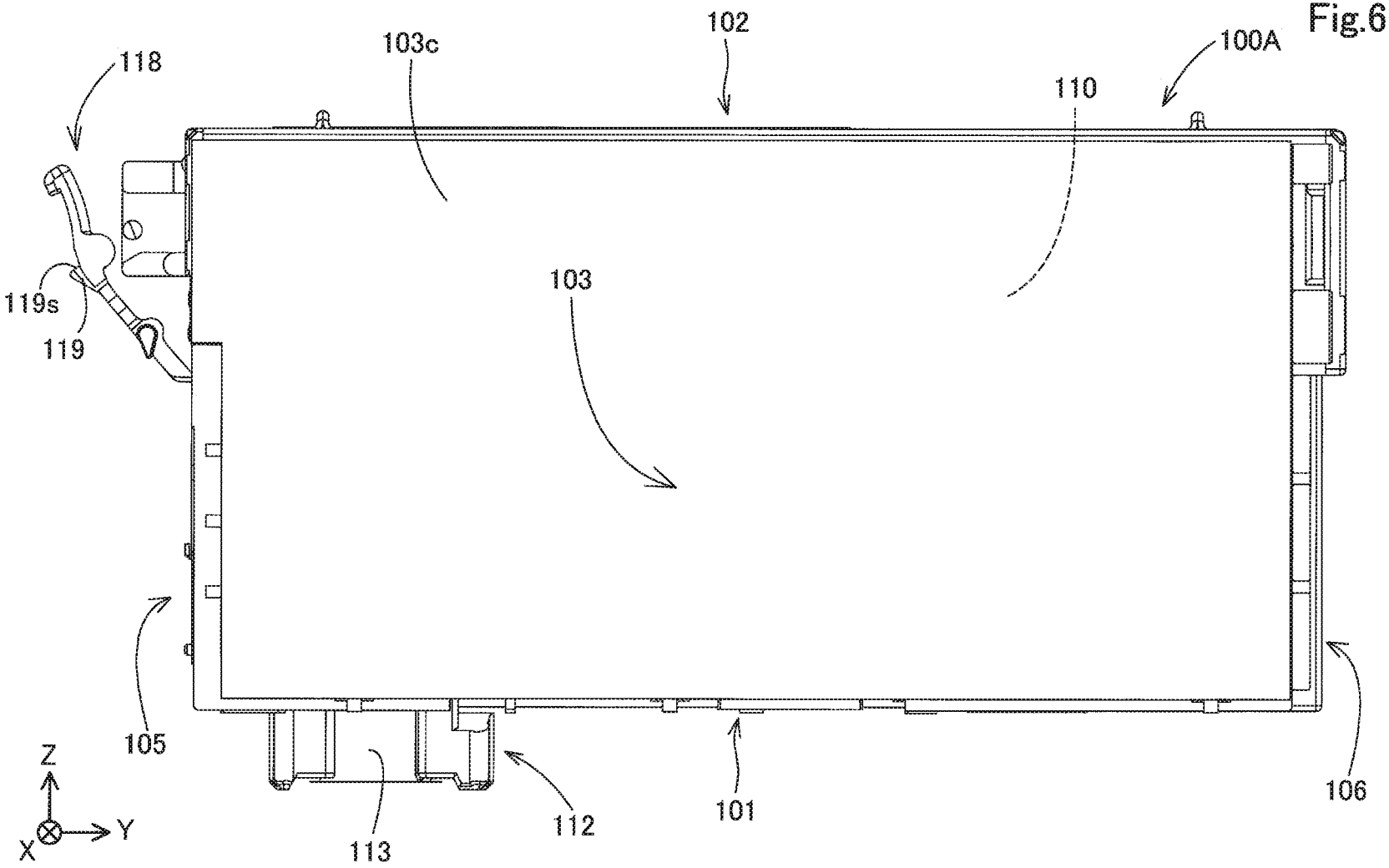
FIG. 6 is a schematic left side view of the liquid container of the first embodiment.
Figure 7:
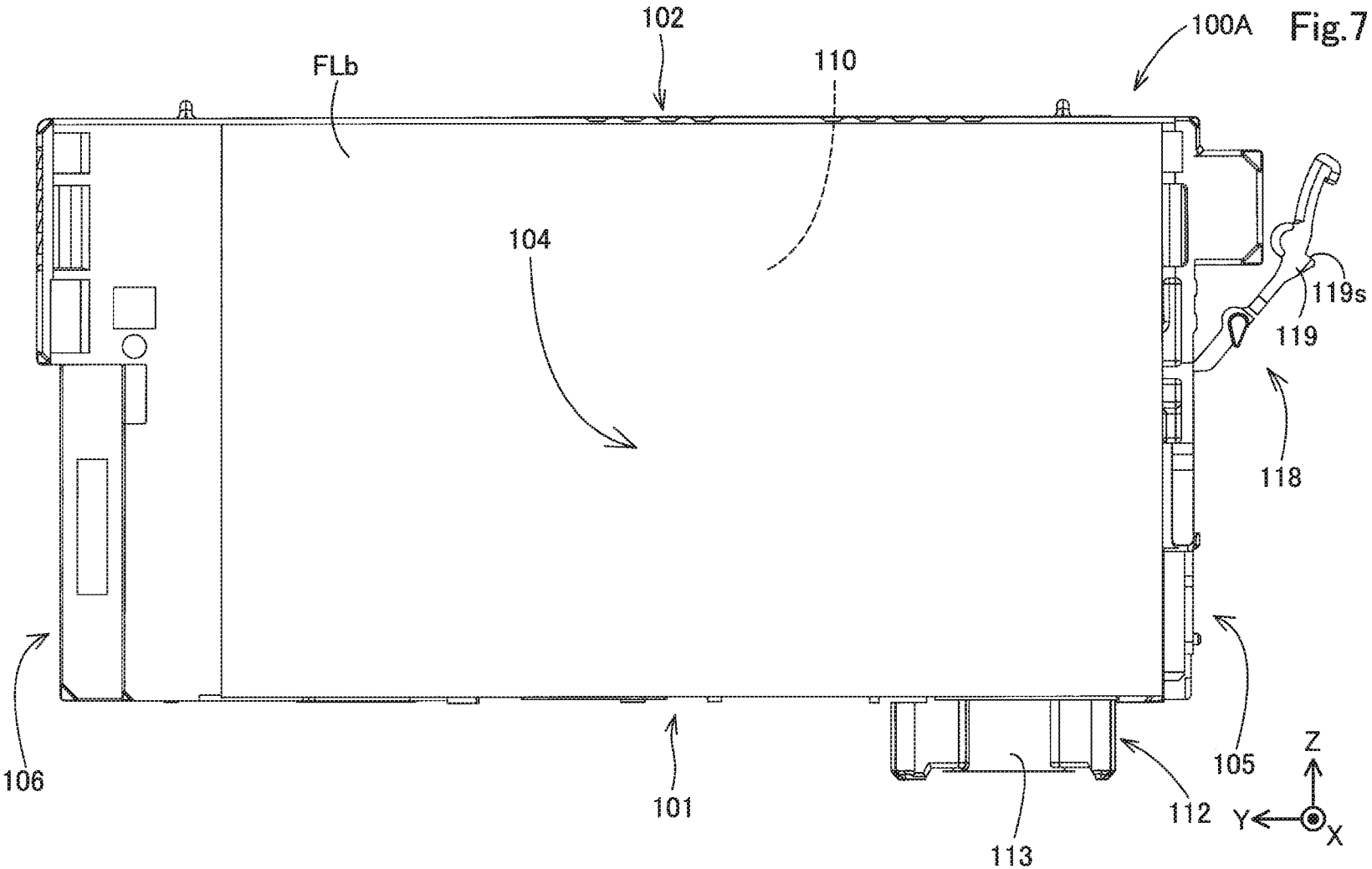
FIG. 7 is a schematic right side view of the liquid container of the first embodiment.
Figure 8:
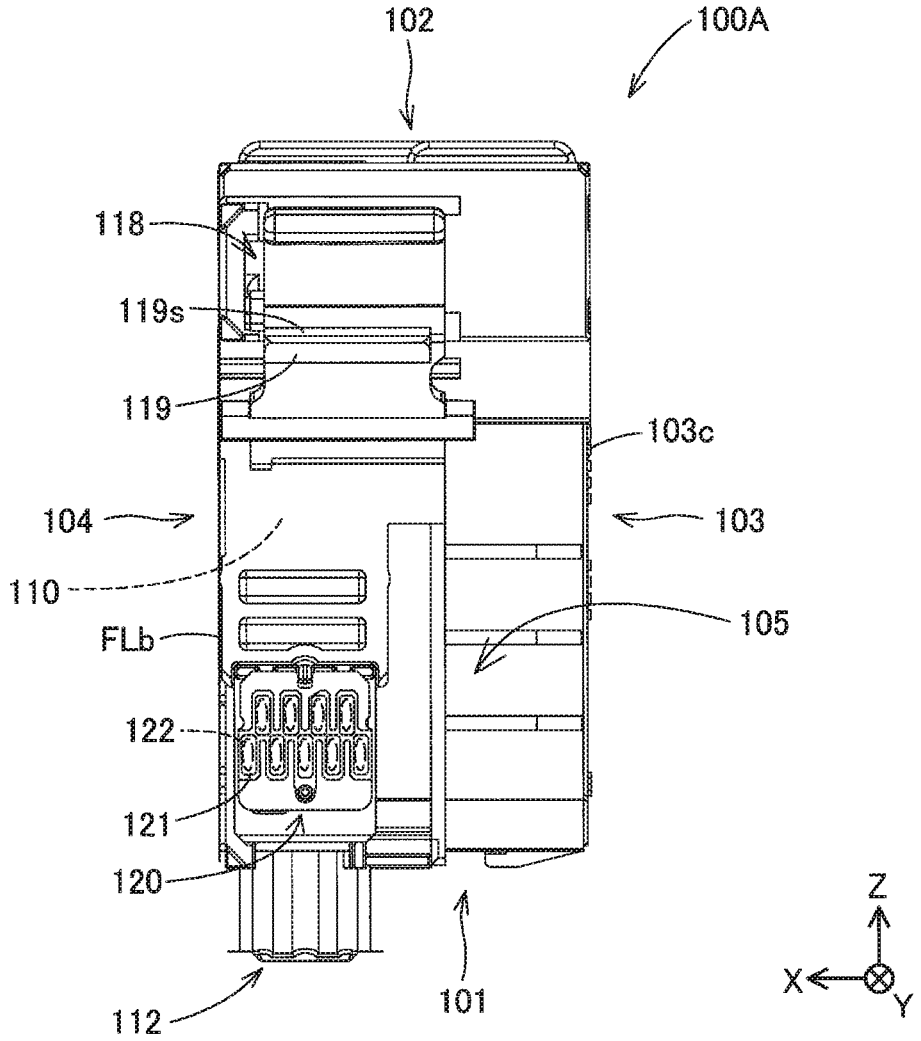
FIG. 8 is a schematic back view of the liquid container of the first embodiment.
Figure 9:
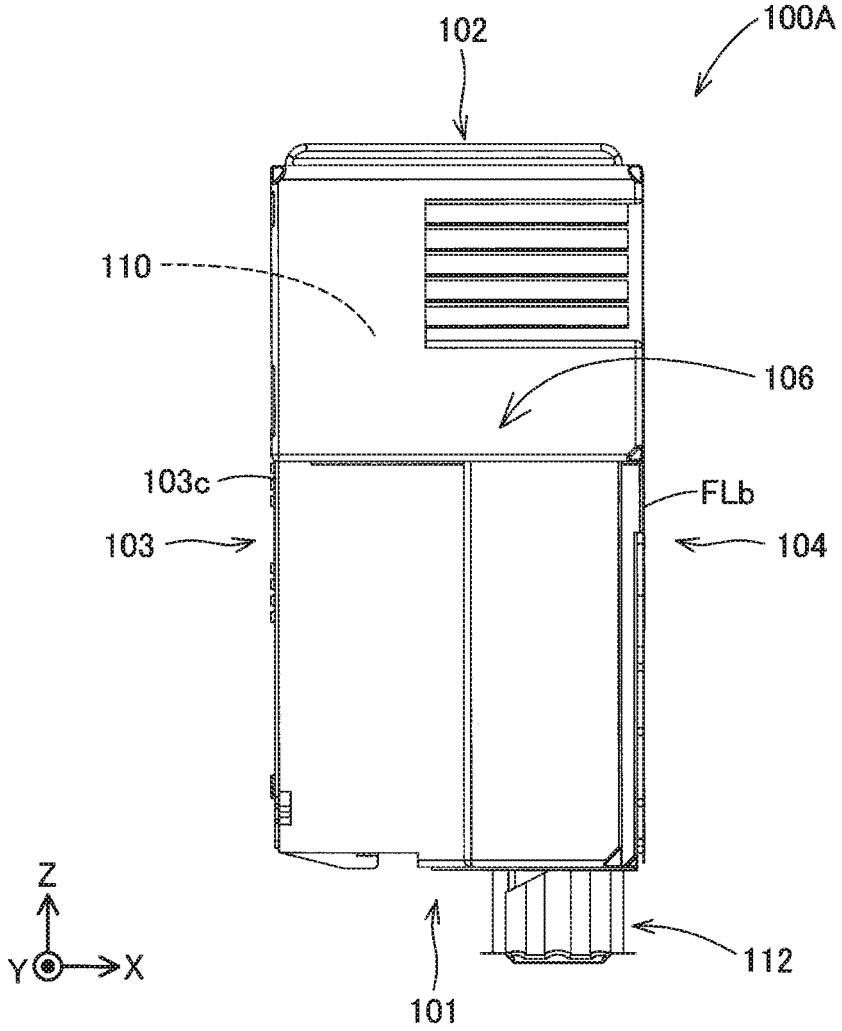
FIG. 9 is a schematic front view of the liquid container of the first embodiment.

1-3. Configuration of Liquid Container:

1-3-1. External Configuration of Liquid Container:

The external configuration of the liquid container 100A in the first embodiment will be described with reference to FIGS. 4 to 9. In FIGS. 4 to 9, the X, Y, and Z axes when the liquid container 100A is in the fitting posture are shown. FIG. 4 is a schematic bottom view when the liquid container 100A is seen in a plan view in the +Z direction. FIG. 5 is a schematic top view when the liquid container 100A is seen in a plan view in the −Z direction. FIG. 6 is a schematic left side view when the liquid container 100A is seen in plan view in the +X direction. FIG. 7 is a schematic right side view when the liquid container 100A is seen in a plan view in the −X direction. FIG. 8 is a schematic back view when the liquid container 100A is seen in a plan view in the +Y direction. FIG. 9 is a schematic front view when the liquid container 100A is seen in a plan view in the −Y direction.

The liquid container 100A includes six wall portions 101 to 106 which configure external wall surfaces. In the liquid container 100A, a liquid storage portion 110 is formed within a region surrounded by the six wall portions 101 to 106. The liquid storage portion 110 stores the liquid. In FIGS. 4 to 9, the liquid storage portion 110 is not seen and thus is indicated by a sign with a broken lead line.

Each of the wall portions 101 to 106 does not need to be configured as a flat wall, and may include projections and recesses or may include a curved surface. The external shape of the liquid container 100A is not limited to the six wall portions 101 to 106 and may be configured with a larger number of wall portions. In the following description, a "bottom surface", an "upper surface", a "left side surface", a "right side surface", a "front surface", and a "back surface" are terms which are used for identifying the positions of the individual surfaces when the liquid container 100A is in the fitting posture, and when the liquid container 100A is in the fitting posture, the positions of the individual wall portions 101 to 106 are not limited to the positions indicated by the terms.

The first wall portion 101 (see FIG. 4) configures the bottom surface of the liquid container 100A which is directed in the −Z direction. The bottom surface configured by the first wall portion 101 is formed in a substantially rectangular shape, with the X axis direction being a lateral direction, and the Y axis direction being a longitudinal direction. The first wall portion 101 is opposite the bottom wall 22 of the holder 13.

The second wall portion 102 (see FIG. 5) is opposite the first wall portion 101 in the Z axis direction and configures the upper surface of the liquid container 100A which is directed in the +Z direction. The upper surface configured by the second wall portion 102 is formed substantially in the shape of a rectangle as with the bottom surface configured by the first wall portion 101.

The third wall portion 103 (see FIG. 6) intersects the first wall portion 101 and the second wall portion 102, and configures the left side surface of the liquid container 100A which is directed in the −X direction. The left side surface configured by the third wall portion 103 is formed in a substantially rectangular shape, with the Z axis direction being a lateral direction, and the Y axis direction being a longitudinal direction.

The fourth wall portion 104 (see FIG. 7) intersects the first wall portion 101 and the second wall portion 102 and is opposite the third wall portion 103 in the X axis direction. The fourth wall portion 104 configures the right side wall of the liquid container 100A which is directed in the +X direction. The right side surface configured by the fourth wall portion 104 is formed in a substantially rectangular shape, with the left side surface configured by the third wall portion 103.

The fifth wall portion 105 (see FIG. 8) intersects the first wall portion 101, the second wall portion 102, the third wall portion 103, and the fourth wall portion 104, and configures the back surface of the liquid container 100A which is directed in the −Y direction. The back surface configured by the fifth wall portion 105 is formed in a substantially rectangular shape, with the X axis direction being a lateral direction, and the Z axis direction being a longitudinal direction.

The sixth wall portion 106 (see FIG. 9) intersects the first wall portion 101, the second wall portion 102, the third wall portion 103, and the fourth wall portion 104 and is opposite the fifth wall portion 105 in the Y axis direction. The sixth wall portion 106 configures the front surface of the liquid container 100A which is directed in the +Y direction. The front surface configured by the sixth wall portion 106 is formed in a substantially rectangular shape as with the back surface configured by the fifth wall portion 105.

FIG. 4 will be referenced. In the first wall portion 101, an atmosphere open port 111, a liquid supply portion 112 and a liquid detection portion 115 are provided. The atmosphere open port 111 is an open portion for introducing the atmosphere into the liquid storage portion 110 provided within the liquid container 100A. The atmosphere open port 111 is provided, in the Y axis direction, in a position which is closer to an end portion on the side of the +Y direction than to an end portion on the side of the −Y direction. The path of the atmosphere introduced from the atmosphere open port 111 within the liquid container 100A will be described later.

The liquid supply portion 112 receives the connection of the liquid introduction needle 31 of the holder 13 shown in FIG. 3. The liquid stored in the liquid container 100A is supplied to the liquid consumption device 10 through the liquid introduction needle 31 connected to the liquid supply portion 112. The liquid supply portion 112 includes a tubular supply port 113 which is opened in the Z axis direction and into which the liquid introduction needle 31 is inserted. In the first embodiment, the liquid supply portion 112 is provided, in the Y axis direction, in a position which is closer to the end portion on the side of the −Y direction than to the end portion on the side of the +Y direction. As shown in FIGS. 6 to 9, the liquid supply portion 112 protrudes from the first wall portion 101 in the −Z direction. Within the supply port 113, an annular seal member through which the liquid introduction needle 31 is inserted, a valve member which is able to make contact with the seal member and which is pushed up by the liquid introduction needle 31, and a spring member which biases the valve member to the side of the seal member are stored. The path of the liquid reaching the liquid supply portion 112 within the liquid container 100A will be described later.

The liquid detection portion 115 is a part for making the liquid consumption device 10 detect the remaining state of the liquid within the liquid container 100A. As described above, the liquid detection portion 115 is provided in such a position that when the liquid container 100A is fitted to the holder 13, the liquid detection portion 115 is overlaid, in the Z axis direction, on the window portion 38 of the holder 13. In the first wall portion 101, the liquid detection portion 115 is provided between the atmosphere open port 111 and the liquid supply portion 112 in the Y axis direction. The liquid detection portion 115 includes an optical component 116 that configures the path of the light which is emitted by the liquid detector portion 18 shown in FIG. 1 and which is used for detecting the remaining state of the liquid. In the first embodiment, as the optical component 116, a prism is adopted. The optical component 116 is embedded within the liquid container 100A so as to make contact with the liquid stored in the liquid container 100A. The optical component 116 is arranged in such a position that the optical component 116 is seen from the outside of the liquid container 100A through a through hole which penetrates the first wall portion 101. A method of detecting the remaining state of the liquid in the liquid container 100A through the liquid detection portion 115 will be described later.

FIGS. 6 and 7 will be referenced. On the fifth wall portion 105 of the liquid container 100A, a lever 118 is provided. The lever 118 protrudes from the fifth wall portion 105 in the −Y direction and extends obliquely from the fifth wall portion 105 toward the +Z direction. The lever 118 is turned on a lower end portion which is coupled to the fifth wall portion 105 and which serves as a pivot. In the lever 118, an engaged portion 119 is provided. The engaged portion 119 is formed on the surface of the lever 118 on the side of the −Y direction. The engaged portion 119 includes an engagement surface 119*s* which protrudes in the −Y direction and which is directed in the +Z direction. As described previously, the engagement surface 119*s* of the engaged portion 119 makes contact with the engagement portion 33 of the holder 13 shown in FIG. 2 in the Z axis direction so as to engage therewith, and thus the fitting of the liquid container 100A to the holder 13 is achieved. The engagement of the engaged portion 119 of the lever 118 and the engagement portion 33 of the holder 13 is able to be released by the turning of the lever 118 in the +Y direction.

FIG. 8 will be referenced. In the fifth wall portion 105 of the liquid container 100A, a circuit board 120 is provided below the lever 118. The circuit board 120 is provided, in the Z axis direction, in a position which is closer to a lower end portion on the side of the Z direction than to an upper end portion on the side of the +Z direction. The circuit board 120 is provided in a position which is opposite the contact point mechanism 34 of the holder 13 shown in FIG. 3 when the liquid container 100A is fitted to the holder 13. In the surface of the circuit board 120 directed in the −Y direction, a plurality of terminals 121 are arranged. The individual terminals 121 include contact portions 122 which are electrically connected to the device side terminals 35 of the holder 13 shown in FIG. 3. In FIG. 8, the regions configuring the contact portions 122 on the terminals 121 are schematically illustrated by broken lines.

At least part of the plurality of terminals 121 is electrically connected to an unillustrated storage device provided on the back surface of the circuit board 120. In a state where the liquid container 100A is fitted to the holder 13, the storage device provided on the circuit board 120 of the liquid container 100A and the control portion 16 of the liquid consumption device 10 shown in FIG. 1 are electrically connected through the contact portions 122. In this way, various types of information are exchanged between the storage device provided on the circuit board 120 of the liquid container 100A and the control portion 16 of the liquid consumption device 10.

Figure 10:
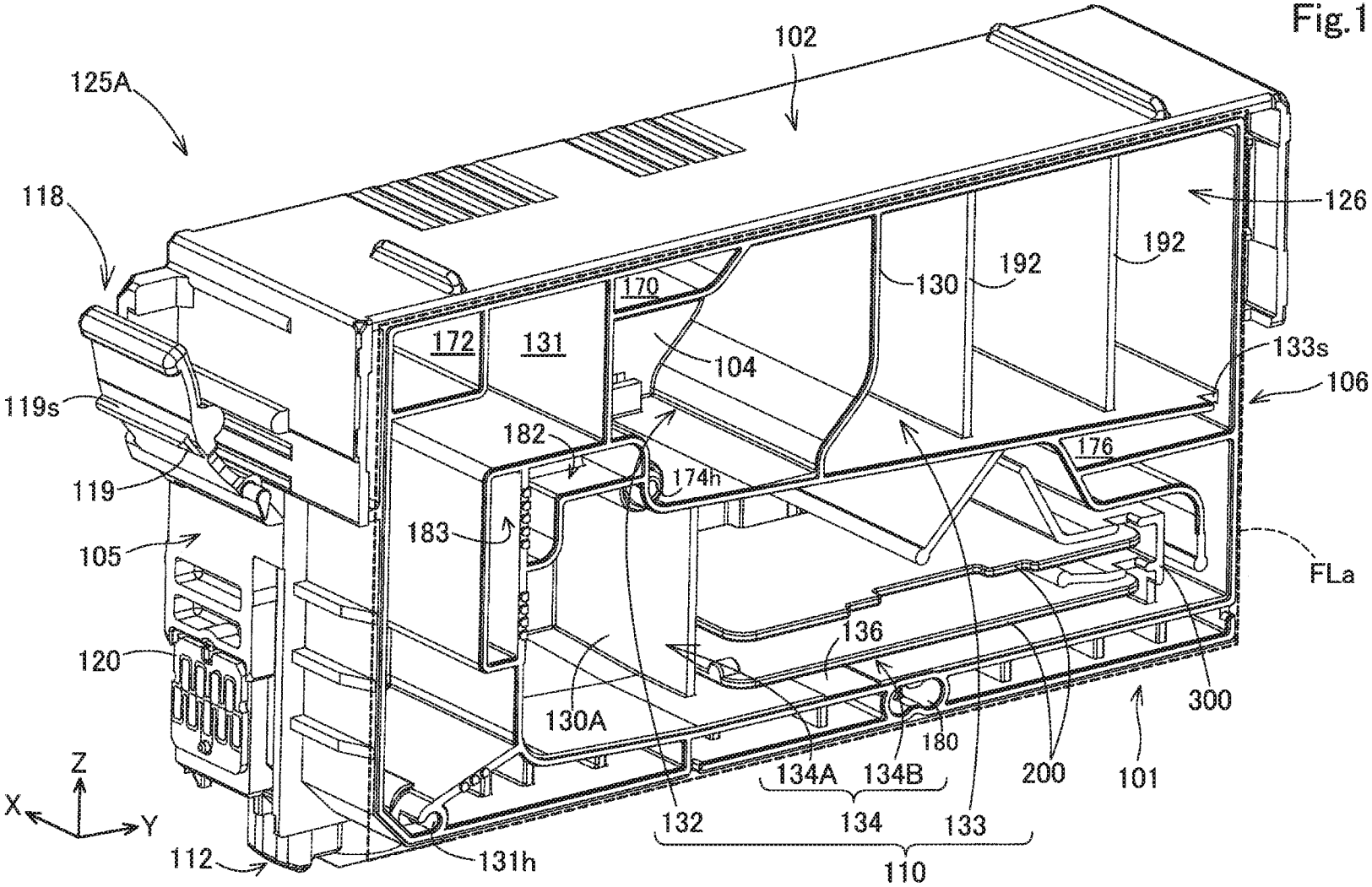
FIG. 10 is a schematic perspective view of a main body portion in the first embodiment.
Figure 11:
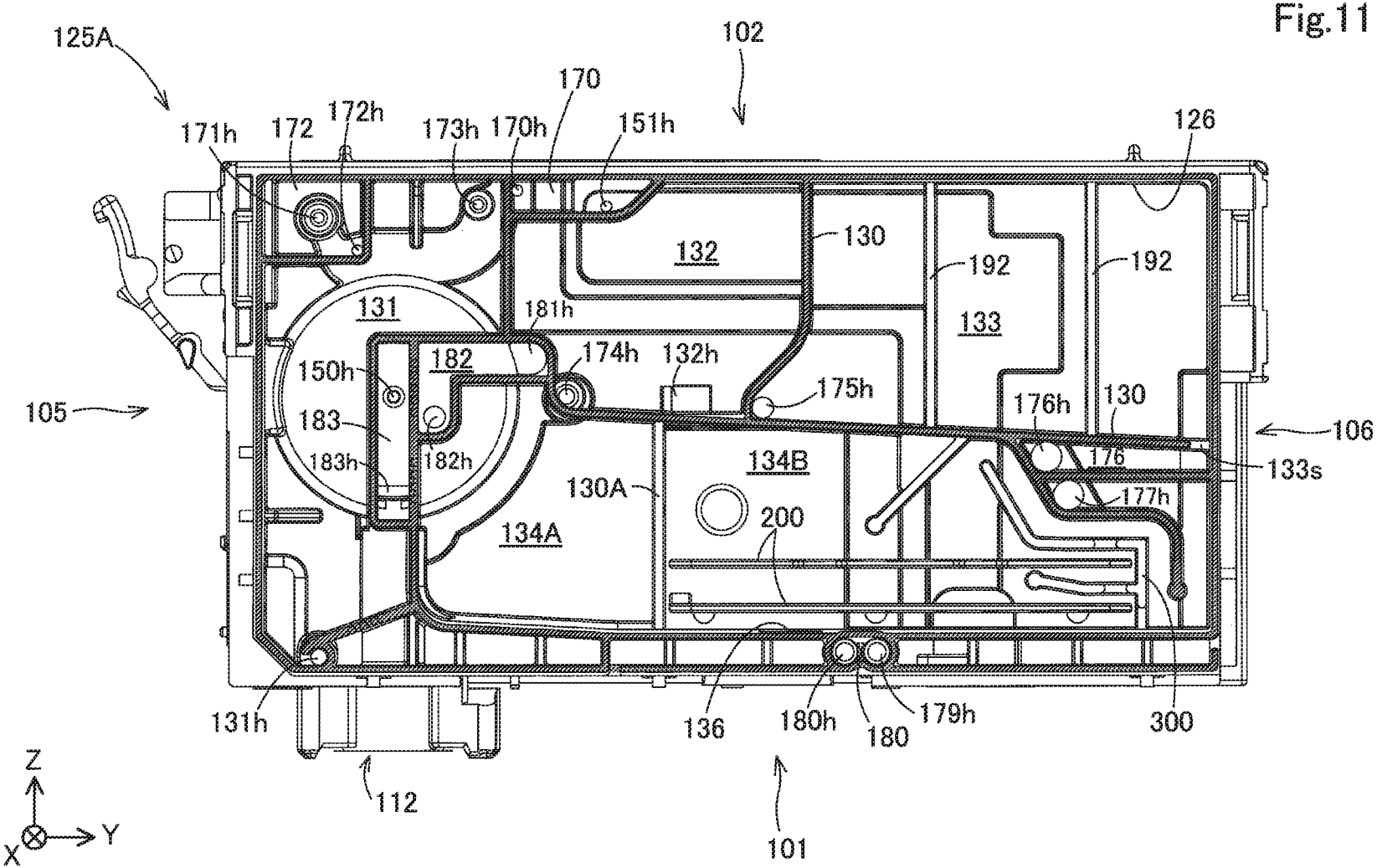
FIG. 11 is a schematic left side view of the main body portion in the first embodiment.

1-3-2. Internal Configuration of Liquid Container:

FIG. 10 is a schematic perspective view showing an internal structure on the side of the left side surface of the liquid container 100A. FIG. 11 is a schematic left side view when a main body portion 125A of the liquid container 100A is seen in a plan view in the +X direction. In the following description, the side of the left side surface of the liquid container 100A is also referred to as a "front surface side" for convenience.

The liquid container 100A includes the main body portion 125A which is configured as a substantially hollow box-shaped member which is opened in the −X direction. The main body portion 125A is formed of, for example, a resin material such as polypropylene. The main body portion 125A is surrounded by the first wall portion 101, the second wall portion 102, the fourth wall portion 104, the fifth wall portion 105, and the sixth wall portion 106 and includes a front surface side concave portion 126 which is opened in the X direction.

A first film FLa which covers the entire front surface side concave portion 126 of the main body portion 125A is welded, and a lid member 103*c* shown in FIGS. 4, 5, and 8 is attached from above it, with the result that the third wall portion 103 of the liquid container 100A is configured. In FIG. 10, the first film FLa is indicated by broken lines for convenience, and the lid member 103*c* is omitted. In FIG. 11, the regions to which the first film FLa is welded are hatched. In the liquid container 100A, the lid member 103*c* described above may be omitted, and the third wall portion 103 may be configured with only the first film FLa.

Within the front surface side concave portion 126, ribs 130 which extend along the X axis direction and which have various shapes are formed. In the liquid container 100A, the first film FLa described above is welded to the end faces of the front surface side of the first wall portion 101, the second wall portion 102, the fifth wall portion 105, and the sixth wall portion 106 and on the end faces of the front surface side of the individual ribs 130. Thus, an atmosphere chamber 131, a first liquid chamber 132, a second liquid chamber 133, a third liquid chamber 134, and the like are formed by partition.

The atmosphere is introduced from the atmosphere open port 111 into the atmosphere chamber 131. The atmosphere chamber 131 is formed in an end on the side of the −Y direction between the first wall portion 101 and the second wall portion 102 so as to be vertically long, with the Z axis direction being a longitudinal direction.

The first liquid chamber 132, the second liquid chamber 133, and the third liquid chamber 134 configure the liquid storage portion 110 described above. The individual liquid chambers 132 to 134 are formed on the side of the +Y direction with respect to the atmosphere chamber 131. The first liquid chamber 132 and the second liquid chamber 133 face the second wall portion 102. The first liquid chamber 132 and the second liquid chamber 133 are aligned in the X axis direction. The third liquid chamber 134 faces the first wall portion 101. The third liquid chamber 134 is provided below the first liquid chamber 132 and the second liquid chamber 133 so as to be horizontally long, with the Y axis direction being a longitudinal direction.

The third liquid chamber 134 has the widest space in the liquid storage portion 110. In other words, the third liquid chamber 134 has the largest space volume in the liquid storage portion 110, and has the largest amount of liquid which is able to be stored. The third liquid chamber 134 is divided, by a partition rib 130A which is one of the ribs 130 and which is provided along the Z axis direction, into two storage chambers 134A and 134B which communicate with each other. The first storage chamber 134A is provided on the side of the −Y direction, and the second storage chamber 134B is provided on the side of the +Y direction. The length of the second storage chamber 134B in the Y axis direction is longer than that of the first storage chamber 134A. The length of the second storage chamber 134B in the Y axis direction is longer than the lengths of the other liquid chambers 132 and 133 in the Y axis direction.

The end face of the partition rib 130A on the side of the −X direction is located apart from the first film FLa in the +X direction and is not joined to the first film FLa. Through a gap formed between the end face of the partition rib 130A on the side of the −X direction and the first film FLa, the liquid is circulated between the first storage chamber 134A and the second storage chamber 134B. While the bottom surface of the second storage chamber 134B is substantially horizontal, the bottom surface of the first storage chamber 134A is slightly inclined downward toward the second storage chamber 134B such that the liquid in the first storage chamber 134A is guided to the second storage chamber 134B by gravity.

In the second storage chamber 134B of the third liquid chamber 134, undulation reduction portions 200 for reducing the undulation of the liquid are arranged, and a support portion 300 which supports the undulation reduction portions 200 is provided. FIGS. 10 and 11 show, for convenience, a state where the undulation reduction portions 200 float along the horizontal direction. The undulation reduction portions 200 and the support portion 300 will be described after the description of the path through which the atmosphere flows and the path through which the liquid flows in the liquid container 100A.

In a bottom portion located in the lowest position in the second storage chamber 134B of the third liquid chamber 134, a residue prevention groove 136 is provided which prevents the liquid from being left in the liquid storage portion 110. One residue prevention groove 136 is provided in the bottom portion of the third liquid chamber 134. The residue prevention groove 136 extends linearly along the X direction. The cross-sectional shape of the residue prevention groove 136 is rectangular, and the bottom surface of the residue prevention groove 136 is substantially horizontal. As will be described later, in the tip of the end portion of the residue prevention groove 136 on the side of the +X direction, the optical component 116 of the liquid detection portion 115 described with reference to FIG. 4 is embedded. The bottom surface of the second storage chamber 134B may be inclined downward toward the residue prevention groove 136.

Figure 12:
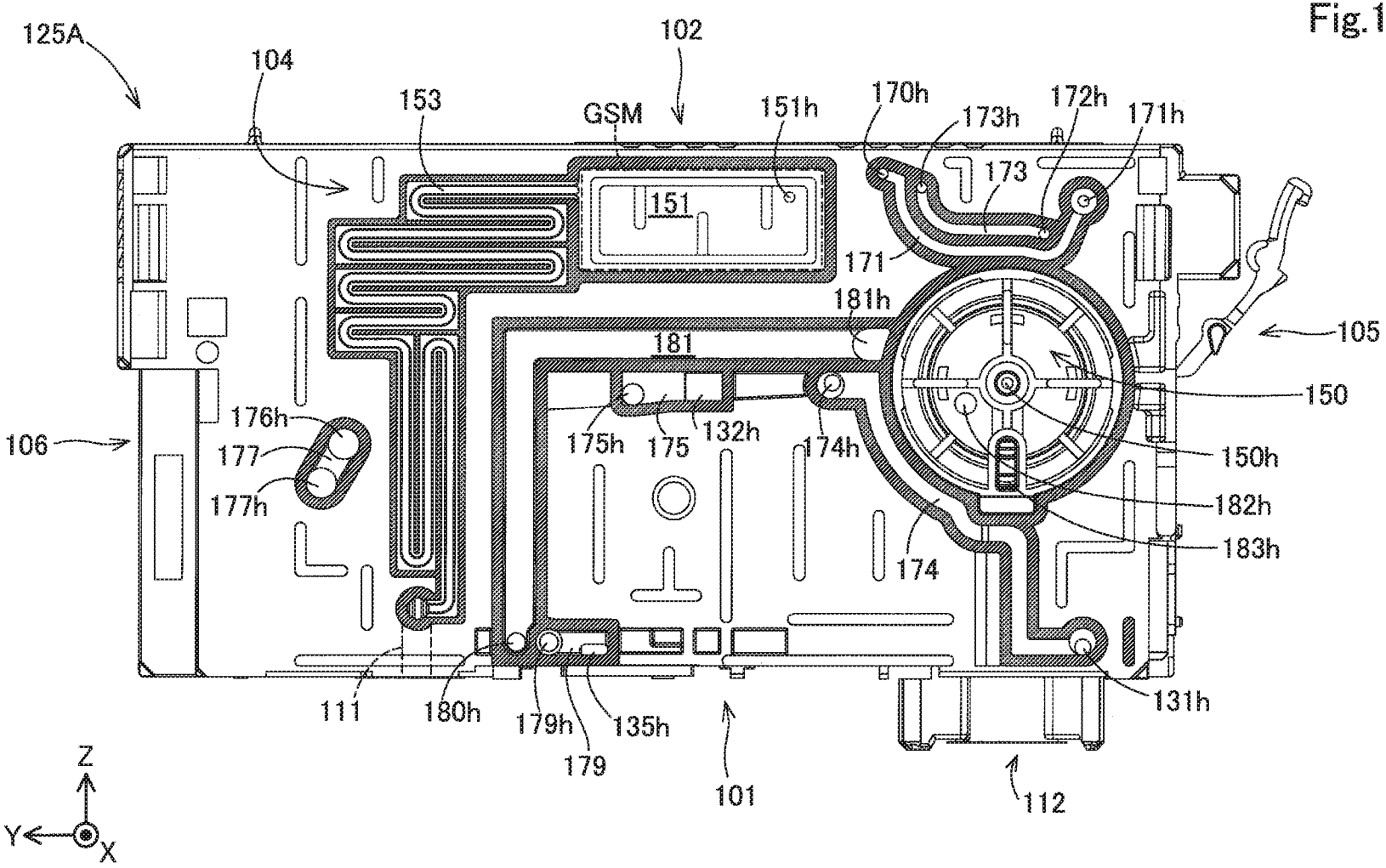
FIG. 12 is a schematic right side view of the main body portion in the first embodiment.

An internal structure on the side of the right side surface of the liquid container 100A will be described with reference to FIG. 12. FIG. 12 is a schematic right side view when the main body portion 125A of the liquid container 100A is seen in a plan view in the −X direction. In the following description, the side of the right side surface of the liquid container 100A is also referred to as a "back surface side" for convenience.

On the back surface side of the main body portion 125A, a plurality of grooves are formed in the wall surface which extends along the Y axis direction and the Z axis direction. These grooves are sealed by welding a second film FLb shown in FIGS. 3, 4, and 7 from the side of the +X direction, and thus a differential pressure valve chamber 150, a gas-liquid separation chamber 151, a meandering path 153, and communication paths which will be described later are formed within the fourth wall portion 104. In FIG. 12, parts to which the second film FLb is welded are hatched.

The differential pressure valve chamber 150 is provided, in the Y axis direction, in a position which is closer to the end portion on the side of the Y direction than to the end portion on the side of the +Y direction. In the differential pressure valve chamber 150, a known differential pressure valve mechanism including a valve member and a spring is stored. In FIG. 12, the differential pressure valve mechanism is omitted.

The gas-liquid separation chamber 151 is provided on the side of the +Y direction with respect to the differential pressure valve chamber 150. The gas-liquid separation chamber 151 is provided, in the Z axis direction, in a position which is closer to the upper end portion on the side of the +Z direction than to the lower end portion on the side of the −Z direction. The gas-liquid separation chamber 151 communicates with the liquid storage portion 110 on the front surface side through an opening 151*h*. In the gas-liquid separation chamber 151, a gas-liquid separation membrane GSM indicated by broken lines is arranged along the Y axis direction and the Z axis direction.

The meandering path 153 is connected to the gas-liquid separation chamber 151. The meandering path 153 is provided on the side of the +Y direction with respect to the gas-liquid separation chamber 151. The meandering path 153 includes a part which is folded along the Y axis direction in the shape of a bellows and a part which is folded along the Z axis direction in the shape of a bellows. The meandering path 153 is formed from the side of the second wall portion 102 to the side of the first wall portion 101, and an end portion on the side of the first wall portion 101 is connected to the atmosphere open port M.

Figure 13:
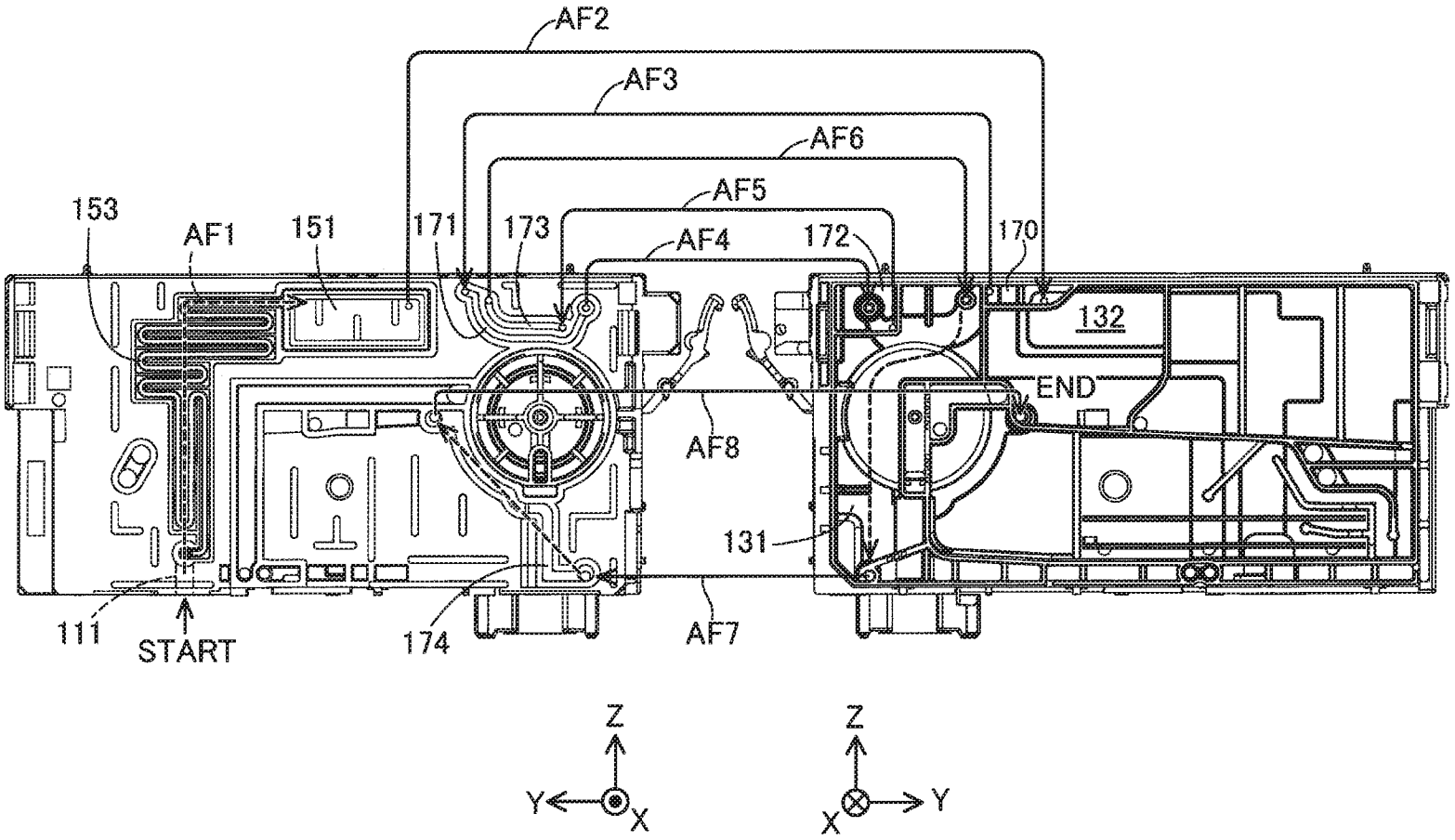
FIG. 13 is a schematic view showing the flow of an atmosphere within the liquid container of the first embodiment.

1-3-3. Paths of Atmosphere within Liquid Container:

FIG. 13 is a schematic view showing the flow of the atmosphere within the liquid container 100A. In the following description, before the flow of the liquid within the liquid container 100A, the flow of the atmosphere introduced into the liquid container 100A will first be described with reference to FIGS. 11 to 13. The atmosphere introduced from the atmosphere open port 111 substantially flows, within the liquid container 100A, through the meandering path 153, the gas-liquid separation chamber 151, the atmosphere chamber 131, and the first liquid chamber 132 in this order.

As indicated by an arrow AF1 in FIG. 13, the atmosphere introduced from the atmosphere open port 111 flows into the gas-liquid separation chamber 151 through the meandering path 153 provided on the back surface side of the liquid container 100A. In order to increase the distance from the atmosphere open port 111 to the liquid storage portion 110, the meandering path 153 is formed so as to be elongated and meander. In this way, it is possible to reduce the evaporation of the liquid within the liquid storage portion 110 through the gas-liquid separation chamber 151 and the meandering path 153. In the gas-liquid separation chamber 151, by the function of the gas-liquid separation membrane GSM (see FIG. 12) described above, the passage of the atmosphere from the meandering path 153 to the liquid storage portion 110 is allowed, whereas the passage of the liquid from the liquid storage portion 110 to the meandering path 153 is not allowed. In this way, a failure is reduced in which the liquid flowing reversely from the liquid storage portion 110 to the gas-liquid separation chamber 151 flows from the gas-liquid separation chamber 151 to the meandering path 153 and the atmosphere open port 111 so as to leak from the liquid container 100A.

As indicated by an arrow AF2 in FIG. 13, the atmosphere introduced through the gas-liquid separation chamber 151 enters, from the opening 151*h* (see FIG. 12) provided within the gas-liquid separation chamber 151, a first preliminary atmosphere chamber 170 (see FIG. 13) provided in an upper portion of the first liquid chamber 132 on the front surface side. As indicated by an arrow AF3 in FIG. 13, the atmosphere in the first preliminary atmosphere chamber 170 enters, from an opening 170*h* (see FIG. 11), an end portion of a first communication path 171 (see FIG. 12) on the side of the +Y direction which is provided on the differential pressure valve chamber 150 on the back surface side and which is extends in the Y axis direction. As indicated by an arrow AF4 in FIG. 13, the atmosphere flows along the first communication path 171 so as to enter, from an opening 171*h* (see FIG. 12) provided at an end portion of the first communication path 171 on the side of the −Y direction, a second preliminary atmosphere chamber 172 which is provided in a corner portion intersecting the second wall portion 102 and the fifth wall portion 105 on the front surface side of the liquid container 100A.

Then, as indicated by an arrow AF5 in FIG. 13, the atmosphere enters, from an opening 172*h* (see FIG. 11) provided in the second preliminary atmosphere chamber 172, an end portion of the back surface side of the second communication path 173 on the side of the −Y direction which is provided on the first communication path 171 extends along the Y axis direction, and which is shorter than the first communication path 171. The atmosphere flows along the second communication path 173, and enters, as indicated by an arrow AF6 in FIG. 13, an upper portion of the atmosphere chamber 131 provided on the front surface side of the liquid container 100A from an opening 173*h* (see FIG. 12) provided in an end portion of the second communication path 173 on the side of the +Y direction.

As indicated by an arrow AF7 in FIG. 13, the atmosphere within the atmosphere chamber 131 enters, through an opening 131*h* (see FIG. 11) provided in a lower portion of the atmosphere chamber 131, an end portion of a third communication path 174 (see FIG. 12) provided on the back surface side on the side of the −Y direction and the −Z direction. The atmosphere flows along the third communication path 174, and flows, through an opening 174*h* (see FIG. 12) provided at an end portion of the third communication path 174 on the side of the +Y direction and the side of the +Z direction, into the first liquid chamber 132 provided on the front surface side. As the liquid within the liquid storage portion 110 is consumed, the atmosphere flows along the paths described above into the liquid storage portion 110.

Figure 14:
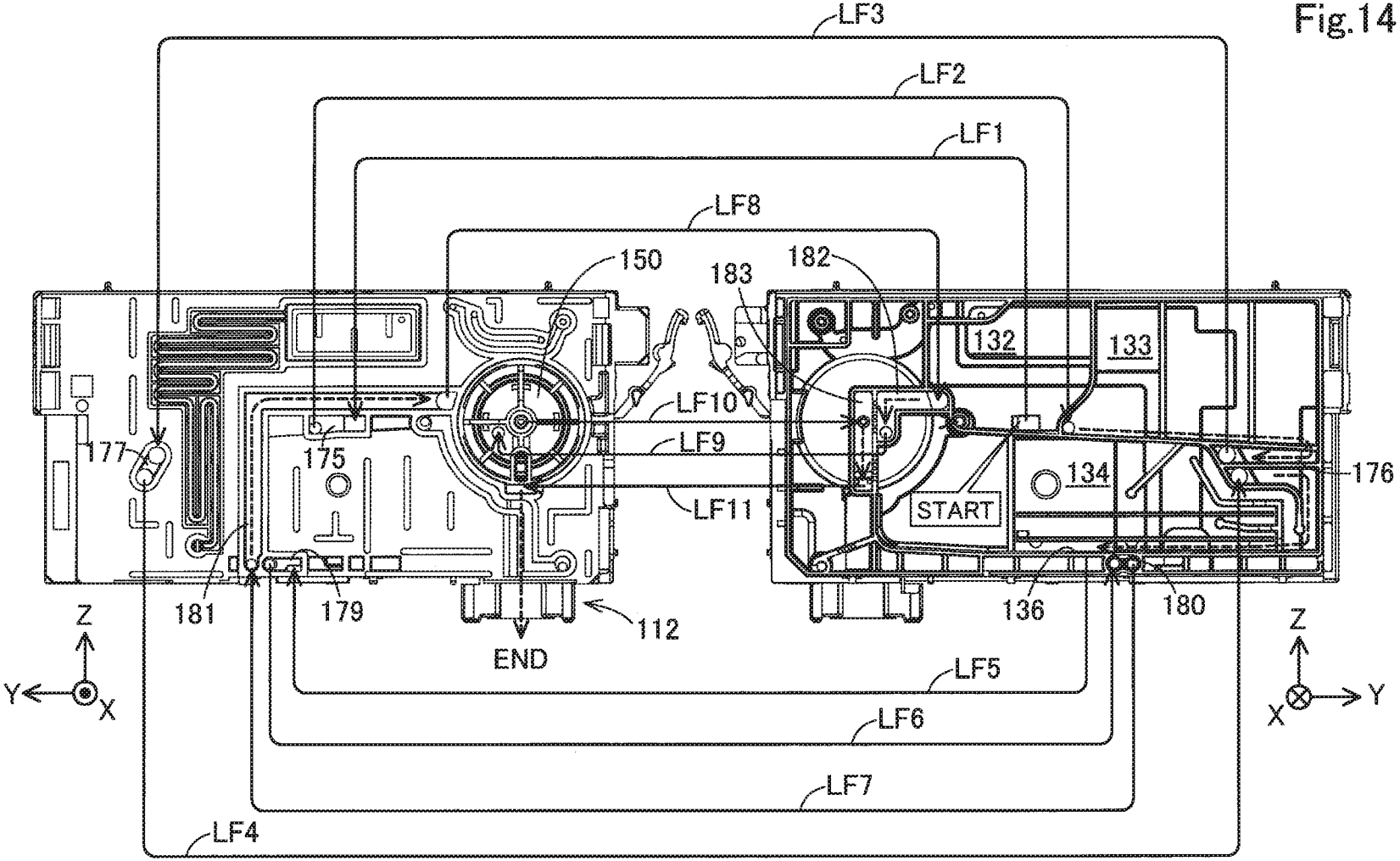
FIG. 14 is a schematic view showing the flow of a liquid within the liquid container of the first embodiment.

1-3-4. Paths of Liquid within Liquid Container:

FIG. 14 is a schematic view showing the flow of the liquid within the liquid container 100A. In the following description, the flow of the liquid within the liquid container 100A will be described with reference to FIGS. 11, 12, and 13 in the liquid container 100A, the liquid substantially flows through the first liquid chamber 132, the second liquid chamber 133, the third liquid chamber 134, the residue prevention groove 136, the differential pressure valve chamber 150, and the liquid supply portion 112 in this order.

As indicated by an arrow LF1 in FIG. 14, the liquid within the first liquid chamber 132 enters, from an opening 132*h* (see FIG. 11) provided in a bottom portion of the first liquid chamber 132, an end portion of the fourth communication path 175 on the side of the −Y direction which extends in the Y axis direction on the back surface side. As indicated by an arrow LF2 in FIG. 14, the atmosphere in the fourth communication path 175 enters, from an opening 175*h* (see FIG. 12) provided at an end portion of the fourth communication path 175 on the side of the +Y direction, a lower portion of the second liquid chamber 133 on the side of the −Y direction which is provided on the front surface side. The liquid within the second liquid chamber 133 enters, through a slit 133*s* (see FIG. 11) provided at an end portion of the rib 130 on the side of the +Y direction which configures the bottom wall of the second liquid chamber 133, a fifth communication path 176 which is provided below the second liquid chamber 133 and which extends in the Y axis direction. As indicated by an arrow LF3 in FIG. 14, the liquid in the fifth communication path 176 enters, through an opening 176*h* (see FIG. 11) provided at an end portion of the fifth communication path 176 on the side of the −Y direction, an end portion of a sixth communication path 177 on the side of the +Z direction and the side of the −Y direction which is provided on the back surface side of the liquid container 100A. As indicated by an arrow LF4 in FIG. 14, the liquid in the sixth communication path 177 enters, through an opening 177*h* (see FIG. 12) provided at an end portion of the sixth communication path 177 on the side of the −Z axis direction and the side of the +Y direction, an end portion of the second storage chamber 134B of the third liquid chamber 134 on the side of the +Z direction which is provided on the front surface side. The liquid flows downward along the rib 130 within the third liquid chamber 134.

As indicated by an arrow LF5 in FIG. 14, the liquid within the third liquid chamber 134 is passed through the residue prevention groove 136 and enters an end portion of an eighth communication path 179 on the side of the −Y direction which is provided on the back surface side of the liquid container 100A and which extends in the Y axis direction. As indicated by an arrow LF6 in FIG. 14, the liquid in the eighth communication path 179 enters, through an opening 179*h* (see FIG. 12) provided on an end portion of the eighth communication path 179 on the side of the +Y direction, an end portion of a ninth communication path 180 on the side of the −Y direction which is provided on the front surface side and which extends along the Y axis direction. As indicated by an arrow LF7 in FIG. 14, the liquid in the ninth communication path 180 enters, through an opening 180*h* (see FIG. 11) provided at an end portion of the ninth communication path 180 on the side of the −Y direction, an end portion of a tenth communication path 181 on the side of the −Z axis direction and the side of +Y direction which is provided on the back surface side. The liquid flows upward along the tenth communication path 181 and enters, as indicated by an arrow LF8 in FIG. 14, through an opening 181*h* (see FIG. 12) adjacent to the differential pressure valve chamber 150 provided at an end portion of the tenth communication path 181 on the side of the +Z direction and the side of the −Y direction, an end portion of an eleventh communication path 182 on the side of the +Z direction and the side of the +Y direction which is provided on the front surface side. As indicated by an arrow LF9 in FIG. 14, the liquid in the eleventh communication path 182 enters, through an opening 182*h* (see FIG. 11) provided at an end portion of the eleventh communication path 182 on the side of the −Z direction and the −Y direction, the differential pressure valve chamber 150 (see FIG. 12) provided on the back surface side.

The valve member (unillustrated) within the differential pressure valve chamber 150 is configured to open when a pressure on the side of the liquid supply portion 112 is lowered and to close when the pressure is increased. When the liquid is jetted from the head 11 so as to lower the pressure on the side of the liquid supply portion 112, the valve member is opened, and thus the liquid within the eleventh communication path 182 which is on the upstream side with respect to the differential pressure valve chamber 150 is passed through an opening 150*h* (see FIG. 12) provided in the differential pressure valve chamber 150 and enters, as indicated by an arrow LF10 in FIG. 14, a twelfth communication path 183 (see FIG. 11) which is provided on the front surface side of the liquid container 100A and which extends in the Z axis direction. As indicated by an arrow LF11 in FIG. 14, the liquid in the twelfth communication path 183 is passed through an opening 183*h* (see FIG. 11) provided at an end portion of the twelfth communication path 183 on the side of the −Z direction and reaches the liquid supply portion 112.

1-3-5. Other Configurations in Liquid Storage Portion:

FIGS. 10 and 11 will be referenced. The liquid storage portion 110 includes vertical ribs 192 which extend along the Z axis direction. The vertical ribs 192 extend within the second liquid chamber 133 from an end portion of the second liquid chamber 133 on the side of the +Z direction to an end portion on the side of the −Z direction. In the second liquid chamber 133, the two vertical ribs 192 are provided. The end faces of the vertical ribs 192 on the side of the −X direction are not welded to the first film FLa.

The vertical ribs 192 function as "separation prevention ribs". The vertical ribs 192 are provided within the second liquid chamber 133, and thus, for example, when the liquid container 100A is dropped, the movement of the liquid within the second liquid chamber 133 is received by the vertical ribs 192, with the result that the rapid movement of the liquid is reduced. Hence, the application of impacts to the ribs 130 with which the second liquid chamber 133 is formed by partition and the welded part of the first film FLa caused by the movement of the liquid is relieved. Consequently, it is possible to reduce the separation of the first film FLa from the ribs 130.

As described above, the vertical ribs 192 are not joined to the first film FLa. Hence, for example, when the liquid of the liquid storage portion 110 is frozen so as to be expanded, a failure is reduced in which the first film FLa is joined to the vertical ribs 192 and in which thus the first film FLa is torn from the junction thereof. Between the end faces of the vertical ribs 192 on the side of the −X direction and the first film FLa, gaps for circulating the liquid are provided. Hence, in a step of welding the first film FLa to the ribs 130, the erroneous welding of the first film FLa to the vertical ribs 192 is reduced. In addition, even when the entire liquid container 100A is reduced in pressure at the time of shipment of the liquid container 100A, the first film FLa is able to be supported from inside the liquid container 100A with the vertical ribs 192 without stress.

Figure 15:
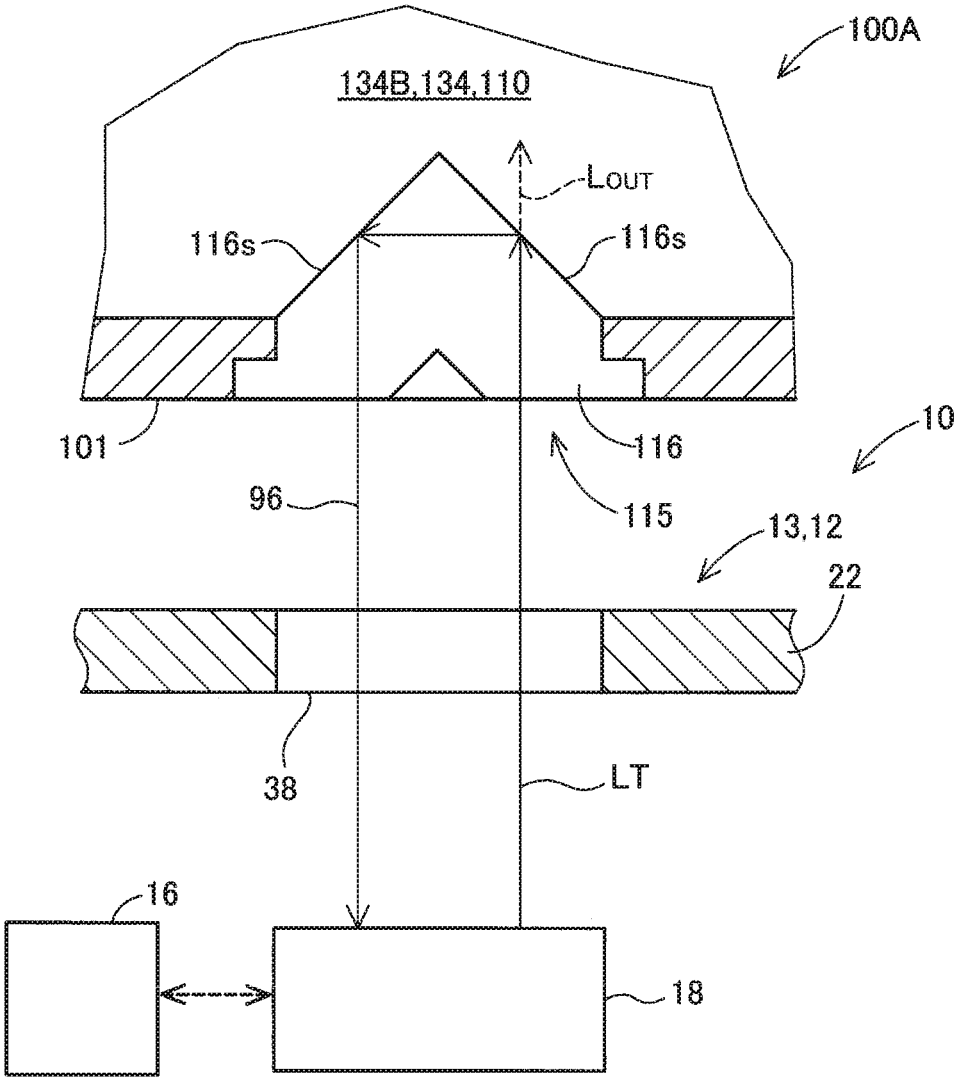
FIG. 15 is a schematic view for illustrating a method of detecting the remaining state of the liquid with a liquid detection portion.

1-3-6. Method of Detecting Remaining State of Liquid:

FIG. 15 is a schematic view for illustrating a method of optically detecting the remaining state of the liquid in the liquid detection portion 110 through the liquid detection portion 115. In the liquid container 100A, the optical component 116 of the liquid detection portion 115 is embedded in the first wall portion 101 forming the bottom surface of the second storage chamber 134B in the liquid storage portion 110 so as to be exposed to the liquid.

The control portion 16 of the liquid consumption device 10 emits, in a detection processing for detecting the remaining state of the liquid in the liquid container 100A, a light LT toward the carriage 12 from the light emitting element of the liquid detector portion 18 provided below the reciprocation path of the carriage 12. The light LT of the liquid detector portion 18 is passed through the window portion 38 provided on the bottom wall 22 of the holder 13 so as to enter the liquid detection portion 115 provided in the first wall portion 101 of the liquid container 100A.

Here, when the position of the surface of the liquid within the liquid storage portion 110 is higher than a reflection surface 116*s* of the optical component 116, the light LT entering the optical component 116 travels from the reflection surface 116*s* to the outside of the optical component 116 as indicated by an arrow LOUT. Hence, when the surface of the liquid within the liquid storage portion 110 is higher than the reflection surface 116*s*, the light receiving element of the liquid detector portion 18 is not able to detect the light LT. In this case, the control portion 16 determines that the predetermined and specified amount of liquid is left in the liquid storage portion 110.

On the other hand, when the position of the surface of the liquid within the liquid storage portion 110 is lower than the reflection surface 116*s*, the light LT which enters the optical component 116 is repeatedly reflected off the reflection surface 116*s* so as to be emitted from the optical component 116 toward the liquid detector portion 18. Hence, when the surface of the liquid within the liquid storage portion 110 lower than the reflection surface 116*s*, the light receiving element of the liquid detector portion 18 is able to detect the light LT. In this case, the control portion 16 determines that the specified amount of liquid is not left in the liquid storage portion 110.

Figure 16:
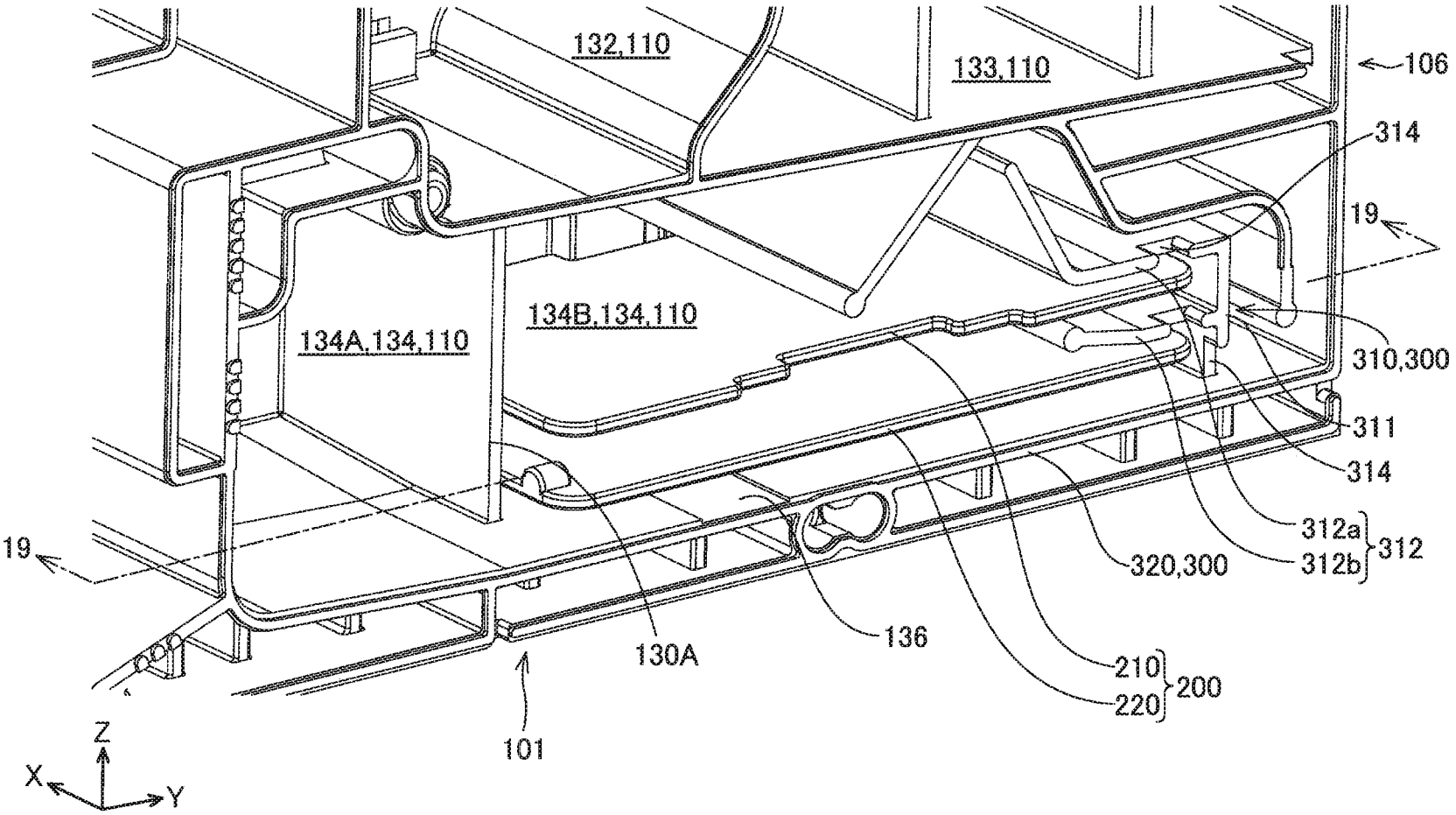
FIG. 16 is a schematic perspective view showing undulation reduction portions and a support portion thereof in the first embodiment.

1-3-7. Configurations of Undulation Reduction Portions and Support Portion:

The configurations of the undulation reduction portions 200 and the support portion 300 thereof provided in the liquid storage portion 110 will be described with reference to FIGS. 16 to 20. FIG. 16 is a schematic perspective view extracting and showing the third liquid chamber 134 in which the undulation reduction portions 200 and the support portion 300 thereof are provided.

In the second storage chamber 134B of the third liquid chamber 134, the undulation reduction portions 200 are provided. In the first embodiment, the plurality of undulation reduction portions 200 include two undulation reduction portions, which are a first undulation reduction portion 210 and a second undulation reduction portion 220. In the second storage chamber 134B, the first undulation reduction portion 210 and the second undulation reduction portion 220 are arranged vertically. The first undulation reduction portion 210 is arranged above the second undulation reduction portion 220. In the following description, when they are referred to as the "undulation reduction portions 200", this indicates both the first undulation reduction portion 210 and the second undulation reduction portion 220.

The undulation reduction portions 200 are configured with plate-shaped members. The undulation reduction portions 200 have a long shape, with the Y axis direction being a longitudinal direction. The undulation reduction portions 200 are configured of, for example, a resin material such as polypropylene. The undulation reduction portions 200 are arranged, in the liquid storage portion 110, along the direction of reciprocation of the carriage 12. More specifically, the undulation reduction portions 200 are arranged along a horizontal plane. As will be described below, since the undulation reduction portions 200 are supported by the support portion 300 in a state where they are allowed to swing together with the liquid, the posture of the arrangement thereof is changed according to the movement of the liquid in the liquid storage portion 110.

The undulation reduction portions 200 are supported by the support portion 300 such that the undulation reduction portions 200 are allowed to swing together with the liquid in the liquid storage portion 110 and that the movement thereof along the direction of gravity is restricted. Here, the "supporting" means that the undulation reduction portions 200 should be maintained a state where the movement to a position falling outside the range of a predetermined arrangement region is restricted.

The support portion 300 of the first embodiment is configured with a support rib 310 and a support bottom wall portion 320. The support rib 310 is one of the ribs 130 provided within the liquid storage portion 110. The support bottom wall portion 320 is a wall portion which configures part of the first wall portion 101 and which configures the bottom surface of the second storage chamber 134B.

The support rib 310 is provided in a position that is close to an end portion of the second storage chamber 134B on the side of the +Y direction, that is, a position that is closer to the sixth wall portion 106 than the partition rib 130A with which the first storage chamber 134A and the second storage chamber 134B are partitioned. The support rib 310 is located on the side of the +Y direction with respect to the undulation reduction portions 200. The support rib 310 includes a vertical support rib 311 which extends from the support bottom wall Portion 320 in the Z direction and a horizontal support rib 312 which extends from the vertical support rib 311 toward the −Y direction. In the first embodiment, the horizontal support rib 312 includes two horizontal support ribs, which are a first horizontal support rib 312*a* and a second horizontal support rib 312*b* that are aligned in the Z axis direction. The first horizontal support rib 312*a* is located above the second horizontal support rib 312*b*.

The undulation reduction portions 200 including the first undulation reduction portion 210 and the second undulation reduction portion 220 is located respectively along the direction of gravity. In the first embodiment, parts of the undulation reduction portions 200 on the side of end portions in the +Y direction, that is, parts of the undulation reduction portions 200 which are located on the side of the +Y direction with respect to the centers thereof in the Y axis direction are supported by the horizontal support ribs 312*a* and 312*b*.

The part of the first undulation reduction portion 210 on the side of the end portion in the +Y direction is supported between the first horizontal support rib 312*a* and the second horizontal support rib 312*b*. The first horizontal support rib 312*a* is located above the part of the first undulation reduction portion 210 on the side of the end portion in the +Y direction. The first horizontal support rib 312*a* functions as an upper support portion for the first undulation reduction portion 210. The first horizontal support rib 312*a* restricts the upward movement of the part of the first undulation reduction portion 210 on the side of the end portion in the +Y direction beyond the first horizontal support rib 312*a*.

The second horizontal support rib 312*b* is located below the part of the first undulation reduction portion 210 on the side of the end portion in the +Y direction. The second horizontal support rib 312*b* functions as a lower support portion for the first undulation reduction portion 210. The second horizontal support rib 312*b* restricts the downward movement of the part of the first undulation reduction portion 210 on the side of the end portion in the +Y direction beyond the second horizontal support rib 312*b*.

An interval between the first horizontal support rib 312*a* and the second horizontal support rib 312*b* is greater than the thickness of the part of the first undulation reduction portion 210 on the side of the end portion in the +Y direction sandwiched between the first horizontal support rib 312*a* and the second horizontal support rib 312*b*. Here, the "interval between the first horizontal support rib 312*a* and the second horizontal support rib 312*b*" means the minimum value of the distance in the Z axis direction between the first horizontal support rib 312*a* and the second horizontal support rib 312*b*. In this configuration, the support portion 300 allows the part of the first undulation reduction portion 210 on the side of the end portion in the +Y direction to vertically swing together with the liquid in the second storage chamber 134B. The support portion 300 also restricts a range of the movement of the part of the first undulation reduction portion 210 on the side of the end portion in the +Y direction along the direction of gravity to a range sandwiched between the first horizontal support rib 312*a* serving as an upper support portion and the second horizontal support rib 312*b* serving as a lower support portion.

The second undulation reduction portion 220 is supported between the second horizontal support rib 312*b* and the support bottom wall portion 320. The second horizontal support rib 312*b* is located above the part of the second undulation reduction portion 220 on the side of the end portion in the +Y direction. The second horizontal support rib 312*b* functions as an upper support portion for the second undulation reduction portion 220. The second horizontal support rib 312*b* restricts the upward movement of the part of the second undulation reduction portion 220 on the side of the end portion in the +Y direction beyond the second horizontal support rib 312*b*.

The support bottom wall portion 320 is located below the second undulation reduction portion 220. The support bottom wall portion 320 functions as the lower support portion for the second undulation reduction portion 220. The support bottom wall portion 320 restricts the downward movement of the second undulation reduction portion 220 beyond the support bottom wall portion 320.

An interval between the second horizontal support rib 312*b* and the support bottom wall portion 320 is greater than the thickness of the part of the second undulation reduction portion 220 on the side of the end portion in the +Y direction sandwiched between the second horizontal support rib 312*b* and the support bottom wall portion 320. Here, the "interval between the second horizontal support rib 312*b* and the support bottom wall portion 320" means the minimum value of the distance in the Z axis direction between the second horizontal support rib 312*b* and the support bottom wall portion 320. In this configuration, the support portion 300 allows the part of the second undulation reduction portion 220 on the side of the end portion in the +Y direction to vertically swing together with the liquid in the second storage chamber 134B. The support portion 300 also restricts a range of the movement of the part of the second undulation reduction portion 220 on the side of the end portion in the +Y direction in the direction of gravity to a range sandwiched between the second horizontal support rib 312*b* serving as the upper support portion and the support bottom wall portion 320 serving as the lower support portion.

The lengths of the undulation reduction portions 200 in the Y axis direction are smaller than an interval between the vertical support rib 311 and the rib 130A. The "interval between the vertical support rib 311 and the rib 130A" means the minimum value of the distance in the Y axis direction between the vertical support rib 311 and the rib 130A. In this configuration, the undulation reduction portions 200 are allowed to swing in the Y axis direction. When the end portions of the undulation reduction portions 200 in the −Y direction are brought into contact with the rib 130A, the end portions of the undulation reduction portions 200 in the +Y direction are located so as to overlap the horizontal support rib 312 in the Z axis direction. Hence, even when the undulation reduction portions 200 swing in the Y axis direction, the possibility of the falling off of the undulation reduction portions 200 from the support portion 300 is reduced.

In the first embodiment, the end face of the support rib 310 on the side of the −X direction is located on the side of the +X direction with respect to the first film FLa. In this way, a gap through which the liquid is able to be circulated is formed between the end face of the support rib 310 on the side of the −X direction and the first film FLa is formed, and thus the inhibition of the flow of the liquid in the second storage chamber 134B by the support rib 310 is reduced. In the first embodiment, in an end portion of the support rib 310 on the side of the −X direction, a recess portion 314 is formed whose part is recessed in the shape of a cut toward the side of the +X direction. The support rib 310 includes the recess portion 314, and thus the inhibition of the flow of the liquid in the second storage chamber 134B by the support rib 310 is further reduced. In other embodiments, at least part of the end face of the support rib 310 on the side of the X direction may be located so as to make contact with the first film FLa. In other embodiments, the recess portion 314 of the support rib 310 may be omitted or may be provided in a place other than the illustrated position.

The shapes of the first undulation reduction portion 210 and the second undulation reduction portion 220 will be described with reference to FIGS. 17A to 17C and 18A to 18D. In FIGS. 17A to 17C and 18A to 18D, X, Y and Z axes are shown when the first undulation reduction portion 210 and the second undulation reduction portion 220 are in a horizontal posture in which they are arranged horizontally in the liquid storage portion 110 when the liquid container 100A is in the fitting posture.

Figure 17A:
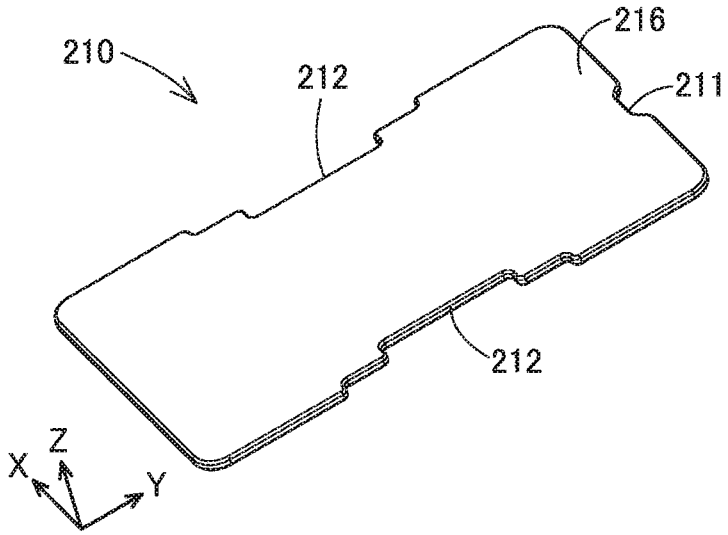
FIG. 17A is a schematic perspective view showing a first undulation reduction portion in the first embodiment.
Figure 17B:
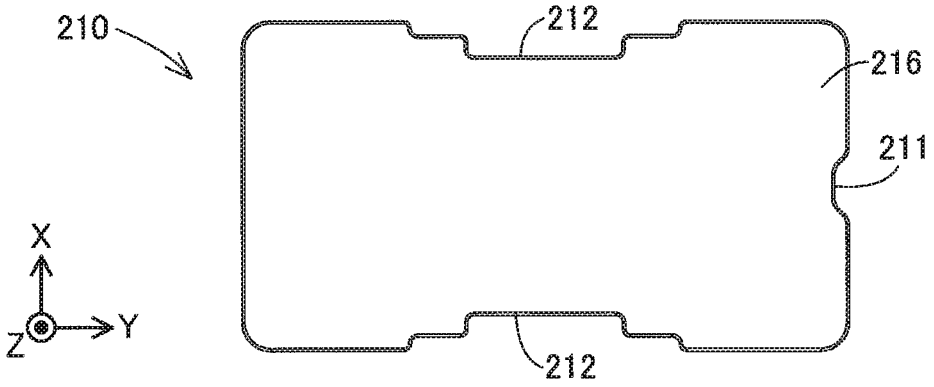
FIG. 17B is a schematic plan view showing the first undulation reduction portion in the first embodiment.
Figure 17C:
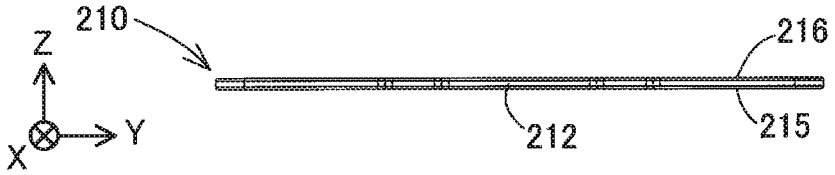
FIG. 17C is a schematic side view showing the first undulation reduction portion in the first embodiment.

FIG. 17A is a schematic perspective view when the first undulation reduction portion 210 is seen from the side of the +Z direction. FIG. 17B is a schematic a plan view when the first undulation reduction portion 210 is seen in a plan view in the −Z direction. FIG. 17C is a schematic side view when the first undulation reduction portion 210 is seen in a plan view in the +X direction.

FIGS. 17A and 17B will be referenced. The first undulation reduction portion 210 has a flat plate shape which extends in the X axis direction and the Y axis direction. The first undulation reduction portion 210 is formed in a substantially rectangular shape, with the Y axis direction being a horizontal direction.

The first undulation reduction portion 210 includes a first concave portion 211 in an end portion in the +Y direction in which part thereof is recessed in the −Y direction. The first undulation reduction portion 210 includes the first concave portion 211, and thus even when the end portion of the first undulation reduction portion 210 on the side of the +Y direction is in contact with the vertical support rib 311, a space through which the liquid is able to be circulated is formed between the end portion and the vertical support rib 311. Hence, the inhibition of the flow of the liquid in the liquid storage portion 110 due to the first undulation reduction portion 210 is reduced.

The first undulation reduction portion 210 includes second concave portions 212 in end portions in the +X direction and the −X direction in which parts thereof are recessed in the X axis direction. By the second concave portions 212, spaces through which the liquid is able to be circulated are formed on the sides of the first undulation reduction portion 210 in the +X direction and the −X direction. Hence, the prevention of the circulation of the liquid within the liquid storage portion 110 due to the first undulation reduction portion 210 is further reduced.

FIG. 17C will be referenced. A lower wall surface 215 which is the wall surface of the first undulation reduction portion 210 that is directed in the −Z direction and an upper wall surface 216 which is the wall surface that is directed in the +Z direction are preferably configured as smooth surfaces which do not have projections and recesses. In this way, the liquid is made to easily flow on both the wall surfaces 215 and 216, and thus a failure is reduced in which the liquid remains adhered to the first undulation reduction portion 210 and is thus left in the liquid storage portion 110.

Figure 18A:
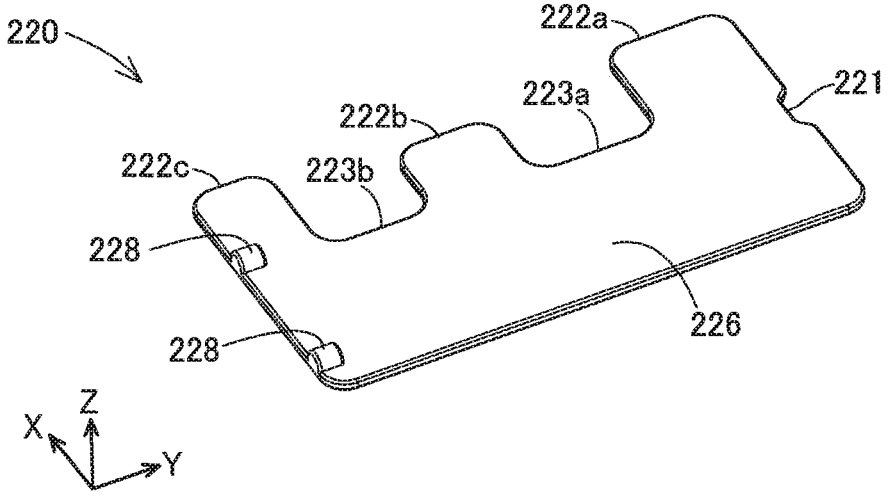
FIG. 18A is a first schematic perspective view showing a second undulation reduction portion in the first embodiment.
Figure 18B:
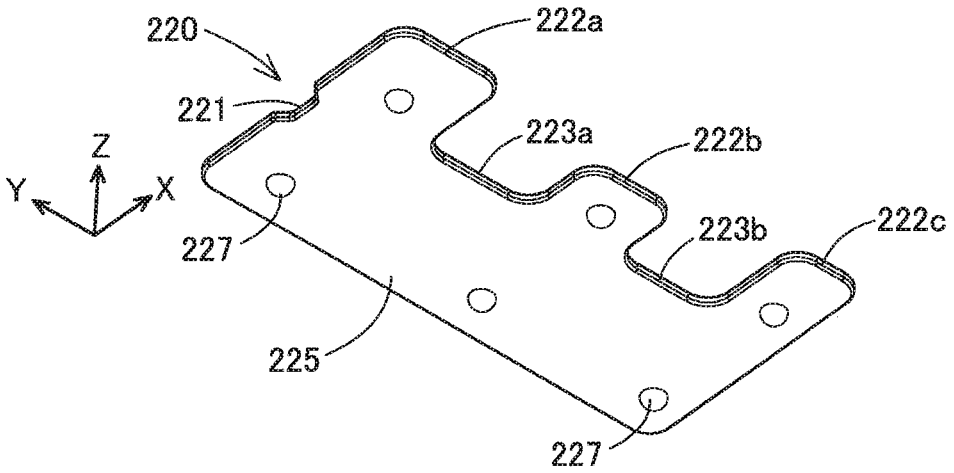
FIG. 18B is a second schematic perspective view showing the second undulation reduction portion in the first embodiment.
Figure 18C:
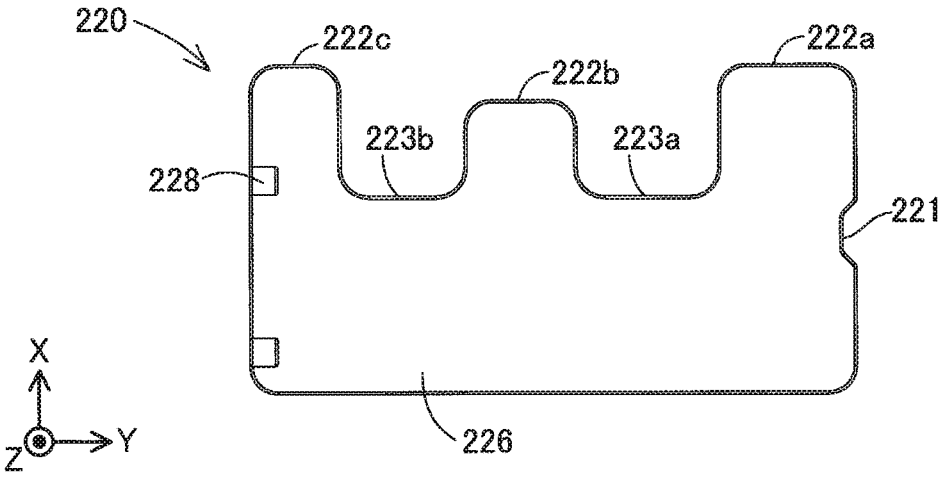
FIG. 18C is a schematic plan view showing the second undulation reduction portion in the first embodiment.
Figure 18D:
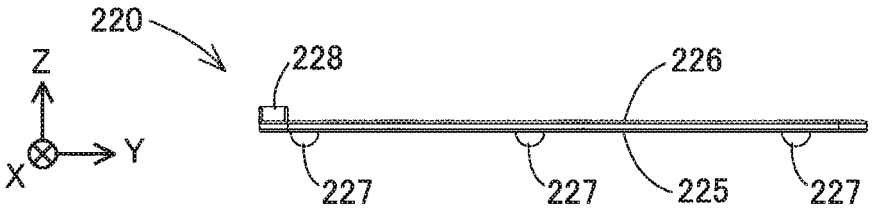
FIG. 18D is a schematic side view showing the second undulation reduction portion in the first embodiment.

FIG. 18A is a schematic perspective view when the second undulation reduction portion 220 is seen in the +Z direction. FIG. 18B is a schematic perspective view when the second undulation reduction portion 220 is seen in the −Z direction. FIG. 18C is a schematic a plan view when the second undulation reduction portion 220 is seen in a plan view in the −Z direction. FIG. 18D is a schematic side view when the second undulation reduction portion 220 is seen in a plan view in the +X direction.

FIGS. 18A to 18C will be referenced. The second undulation reduction portion 220 has a flat plate shape which extends in the X axis direction and the Y axis direction. In an end portion of the second undulation reduction portion 220 in the +Y direction, a first concave portion 221 is provided in which part thereof is recessed toward the side of the −Y direction. The second undulation reduction portion 220 includes the first concave portion 221, and thus even when the end portion of the second undulation reduction portion 220 in the +Y direction is in contact with the vertical support rib 311, a space through which the liquid is able to be circulated is formed between the end portion and the vertical support rib 311. Hence, the inhibition of the flow of the liquid in the liquid storage portion 110 due to the second undulation reduction portion 220 is reduced.

The second undulation reduction portion 220 includes, in an end portion on the side of the +X direction, a plurality of extension portions 222*a* to 222*c* which extend in the +X direction and which are substantially rectangular. The extension portions 222*a* to 222*c* include parts of a wall surface 225. Between the first extension portion 222*a* located at an end on the side of the +Y direction and the second extension portion 222*b* located on the side of the −Y direction with respect thereto, a first concave portion 223*a* which is substantially rectangular is formed. Between the second extension portion 222*b* and the third extension portion 222*c* located at an end on the side of the −Y direction, a second concave portion 223*b* which is substantially rectangular is formed. The reason why the second undulation reduction portion 220 includes the concave portions 223*a* and 223*b* will be described later.

FIGS. 18B and 18D will be referenced. The second undulation reduction portion 220 includes, on a lower wall surface 225 on the side of a bottom surface which faces the support bottom wall portion 320 configuring the bottom surface of the liquid storage portion 110, a plurality of leg portions 227 which protrude toward the bottom surface of the liquid storage portion 110 in the −Z direction. The function of the leg portions 227 will be described later.

FIGS. 18A and 18D will be referenced. In an end portion of an upper wall surface 226 of the second undulation reduction portion 220 which is directed in the +Z direction, a plurality of protrusion portions 228 are provided which protrude in the +Z direction and which are aligned along the X axis direction. In the first embodiment, two protrusion portions 228 are provided. The function of the protrusion portions 228 will be described later.

Figure 19:
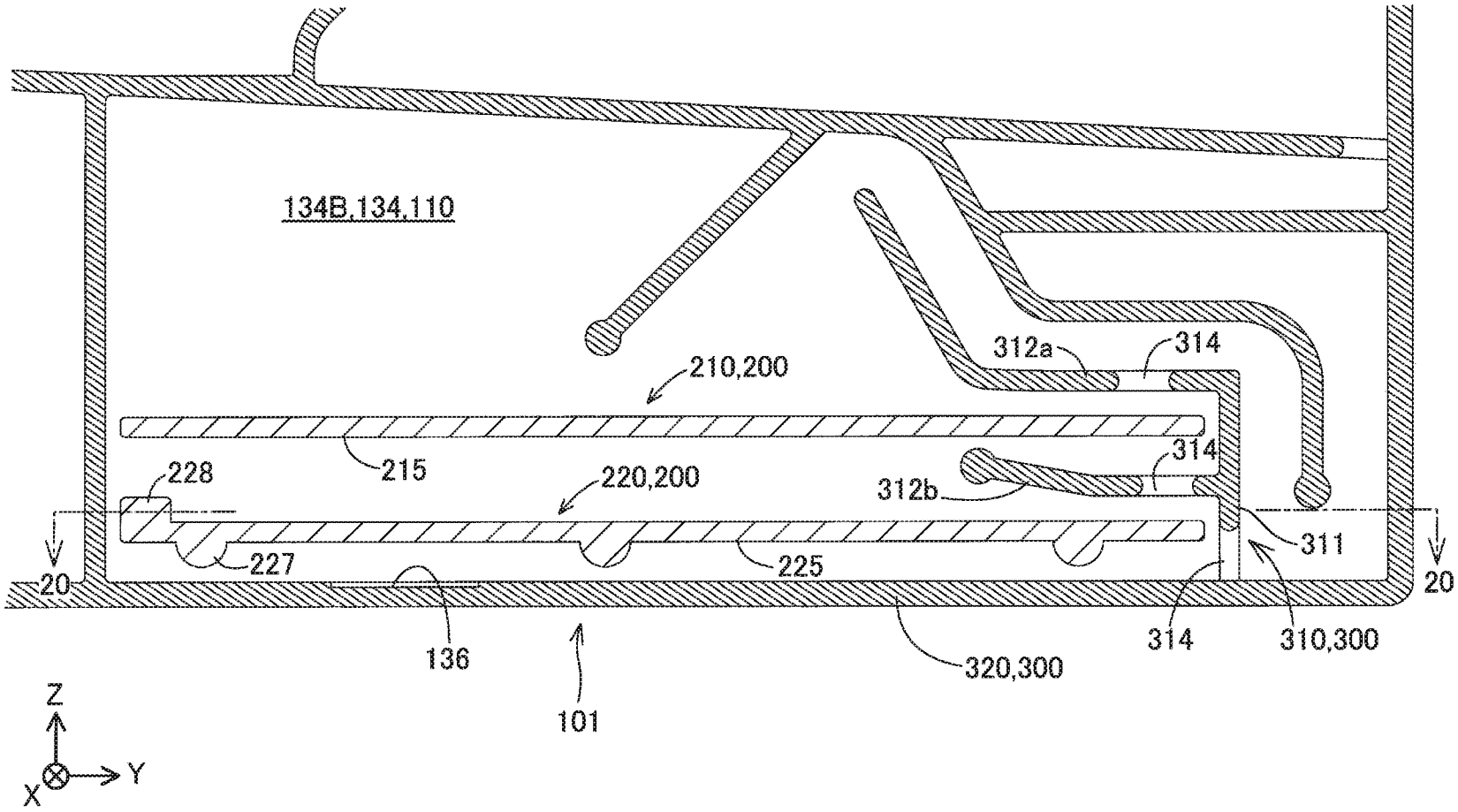
FIG. 19 is a first schematic cross-sectional view of a liquid storage portion in the first embodiment.

The functions of the undulation reduction portions 200 and the support portion will be described with reference to FIG. 19. FIG. 19 is a schematic cross-sectional view of the liquid storage portion 110 taken along line 19-19 shown in FIG. 16. In the liquid storage portion 110, the liquid is repeatedly moved and shaken by an inertial force produced when the carriage 12 reciprocates, and thus the liquid swings.

In the liquid container 100A, the undulation reduction portions 200 having the wall surfaces 215 and 225 directed downward are arranged along the direction of reciprocation of the carriage 12 in the second storage chamber 134B of the liquid storage portion 110 in a state where the undulation reduction portions 200 are supported by the support portion 300. The wall surfaces 215 and 225 directed downward function so as to prevent the vertical movement of the liquid. The undulation reduction portions 200 are supported by the support portion 300 such that the movement of the wall surfaces 215 and 225 along the direction of gravity is restricted. More specifically, the range of the movement of the wall surfaces 215 and 225 along the direction of gravity is restricted. Hence, the range of the swinging of the wall surfaces 215 and 225 of the undulation reduction portions 200 along the direction of gravity is reduced as compared with the range of the swinging of the liquid along the direction of gravity, and thus the significant swinging of the liquid together will the wall surfaces 215 and 225 is reduced. In this way, an effect of reducing the swinging of the liquid with the wall surfaces 215 and 225 is more enhanced. The undulation of the liquid in the liquid storage portion 110 is reduced, and thus the production of air bubbles in the liquid caused by the collision of the liquid and the inner wall surfaces of the liquid storage portion 110 is reduced. Hence, a problem is reduced in which the liquid mixed with the air bubbles is supplied to the head 11 so as to cause a failure in the jetting of the liquid.

Here, as the liquid in the liquid storage portion 110 is consumed, the position of the surface of the liquid may be lowered beyond a predetermined height position, that is, the position of the horizontal support rib 312 which specifies the lower limit position of the range of the movement of the first undulation reduction portion 210. In this case, at least part of the lower wall surface 215 of the first undulation reduction portion 210 is supported, by the second horizontal support rib 312*b* serving as the lower support portion, in a position higher than the surface of the liquid, and thus the wall surface 215 of the first undulation reduction portion 210 reduces the vertical undulation of the liquid from above. Moreover, by the first horizontal support rib 312*a* serving as the upper support portion and the second horizontal support rib 312*b*, the upward movement of the wall surface 215 of the first undulation reduction portion 210 and the wall surface 225 of the second undulation reduction portion 220 is restricted. Hence, the pushing up of the wall surfaces 215 and 225 by the liquid is reduced, and thus the upward movement of the liquid is able to be stopped by the wall surfaces 215 and 225. Therefore, even in a state where the amount of liquid left in the liquid storage portion 110 is reduced, the swinging of the liquid is effectively reduced.

In the liquid container 100A, the undulation reduction portions 200 are supported by the support portion 300 so as to be allowed to swing together with the liquid. When the carriage 12 reciprocates, the undulation reduction portions 200 swing together with the liquid, and thus even when the liquid is adhered to the surfaces of the undulation reduction portions 200, the falling off of the liquid from the undulation reduction portions 200 is facilitated by the swinging. Hence, a failure is reduced in which the liquid remains adhered to the undulation reduction portions 200 and is thus left in the liquid storage portion 110.

Moreover, the liquid within the liquid storage portion 110 is agitated by the swinging of the undulation reduction portions 200, and thus the occurrence of unevenness of the density of the liquid caused by the precipitation of a precipitation component is reduced. Hence, the nonuniformity of the density of the liquid supplied to the head 11 is reduced, and thus the degradation of quality of a printed image caused by the nonuniformity of the density of the jetted liquid is reduced.

In the liquid container 100A, it is possible to effectively reduce the undulation of the liquid with the undulation reduction portions 200 which are plate-shaped members and which are simply configured. The undulation reduction portions 200 preferably have such strength as to prevent deformation caused by the swinging of the liquid when the undulation reduction portions 200 are arranged in the liquid. The undulation reduction portions 200 also preferably have such strength as to prevent deformation when only one end portion thereof is fixed and supported horizontally. In this way, it is possible to more effectively reduce the undulation of the liquid.

The specific gravity of the undulation reduction portions 200 is preferably lower than that of the liquid stored in the liquid storage portion 110. The specific gravity here may be with reference to water. In this way, the undulation reduction portions 200 are able to float in the liquid storage portion 110 by buoyancy which the undulation reduction portions 200 receive from the liquid. Hence, when the position of the surface of the liquid is lowered beyond the horizontal support rib 312, the undulation reduction portions 200 are able to be floated on the surface of the liquid, and thus it is possible to effectively reduce the undulation of the surface of the liquid.

The thickness of the undulation reduction portions 200 is preferably minimized. In this way, it is possible to reduce the lowering of the amount of liquid stored in the liquid storage portion 110 caused by the arrangement of the undulation reduction portions 200 in the liquid storage portion 110.

In the liquid container 100A, the first undulation reduction portion 210 and the second undulation reduction portion 220 are supported by the support portion 300 in a state where they are arranged vertically. Hence, when the liquid in the liquid storage portion 110 is consumed so as to lower the surface of the liquid to a height position between the first horizontal support rib 312*a* and the second horizontal support rib 312*b*, it is possible to reduce the swinging of the liquid with the wall surface 215 of the first undulation reduction portion 210 from above. When the surface of the liquid is lowered to a height position between the second horizontal support rib 312*b* and the support bottom wall portion 320, it is possible to reduce the swinging of the liquid with the wall surface 225 of the second undulation reduction portion 220 from above.

As described above, in the liquid container 100A, even when the surface of the liquid is lowered as the liquid is consumed, it is possible to effectively reduce the swinging of the liquid with the undulation reduction portions 200 which are arranged vertically and which are at heights close to the position of the surface of the liquid. Hence, the change of the effect of reducing the undulation of the liquid with the undulation reduction portions 200 caused by a change in the amount of liquid stored in the liquid storage portion 110 is reduced.

In the liquid container 100A, the undulation reduction portions 200 are arranged in the third liquid chamber 134 in which the amount of liquid stored is the largest among the multiple liquid chambers 132 to 134 configuring the liquid storage portion 110. Hence, in the liquid container 100A, by reducing the undulation of the liquid with the undulation reduction portions 200, a large effect is obtained. In the liquid container 100A, the undulation reduction portions 200 are arranged in the third liquid chamber 134 closest to the liquid supply portion 112 among the multiple liquid chambers 132 to 134 configuring the liquid storage portion 110. Hence, the supply of the liquid containing air bubbles produced by the swinging of the liquid to the liquid supply portion 112 is reduced.

In the liquid storage portion 110, the wall surfaces 215 and 225 of the undulation reduction portions 200 are preferably extended in a direction along the horizontal direction so as to cover a wider range so that the wall surfaces 215 and 225 are able to reduce the undulation of the liquid in the wider range. The area of the wall surfaces 215 and 225 of the undulation reduction portions 200 is preferably more than or equal to 50% of the horizontal cross-sectional area of the liquid storage portion 110 at heights where the wall surfaces 215 and 225 are arranged, and is more preferably more than or equal to 80% thereof.

As described previously, on the wall surface 225 of the second undulation reduction portion 220, the leg portions 227 are formed. The second undulation reduction portion 220 includes the leg portions 227, and thus when the second undulation reduction portion 220 is located in the lowest position in the second storage chamber 134B, gaps are formed between the second undulation reduction portion 220 and the bottom surface of the second storage chamber 134B. Hence, a failure is reduced in which the second undulation reduction portion 220 is stuck to the bottom surface of the second storage chamber 134B so as not to swing.

Since spaces through which the liquid is able to be circulated are secured between the second undulation reduction portion 220 and the bottom surface of the second storage chamber 134B, the inhibition of the flow of the liquid in the liquid storage portion 110 by the second undulation reduction portion 220 is reduced. In addition, the blocking of the residue prevention groove 136 provided below the second undulation reduction portion 220 by the wall surface 225 of the second undulation reduction portion 220 is reduced.

The leg portions 227 preferably have a substantially hemispherical shape. It is possible to reduce a contact area between the leg portions 227 and the support bottom wall portion 320 so as to reduce more a failure in which the liquid is left between the leg portions 227 and the support bottom wall portion 320. The leg portions 227 may be interpreted to function as support portions for restricting the range of the movement of the second undulation reduction portion 220 in the direction of gravity.

As described previously, in the end portion of the wall surface 226 of the second undulation reduction portion 220 in the −Y direction which is directed in the +Z direction, the protrusion portions 228 are provided which protrude in the +Z direction and which are arranged along the X axis direction. By the protrusion portions 228, gaps between an end portion of the first undulation reduction portion 210 in the −Y direction and an end portion of the second undulation reduction portion 220 in the −Y direction are secured. Hence, a failure is reduced in which the liquid is held and left between the end portion of the first undulation reduction portion 210 in the −Y direction and the end portion of the second undulation reduction portion 220 in the Y direction.

In the liquid container 100A, when the main body portion 125A is molded, the support portion 300 is able to be formed together with the other ribs 130. The undulation reduction portions 200 are inserted in the +X direction from an opening of the main body portion 125A on the side of the −X direction, and thus it is possible to bring the undulation reduction portions 200 into a state where the undulation reduction portions 200 are supported by the support portion 300. Hence, it is possible to simply provide a structure for reducing the undulation of the liquid which is configured with the undulation reduction portions 200 and the support portion 300 thereof. Thus, it is possible to simplify steps of manufacturing the liquid container 100A and to reduce the manufacturing cost.

Figure 20:
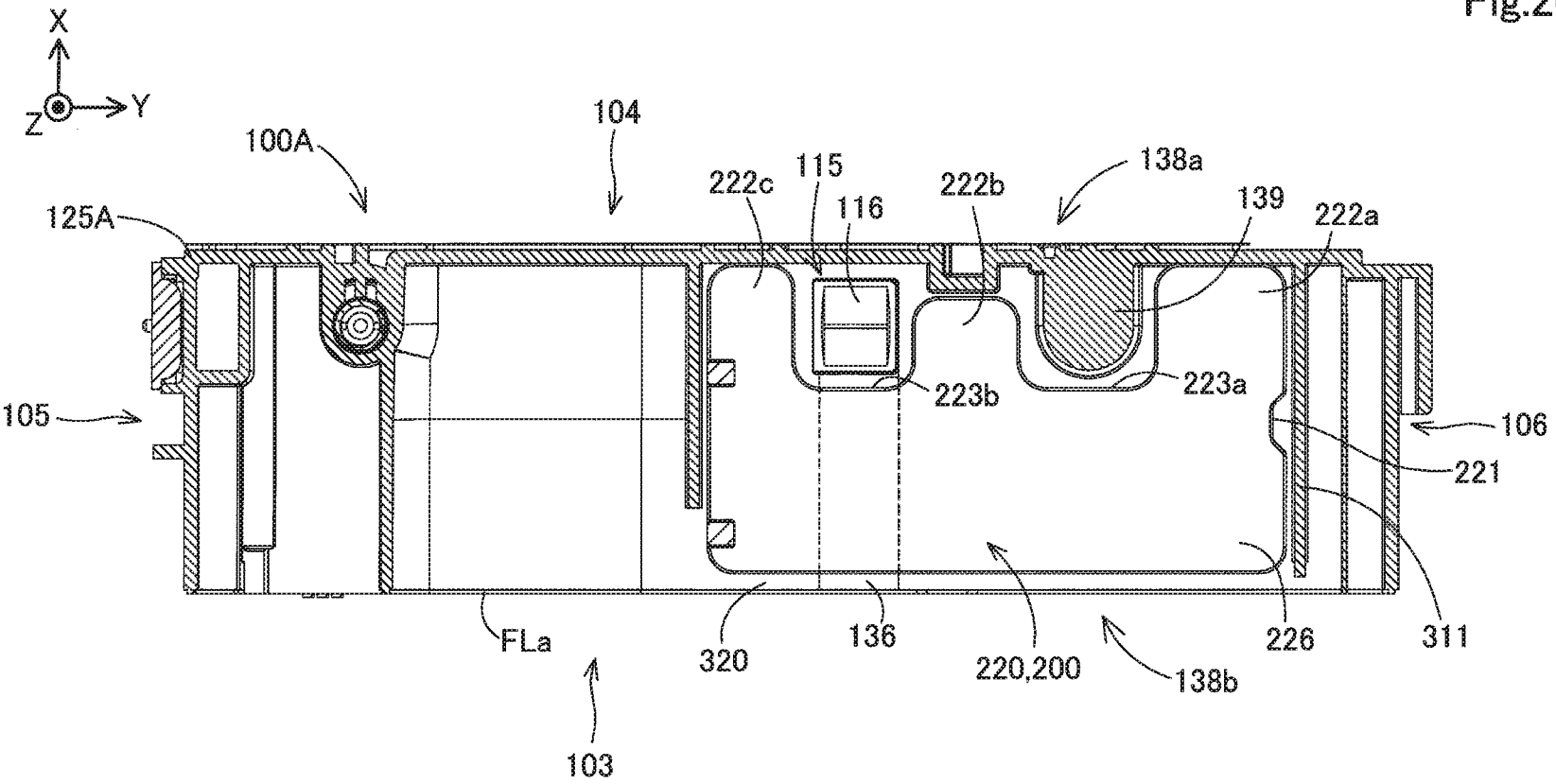
FIG. 20 is a second schematic cross-sectional view of the liquid storage portion in the first embodiment.

FIG. 20 is a schematic cross-sectional view of the liquid storage portion 110 taken along line 20-20 shown in FIG. 19. As described previously, in the bottom surface of the third liquid chamber 134 in the liquid storage portion 110, the residue prevention groove 136 is provided which extends along the X axis direction. In an end portion of the residue prevention groove 136 on the side of the +X direction, a concave portion is formed in which the optical component 116 of the liquid detection portion 115 is stored.

In the liquid container 100A, the undulation reduction portions 200 are provided in the third liquid chamber 134 in which the liquid detection portion 115 is provided. Hence, the occurrence of an erroneous detection of the remaining state of the liquid caused by the liquid detection portion 115 is reduced. In the liquid container 100A, the optical component 116 of the liquid detection portion 115 is arranged in a position which is lower than the bottom surface of the residue prevention groove 136 and in which the liquid left in the liquid storage portion 110 easily gathers. Hence, the accuracy of detection of the remaining state of the liquid is enhanced.

In the liquid container 100A, the second undulation reduction portion 220 has a shape which does not overlap the liquid detection portion 115 when the second undulation reduction portion 220 is seen in the −Z direction extending from the undulation reduction portions 200 toward the bottom surface of the liquid storage portion 110. The liquid detection portion 115 is located in a space within the second concave portion 223*b* which is formed so as to be sandwiched between the second extension portion 222*b* and the third extension portion 222*c*. When seen in the −Z direction, the second concave portion 223*b* is shaped so as to be recessed in the −X direction along the outer periphery of the liquid detection portion 115. In this configuration, the lowering of the accuracy of detection of the remaining state of the liquid with the liquid detection portion 115 caused by the second undulation reduction portion 220 is reduced. The second extension portion 222*b* and the third extension portion 222*c* which extend in the X axis direction while avoiding the region above the liquid detection portion 115 are provided, and accordingly, the area of the wall surface 225 of the second undulation reduction portion 220 is increased, with the result that the effect of reducing the undulation of the liquid with the second undulation reduction portion 220 is enhanced accordingly.

The liquid container 100A includes a first side wall portion 138*a* and a second side wall portion 138*b* which are opposite each other through the undulation reduction portions 200 in a direction along the wall surfaces 215 and 225. In the first embodiment, the first side wall portion 138*a* is configured with part of the fourth wall portion 104 and is opposite the second side wall portion 138*b* and the direction of reciprocation of the carriage 12. The second side wall portion 138*b* is configured with part of the first film FLa.

The first side wall portion 138*a* includes a convex structure 139 which protrudes toward the second side wall portion 138*b*. When seen in the Z direction, the first extension portion 222*a* and the second extension portion 222*b* of the second undulation reduction portion 220 are located, in positions adjacent to the convex structure 139 in the Y axis direction and protrude from the side of the second side wall portion 138*b* to the side of the first side wall portion 138*a*. In the second undulation reduction portion 220 configured as described above, while the convex structure 139 is being avoided, the area of the wall surface 225 of the second undulation reduction portion 220 is able to be increased by only the wall surface 215 included in the two extension portions 222*a* and 222*b*. Hence, it is possible to reduce the undulation of the liquid in the liquid storage portion 110 in a wider range.

1-4. Summary of First Embodiment:

In the liquid container 100A of the first embodiment, with the undulation reduction portions 200 in which the range of the movement is restricted with the support portion 300, it is possible to effectively reduce the swinging of the liquid in the liquid storage portion 110. The undulation reduction portions 200 are supported by the support portion 300 so as to be able to swing, and thus a failure is reduced in which the liquid remains adhered to the undulation reduction portions 200 and is thus left in the liquid storage portion 110. In the liquid consumption device 10 including the liquid container 100A of the first embodiment, the occurrence of a failure in the jetting of the liquid caused by air bubbles mixed in the liquid as a result of the swinging of the liquid is reduced. When the liquid consumption device 10 is a high-speed printer in which the carriage 12 is made to reciprocate at high speed, it is possible to obtain a higher effect. Moreover, in the liquid container 100A of the first embodiment and the liquid consumption device 10 including it, various operational effects described above in the first embodiment are able to be achieved.

Figure 21:
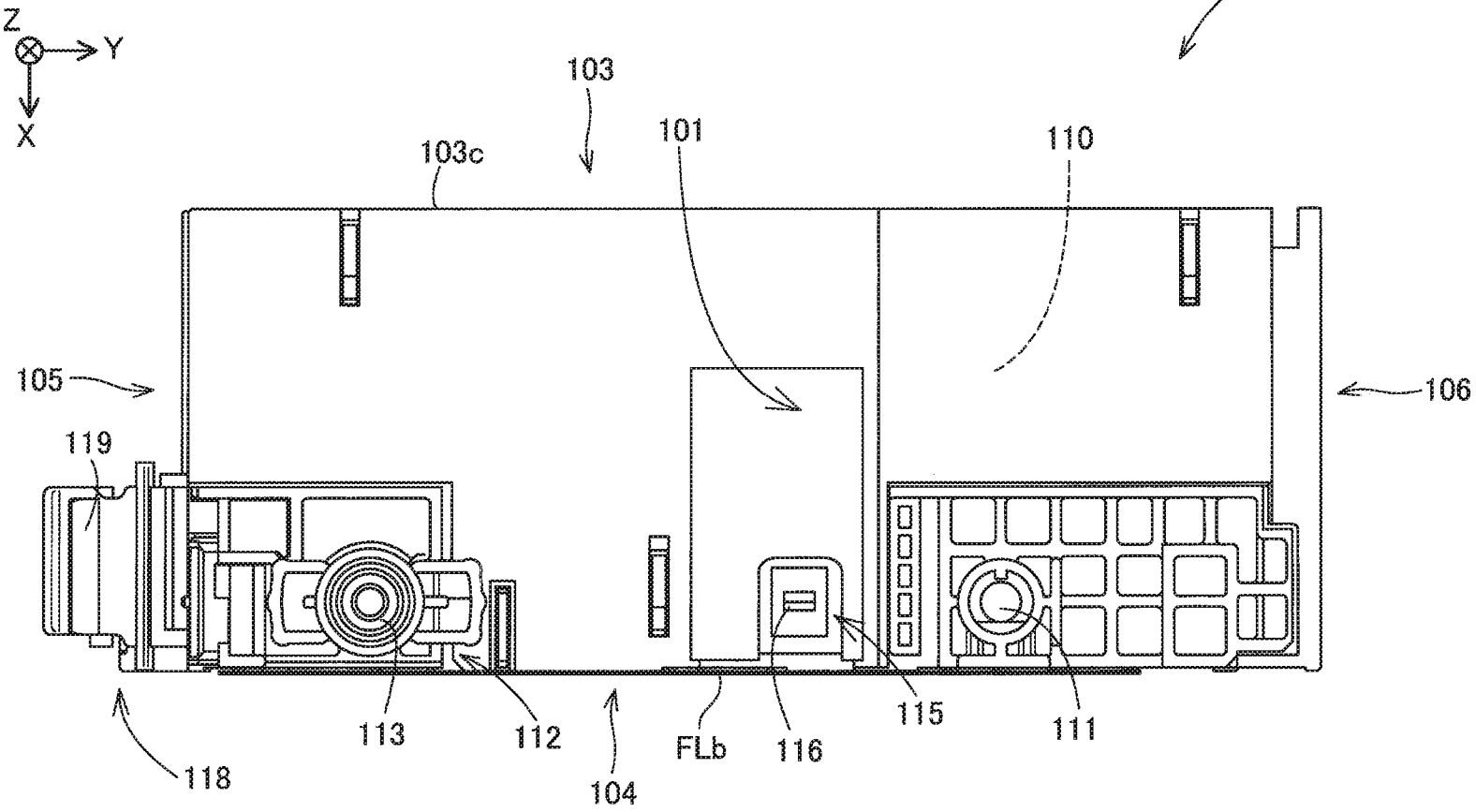
FIG. 21 is a schematic bottom view of a liquid container of a second embodiment.
Figure 22:
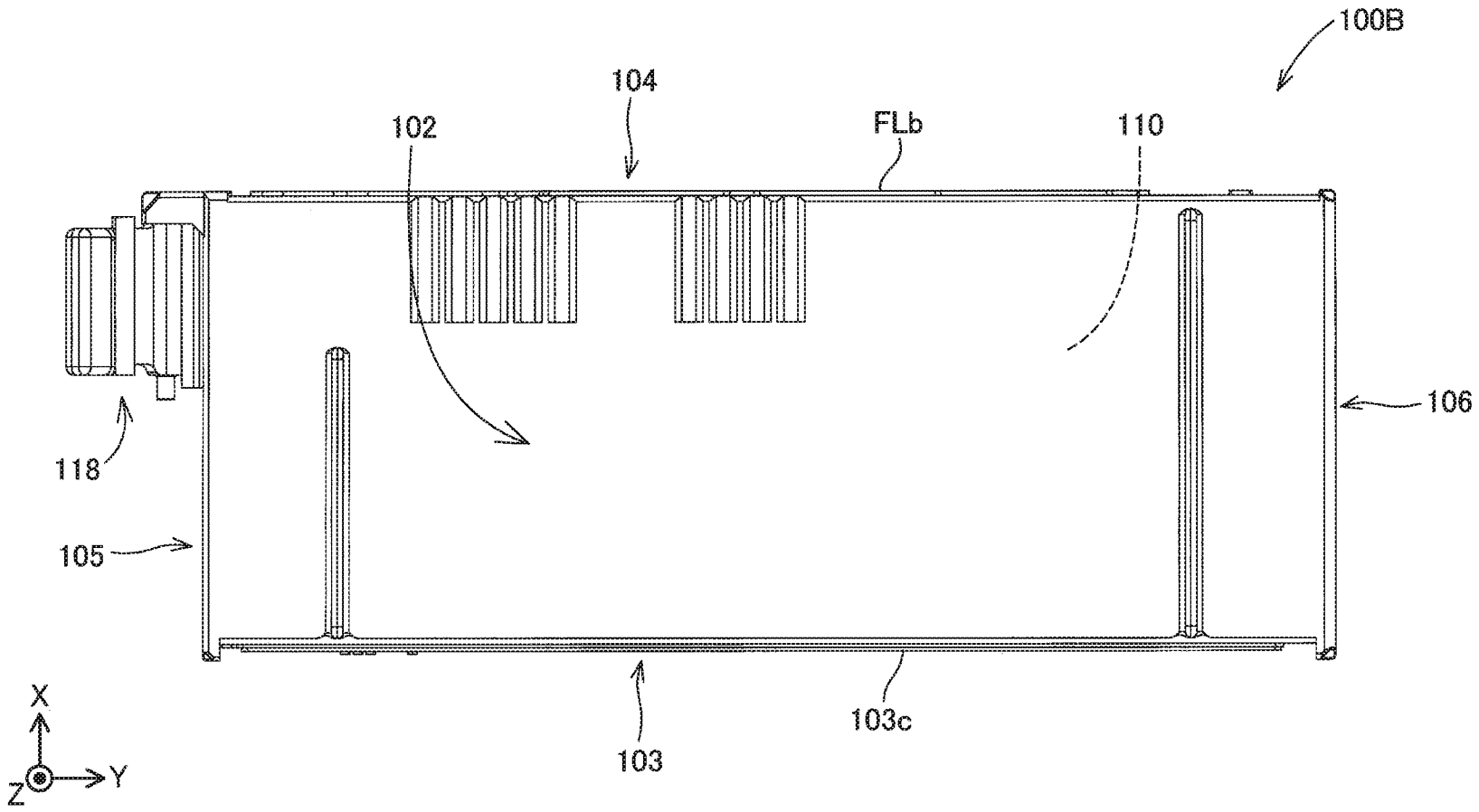
FIG. 22 is a schematic top view of the liquid container of the second embodiment.
Figure 23:
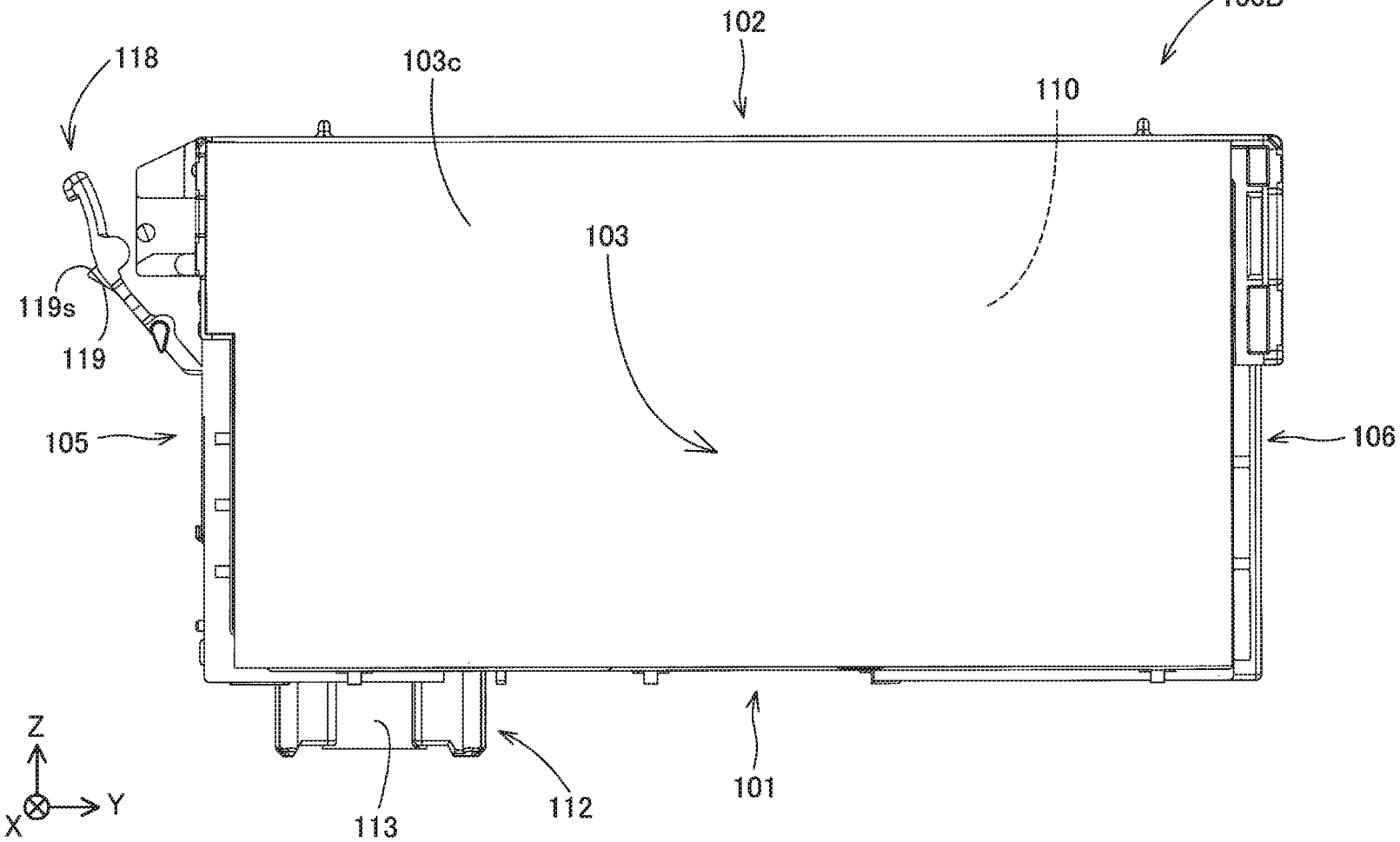
FIG. 23 is a schematic left side view of the liquid container of the second embodiment.
Figure 24:
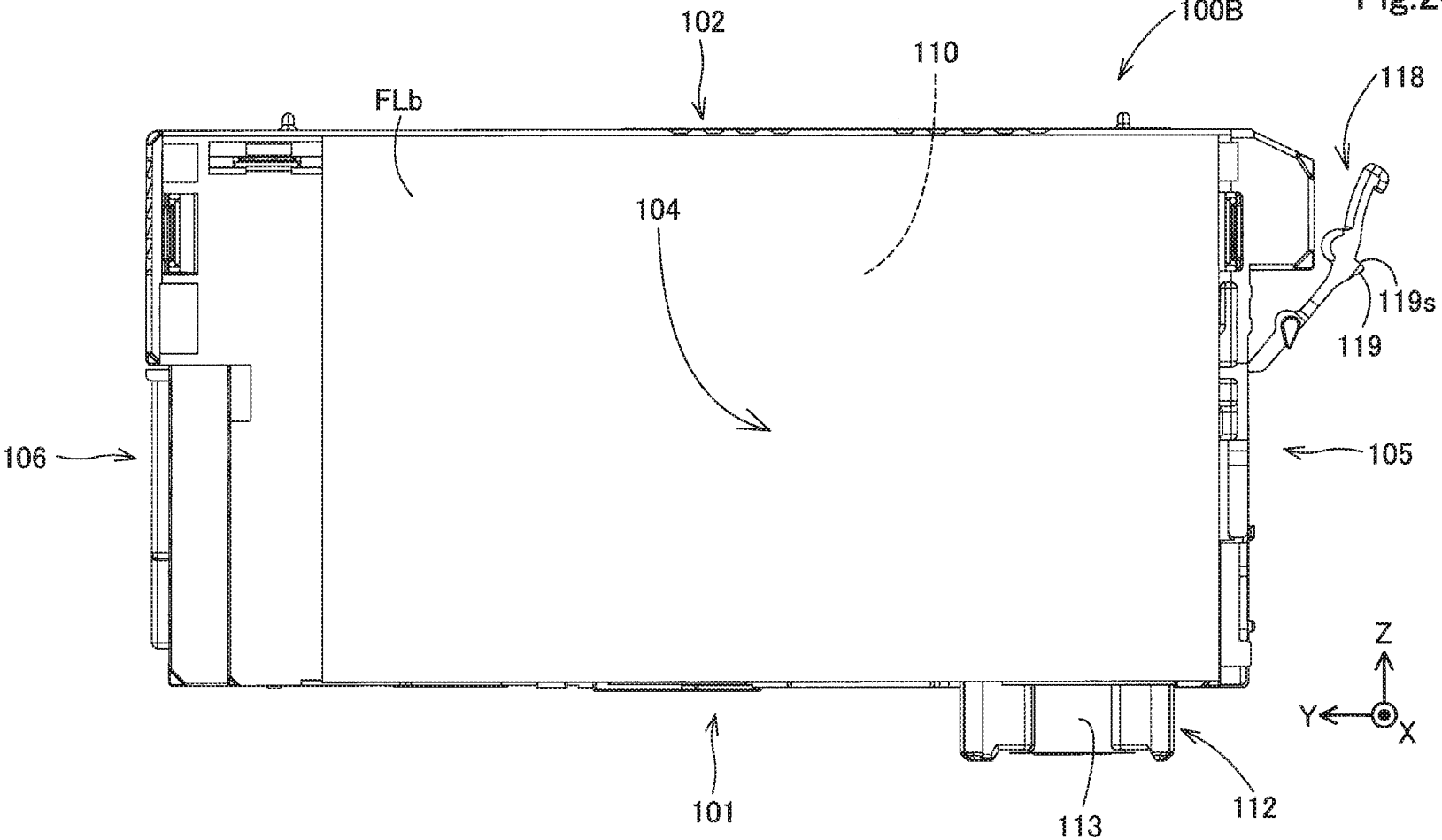
FIG. 24 is a schematic right side view of the liquid container of the second embodiment.
Figure 25:
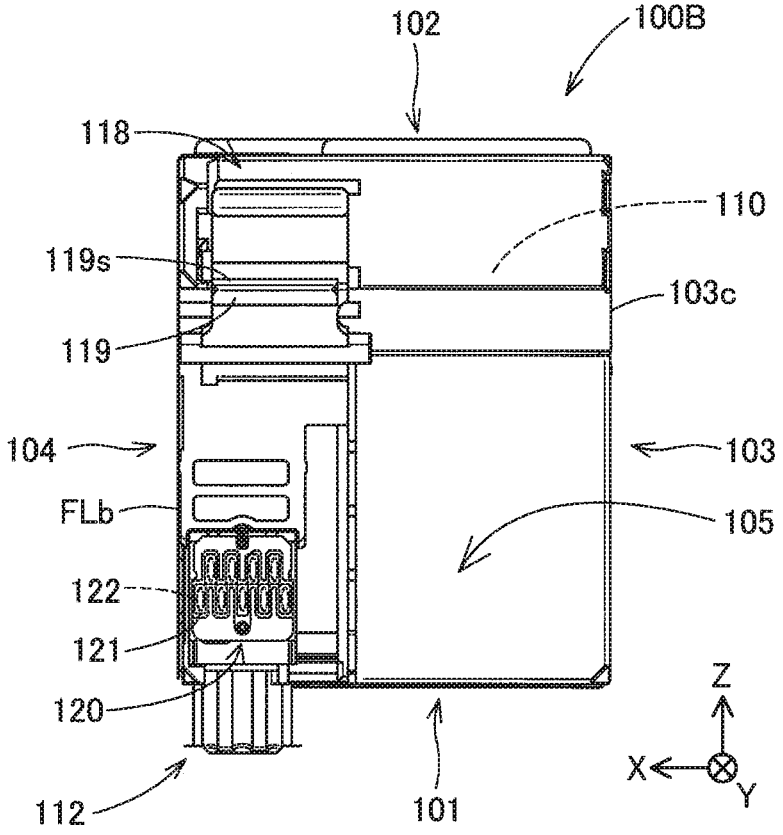
FIG. 25 is a schematic back view of the liquid container of the second embodiment.
Figure 26:
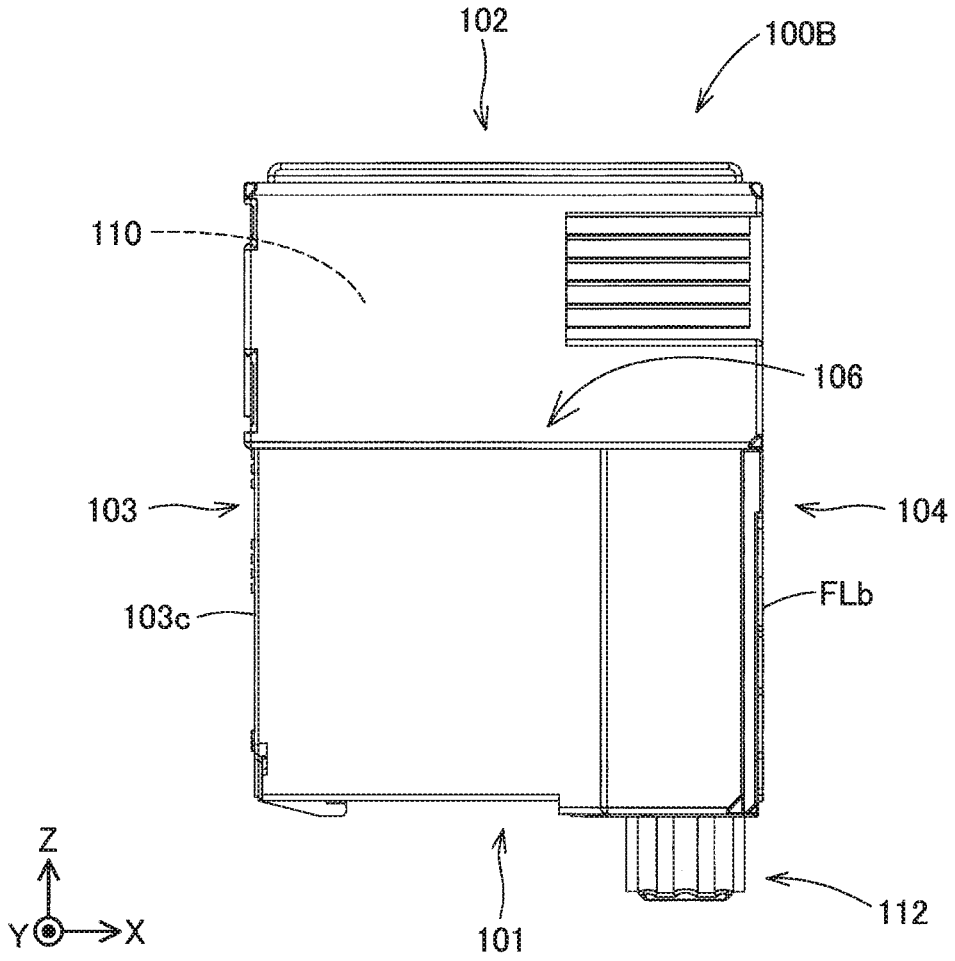
FIG. 26 is a schematic front view of the liquid container of the second embodiment.

2. Second Embodiment 2-1. External Configuration of Liquid Container:

The external configuration of a liquid container 100B in a second embodiment will be described with reference to FIGS. 21 to 26. In FIGS. 21 to 26, X, Y, and Z axes when the liquid container 100B of the second embodiment is in a fitting posture where the liquid container 100B is fitted to the carriage 12 of the liquid consumption device 10 described in the first embodiment are shown. FIG. 21 is a schematic bottom view when the liquid container 100B is seen in a plan view in the +Z direction. FIG. 22 is a schematic top view when the liquid container 100B is seen in a plan view in the −Z direction. FIG. 23 is a schematic left side view when the liquid container 100B is seen in a plan view in the +X direction. FIG. 24 is a schematic right side view when the liquid container 100B is seen in a plan view in the −X direction. FIG. 25 is a schematic back view when the liquid container 100B is seen in a plan view in the +Y direction. FIG. 26 is a schematic front view when the liquid container 100B is seen in a plan view in the −Y direction.

The external configuration of the liquid container 100B in the second embodiment is substantially the same as that of the liquid container 100A in the first embodiment except that the width thereof in the X axis direction is increased. In FIGS. 21 to 26, the same constituent portions as in the liquid container 100A of the first embodiment are identified with the same symbols. With respect to the description of the individual constituent portions in the liquid container 100B of the second embodiment which are the same as in the liquid container 100A of the first embodiment, the description in the first embodiment is substantially applied to the description in the second embodiment.

In the liquid container 100B of the second embodiment, the positions of an atmosphere open port 111 for a fourth wall portion 104, a liquid supply portion 112, a liquid detection portion 115, a lever 118, and a circuit board 120 are substantially the same as in the liquid container 100A of the first embodiment. In the liquid container 100B of the second embodiment, the position of a third wall portion 103 with respect to the fourth wall portion 104 is separated more in the X direction as compared with the liquid container 100A of the first embodiment, and thus the amount of liquid which is able to be stored in the liquid storage portion 110 is increased as compared with the liquid container 100A of the first embodiment. As described above, in the liquid container 100A of the first embodiment, and the liquid container 100B of the second embodiment, by a simple change in design, it is possible to change the amount of liquid which is able to be stored while keeping the compatibility of the fitting to the carriage 12.

Figure 27:
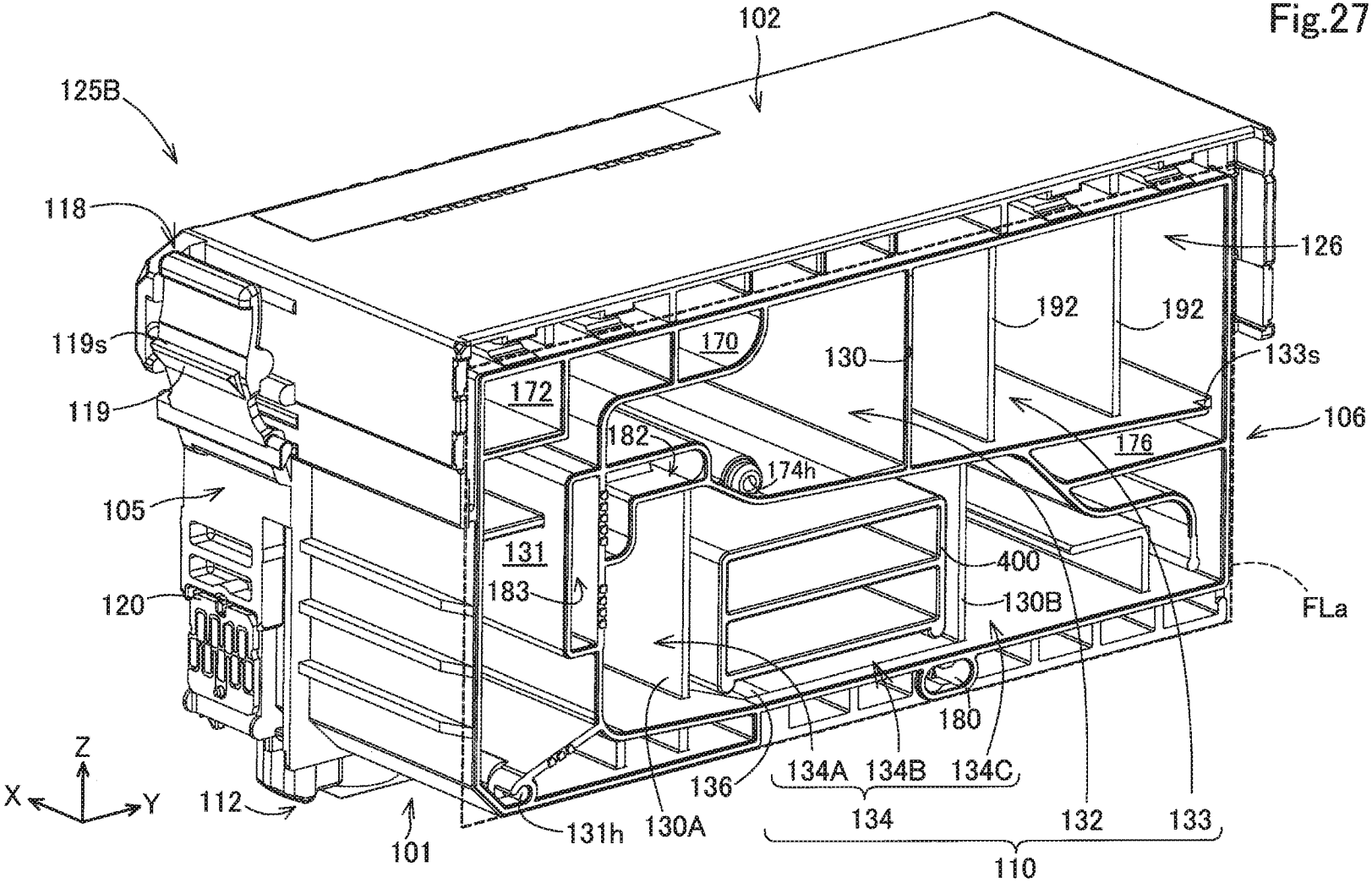
FIG. 27 is a schematic perspective view of a main body portion in the second embodiment.
Figure 28:
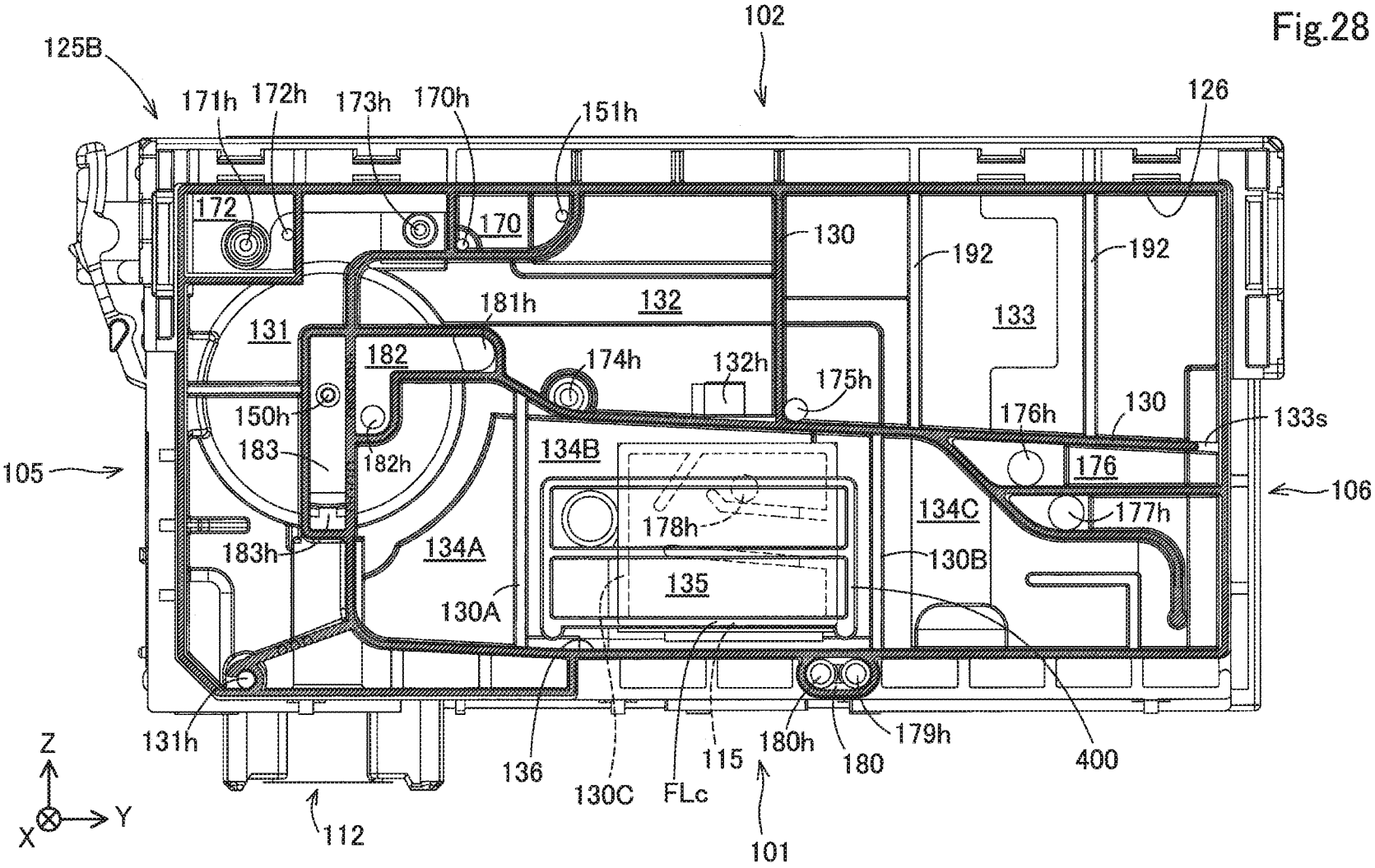
FIG. 28 is a schematic left side view of the main body portion in the second embodiment.

2-2. Internal Configuration of Liquid Container:

FIG. 27 is a schematic perspective view showing an internal structure on the side of the left side surface of the liquid container 100B. FIG. 28 is a schematic left side view when a main body portion 125B of the liquid container 100E is seen in a plan view in the +X direction. In the following description, the side of the left side surface of the liquid container 100B in the second embodiment is also referred to as a "front surface side" as in the first embodiment.

The internal configuration of the liquid container 100B on the front surface side mainly differs from the liquid container 100A of the first embodiment in three points below. Firstly, a third liquid chamber 134 is partitioned into three chambers of first to third storage chambers 134A to 134C. Secondly, within the second storage chamber 134B, a liquid detection chamber 135 is provided in which the liquid detection portion 115 is stored. Thirdly, in the liquid container 100B, instead of the undulation reduction portions 200 and the support portion 300 of the first embodiment, an undulation reduction member 400 which includes undulation reduction portions 410 and a support portion 450 of the second embodiment is arranged in the second storage chamber 134B. The configuration of the undulation reduction member 400 will be described after the description of the flow of the atmosphere and the liquid in the liquid container 100B.

The third liquid chamber 134 is divided, by a partition rib 130A described in the first embodiment and a partition rib 130B which is one of ribs 130 and which extends along the Z axis direction, into the three storage chambers 134A to 134C. The third storage chamber 134C is formed by partition on the side of the +Y direction with respect to the second storage chamber 134B through the partition rib 130B. Among the three storage chambers 134A to 134C, the second storage chamber 134B has the widest space. In the bottom surface of the second storage chamber 134B, a residue prevention groove 136 is provided.

The liquid detection chamber 135 is provided in a back position within the second storage chamber 134B in the X axis direction. The liquid detection chamber 135 is separated by a rib 130C, which extends from the wall surface of a second side wall portion 138*h* in the second storage chamber 134B along the X axis direction, and is formed by sealing the space of a concave portion opened in the −X direction through the welding of a film FLc indicated by broken lines. The liquid detection portion 115 is provided on the bottom surface of the liquid detection chamber 135. As will be described later, the liquid in the second storage chamber 134B flows into the liquid detection chamber 135 through the residue prevention groove 136, and flows from the liquid detection chamber 135 into the liquid supply portion 112.

Figure 29:
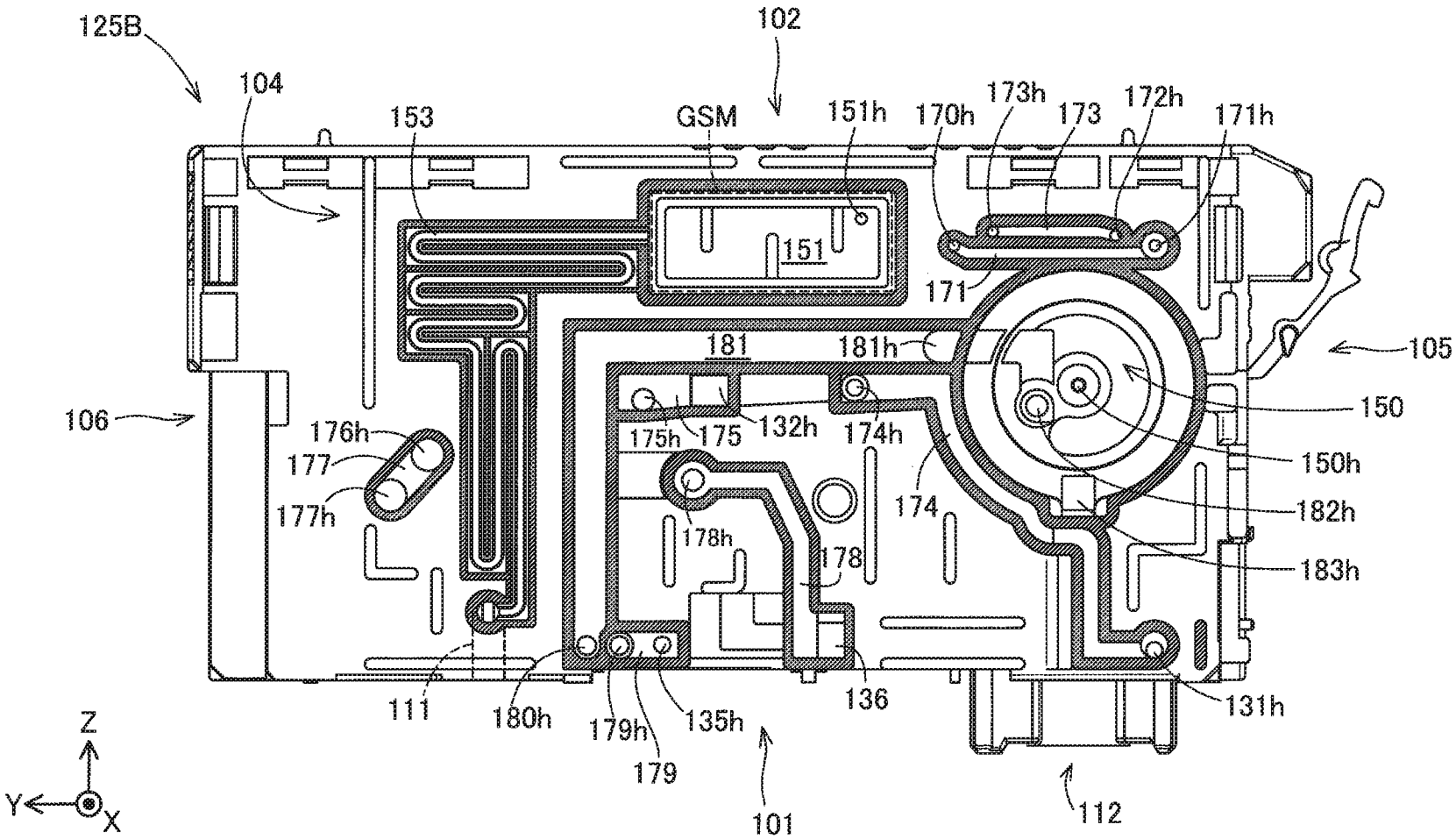
FIG. 29 is a schematic right side view of the main body portion in the second embodiment.

FIG. 29 is a schematic right side view when the main body portion 125B of the liquid container 100B is seen in a plan view in the −X direction. In the following description, the side of the right side surface of the liquid container 100B in the second embodiment is also referred to as a "back surface side" as in the first embodiment. The configuration of the main body portion 125B on the back surface side is substantially the same as that of the main body portion 125A on the back surface side in the first embodiment except that a seventh communication path 178 which connects the third liquid chamber 134 and the liquid detection chamber 135 together is added.

Figure 30:
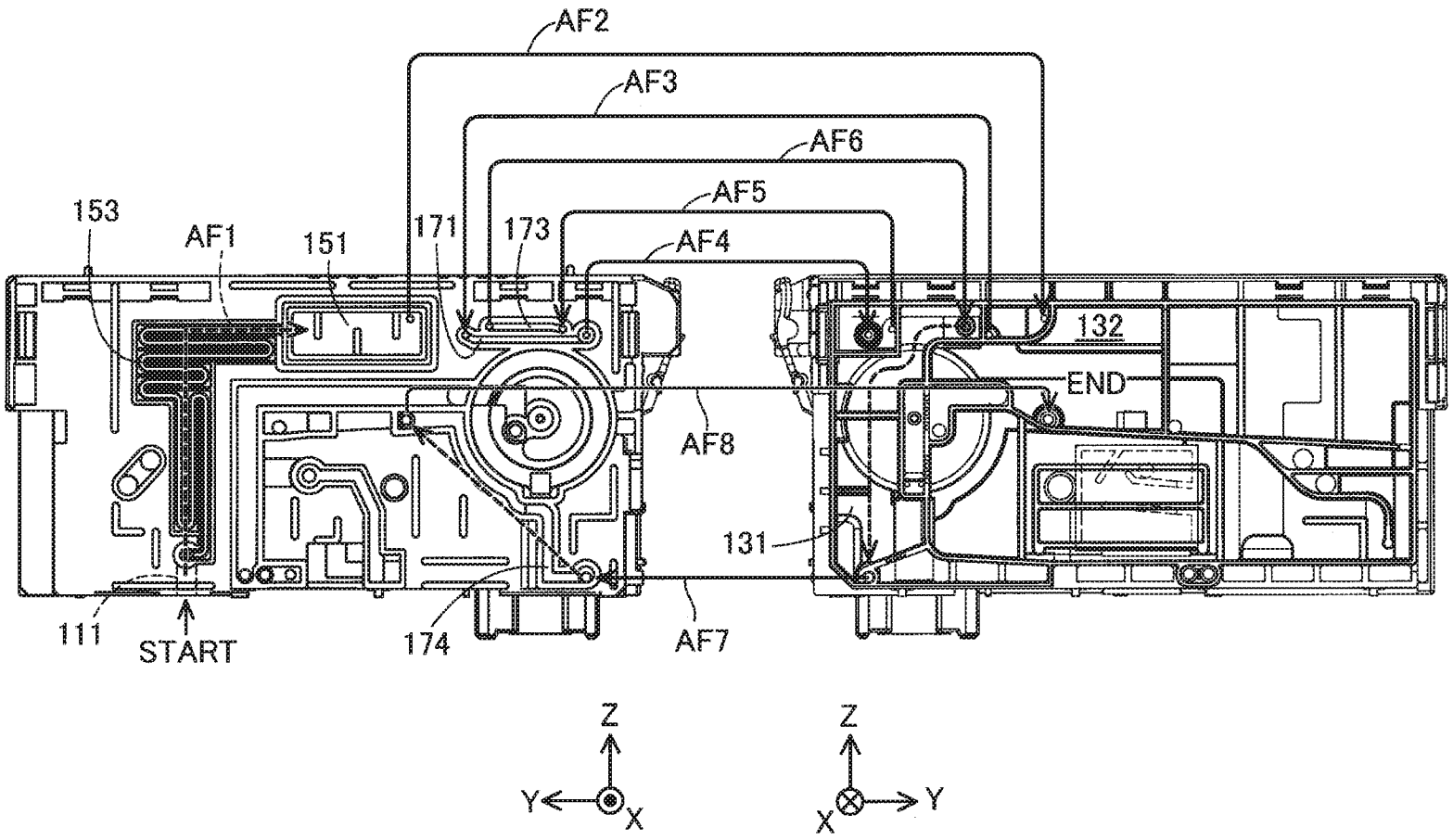
FIG. 30 is a schematic view showing the flow of the atmosphere within the liquid container of the second embodiment.

2-3. Path of Atmosphere within Liquid Container:

FIG. 30 is a schematic view showing the flow of the atmosphere within the liquid container 100B. The flow of the atmosphere within the liquid container 100B is substantially the same as the flow of the atmosphere within the liquid container 100A of the first embodiment. Hence, the description of the flow of the atmosphere in the liquid container 100A of the first embodiment is substantially applied to the second embodiment.

Figure 31:
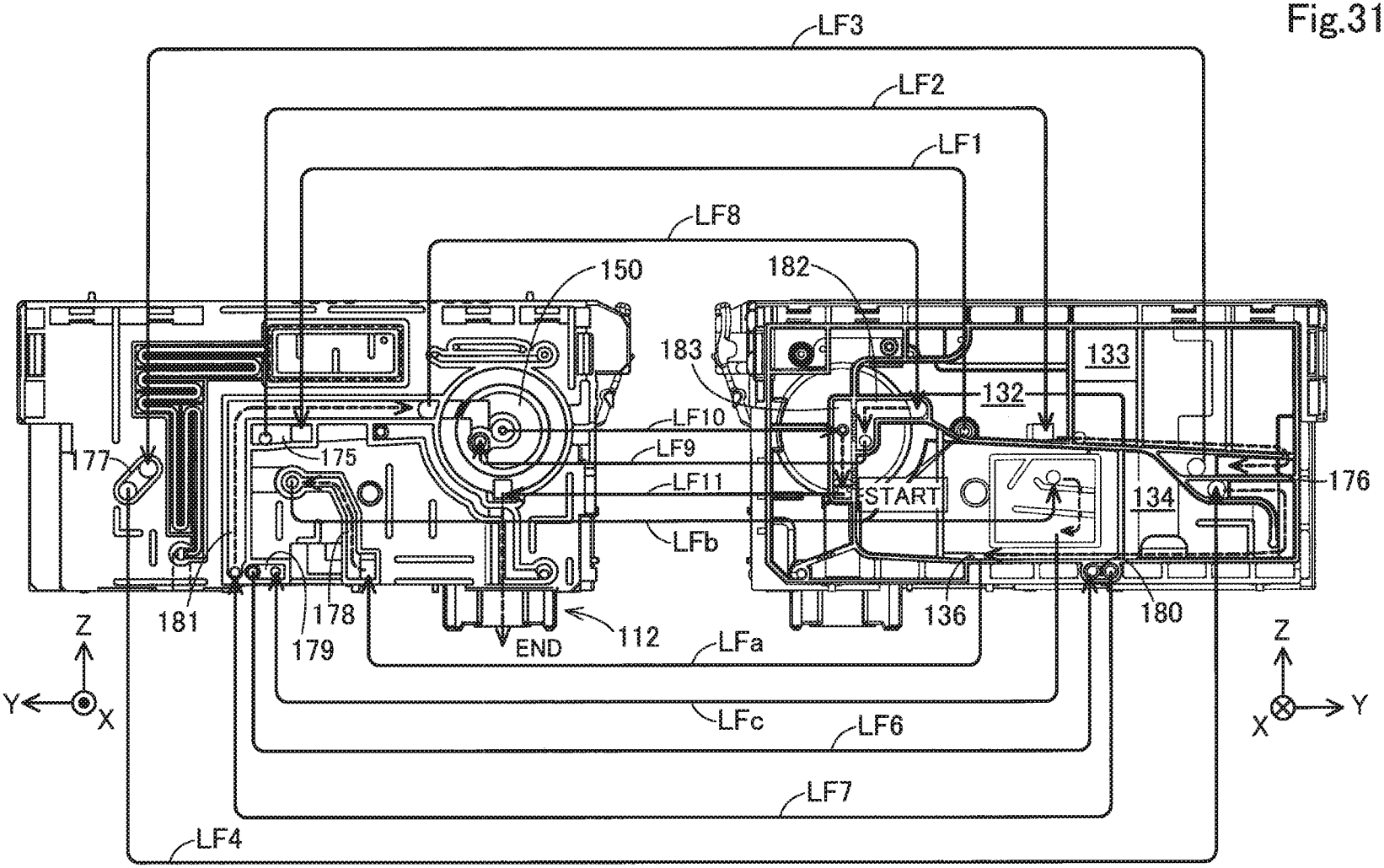
FIG. 31 is a schematic view showing the flow of the liquid within the liquid container of the second embodiment.

2-4. Path of Liquid within Liquid Container:

FIG. 31 is a schematic view showing the flow of the liquid within the liquid container 100B. In FIG. 31, the undulation reduction member 400 is omitted for convenience. The flow of the liquid within the liquid container 100B is substantially the same as the flow of the liquid within the liquid container 100A of the first embodiment except that a path which is passed through the liquid detection chamber 135 after the residue prevention groove 136 so as to reach an eighth communication path 179 is added. Hence, the description of the flow of the liquid from the first liquid chamber 132 to the residue prevention groove 136 in the liquid container 100A of the first embodiment, and the description of the flow of the liquid from the eighth communication path 179 to the liquid supply portion 112 are substantially applied to the second embodiment. In the following description, the path of the liquid which is added in the liquid container 100B will be described.

As indicated by an arrow LFa, the liquid within the third liquid chamber 134 is passed through the residue prevention groove 136 and enters an end portion of the seventh communication path 178 on the side of the −Z direction and the side of the −Y direction which is provided in the back surface of the liquid container 100B. The liquid entering the seventh communication path 178 flows upward along the seventh communication path 178, is passed through an opening 178*h* (see FIG. 29) provided at an end portion of the seventh communication path 178 on the side of the +Z direction and the side of the +Y direction and enters an upper portion of the liquid detection chamber 135 on the front surface side as indicated by an arrow LFb.

In the liquid detection chamber 135, a plurality of ribs for trapping air bubbles included in the liquid are provided. The liquid flows downward in the −Z direction within the liquid detection chamber 135 so as to make contact with the surface of the optical component 116, is then passed through an opening 135*h* (see FIG. 29) provided in a lower portion of the liquid detection chamber 135 on the back surface side as indicated by an arrow LFe, and enters an end portion of the eighth communication path 179 on the side of the −Y direction which is provided on the back surface side and which extends in the Y axis direction. The liquid entering the eighth communication path 179 is passed through, as in the description of the first embodiment, a ninth communication path 180, a tenth communication path 181, an eleventh communication path 182, a differential pressure valve chamber 150 and a twelfth communication path 183 in this order so as to reach the liquid supply portion 112.

Figure 32:
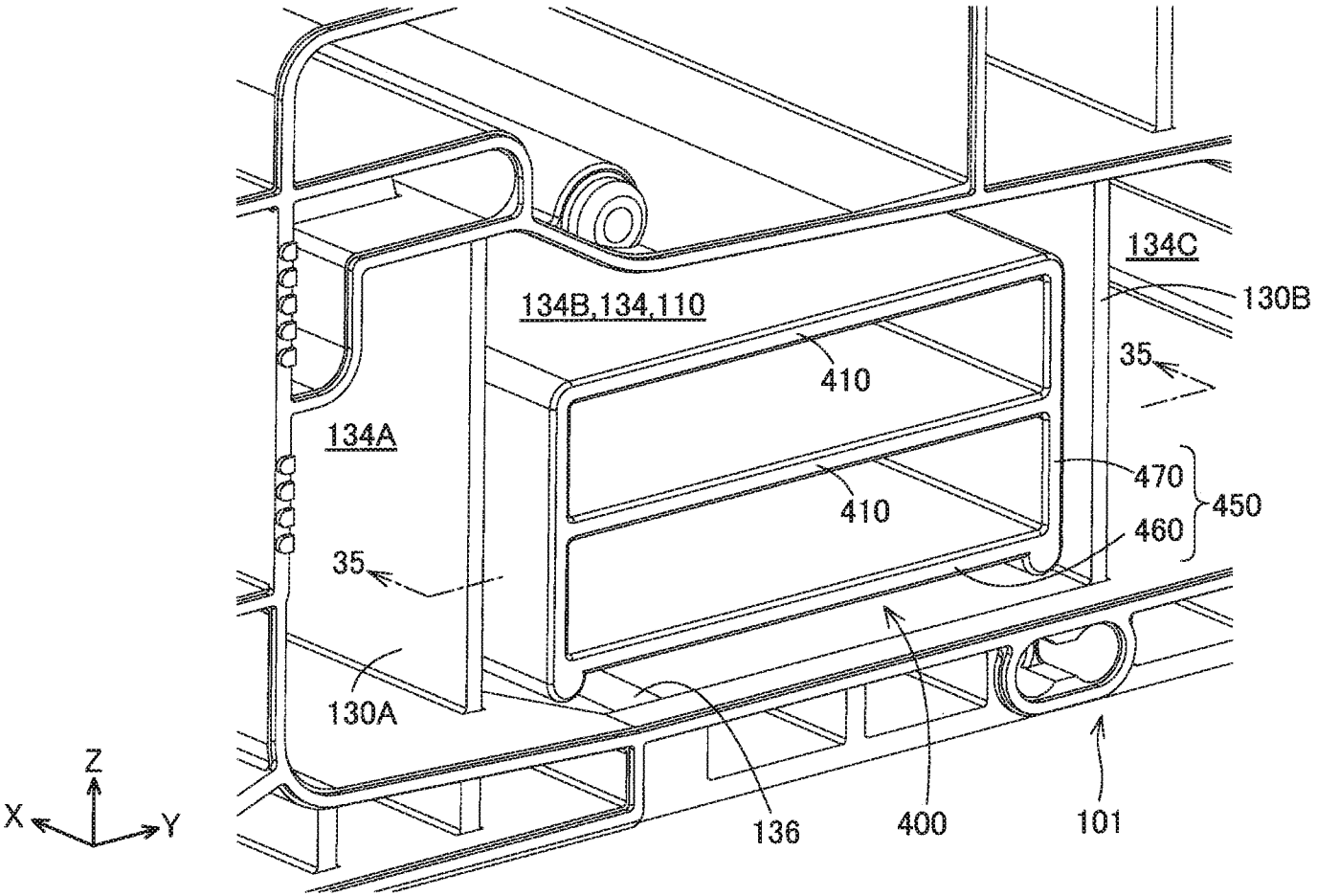
FIG. 32 is a schematic perspective view showing a liquid storage portion in which an undulation reduction member in the second embodiment is arranged.

2-5 Configuration of Undulation Reduction Member:

The configuration of the undulation reduction member 400 arranged in the liquid storage portion 110 will be described with reference to FIGS. 32 to 36. FIG. 32 is a schematic perspective view extracting and showing the second storage chamber 134B of the third liquid chamber 134 in which the undulation reduction member 400 is arranged. FIG. 32 shows a state where the undulation reduction member 400 is placed on the bottom surface of the second storage chamber 134B when the liquid container 100B is in the fitting posture.

Figure 33A:
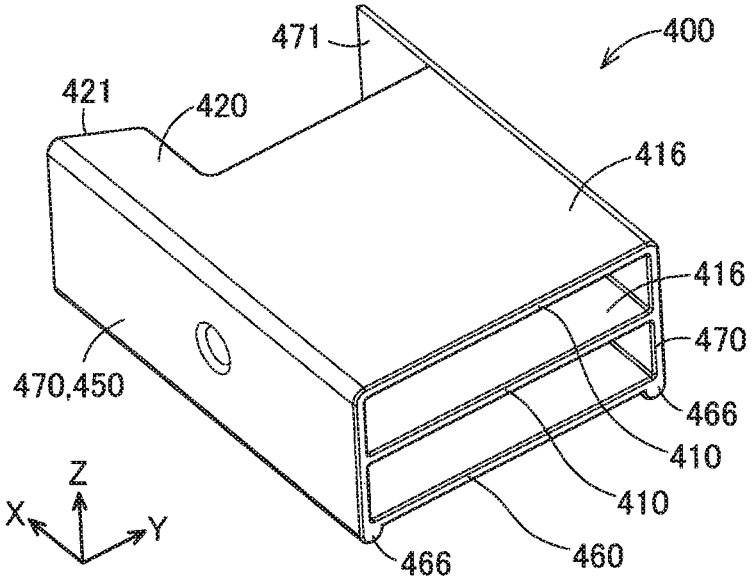
FIG. 33A is a first schematic perspective view showing the undulation reduction member in the second embodiment.
Figure 33B:
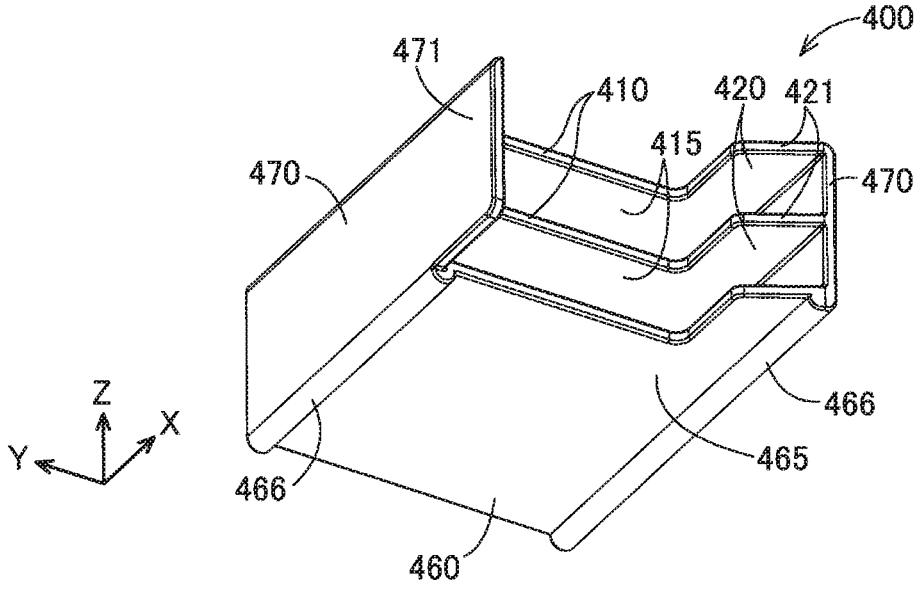
FIG. 33B is a second schematic perspective view showing the undulation reduction member in the second embodiment.
Figure 34A:
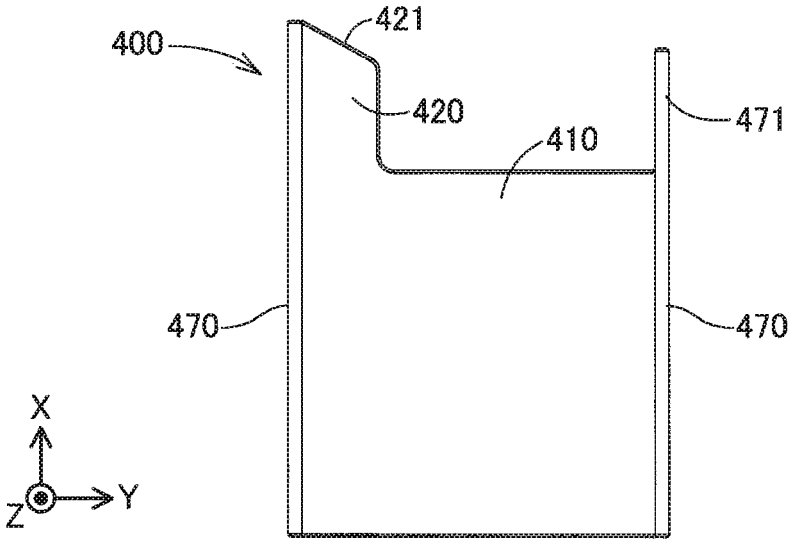
FIG. 34A is a schematic plan view of the undulation reduction member in the second embodiment.
Figure 34B:
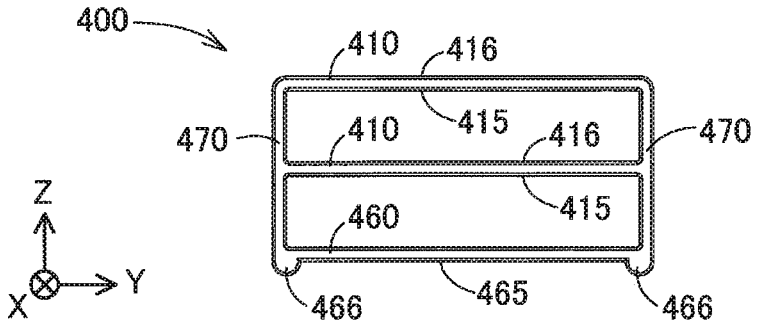
FIG. 34B is a schematic side view of the undulation reduction member in the second embodiment.
Figure 34C:
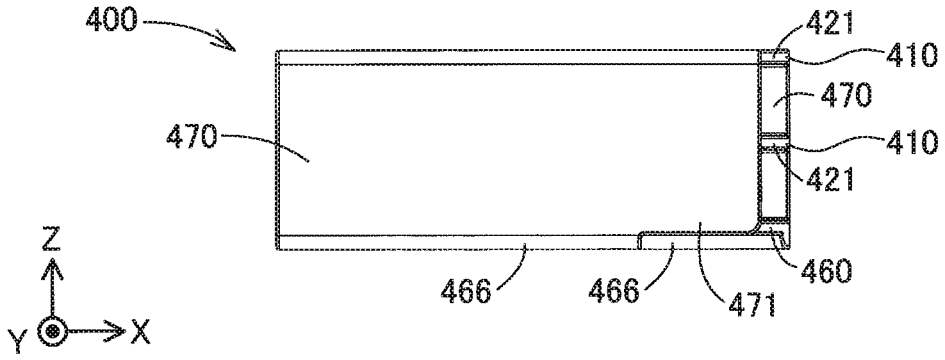
FIG. 34C is a schematic front view of the undulation reduction member in the second embodiment.

FIG. 33A is a schematic perspective view when the undulation reduction member 400 is seen from the side of the +Z direction. FIG. 33B is a schematic perspective view when the undulation reduction member 400 is seen from the side of the −Z direction. FIG. 34A is a schematic a plan view when the undulation reduction member 400 is seen in a plan view in the −Z direction. FIG. 34B is a schematic side view when the undulation reduction member 400 is seen in a plan view in the +X direction. FIG. 34C is a schematic front view when the undulation reduction member 400 is seen in a plan view in the −Y direction. In FIGS. 33A, 33B, and 34A to 34C, X, Y, and Z axes are shown when the undulation reduction member 400 is in a horizontal posture in which the undulation reduction member 400 is arranged horizontally in the liquid storage portion 110 when the liquid container 100B is in the fitting posture.

FIGS. 32 and 33A will be referenced. The undulation reduction member 400 has a configuration in which the undulation reduction portions 410 of the second embodiment and the support portion 450 of the second embodiment are formed integrally. The undulation reduction member 400 is produced by injection molding, for example, a resin material such as polypropylene. As will be described below, the undulation reduction member 400 has a simple configuration in which a plurality of plate-shaped parts that extend along the X axis direction are combined, and thus it is easy to produce the undulation reduction member 400. In other embodiments, the undulation reduction member 400 may be produced by producing the undulation reduction portion 410 and the support portion 450 as separate members and then coupling them together.

FIGS. 32, 33A and 33B will be referenced. The undulation reduction portions 410 are configured as plate-shaped parts which extend along the X axis direction and the Y axis direction. In the undulation reduction member 400, a plurality of undulation reduction portions 410 are arranged vertically. In the undulation reduction member 400, two undulation reduction portions 410 are arranged vertically.

FIGS. 33A and 33B will be referenced. The undulation reduction portion 410 includes a lower wall surface 415 which is directed in the −Z direction and an upper wall surface 416 which is directed in the +Z direction. In the second embodiment, the two wall surfaces 415 and 416 are configured as smooth surfaces which do not include projections and recesses. In this way, the liquid is made to easily flow on both the wall surfaces 415 and 416, and thus a failure is reduced in which the liquid remains adhered to the undulation reduction portions 410 and is thus left in the liquid storage portion 110.

FIGS. 33A, 33B, and 34A will be referenced. The undulation reduction portion 410 includes, at an end portion on the side of the −Y direction, an extension portion 420 which extends more in the +X direction as compared with the other parts. The extension portion 420 includes the wall surface 415. The extension portion 420 includes, at a tip end, an inclination surface 421 which is inclined toward the side of the −X direction as the extension portion 420 extends toward the side of the +Y direction when the extension portion 420 is seen along the Z axis direction. The inclination surface 421 is inclined with respect to a YZ plane. The function of the extension portion 420 will be described later. In other embodiments, the extension portion 420 may be omitted.

In the second embodiment, a plurality of undulation reduction portions 410 have substantially the same shape, and each of the undulation reduction portions 410 includes the extension portion 420. In other embodiments, a plurality of undulation reduction portions 410 may include different shapes.

FIGS. 32, 33A, and 33B will be referenced. The support portion 450 includes a bottom plate portion 460 and coupling portions 470. The bottom plate portion 460 is configured as a plate-shaped part which extends along the X axis direction and the Y axis direction. The bottom plate portion 460 is arranged below the lower wall surfaces 415 of the undulation reduction portions 410. The bottom plate portion 460 is provided in a lower end of the undulation reduction member 400 and is arranged so as to face the bottom surface of the second storage chamber 134B in the liquid storage portion 110. The bottom plate portion 460 is arranged along the bottom surface of the second storage chamber 134B.

As shown in FIG. 33B, the bottom plate portion 460 is shaped so as to be substantially overlaid on the undulation reduction portions 410 when the undulation reduction member 400 is seen along the Z axis direction. In other embodiments, the bottom plate portion 460 may have a shape different from the undulation reduction member 400. In the bottom plate portion 460, a configuration may be adopted in which a curved surface, projections, and recesses or a through hole is provided in the plate surface.

FIG. 33B will be referenced. The bottom plate portion 460 includes, on a lower surface 465 which is a wall surface directed in the −Z direction, leg portions 466 which protrude in the −Z direction. In the second embodiment, the leg portions 466 are configured as convex thread portions which extend in the X axis direction. The leg portions 466 are provided on both ends of the lower surface 465 in the Y axis direction. The function of the leg portions 466 will be described later. In other embodiments, the leg portions 466 may be configured to have a shape other than the convex thread portion, such as a hemispherical shape. The leg portions 466 may be omitted from the bottom plate portion 460.

FIGS. 33A, 33B, and 34C will be referenced. The coupling portions 470 extend in the Z axis direction, which is the direction of the height thereof, and couple together the undulation reduction portions 410 and the bottom plate portion 460. The coupling portions 470 couple together the undulation reduction portions 410 and the bottom plate portion 460 such that the undulation reduction portions 410 are in a posture along the bottom plate portion 460 above the bottom plate portion 460. More specifically, the coupling portions 470 couple together the undulation reduction portions 410 and the bottom plate portion 460 such that they are parallel to each other. In the second embodiment, the coupling portions 470 are provided on both ends of the undulation reduction portions 410 and the bottom plate portion 460 in the Y axis direction. The coupling portions 470 are configured as plate-shaped parts which extend along the Z axis direction and the X axis direction.

FIG. 34B will be referenced. The coupling portions 470 support the undulation reduction portions 410 such that the undulation reduction portions 410 are vertically arranged at predetermined intervals. The coupling portions 470 support the undulation reduction portions 410 and the bottom plate portion 460 such that the interval between the upper undulation reduction portion 410 and the lower undulation reduction portion 410 is equal to the interval between the lower undulation reduction portion 410 and the bottom plate portion 460.

Here, the number of undulation reduction portions 410 included in the undulation reduction member 400 is not limited to two, and the undulation reduction member 400 may include three or more undulation reduction portions 410. In this case, a plurality of undulation reduction members 400 are preferably vertically arranged at regular intervals. The reason for this will be described later.

The bottom plate portion 460 includes the lower surface 465, which is similar to the lower wall surface 415 of the undulation reduction portions 410 and which is a wall surface directed downward, and may function, as with the undulation reduction portions 410, to reduce the undulation of the liquid which will be described later. Hence, the bottom plate portion 460 may be interpreted as the undulation reduction portion, and the undulation reduction member 400 of the second embodiment may be interpreted to have a configuration in which a plurality of undulation reduction portions are vertically arranged at regular intervals. When the bottom plate portion 460 is interpreted as the undulation reduction portion, the leg portions 466 of the bottom plate portion 460 may be interpreted to function as support portions for restricting the range of the movement of the bottom plate portion 460 in the direction of gravity.

FIGS. 33A, 33B, and 34A will be referenced. The coupling portions 470 on the side of the +Y direction includes a protrusion portion 471 which extends so as to protrude from end portions of the undulation reduction portions 410 in the +X direction parallel to the extension portions 420 of the undulation reduction portions 410 along the X axis direction. The function of the protrusion portion 471 will be described later.

Figure 35:
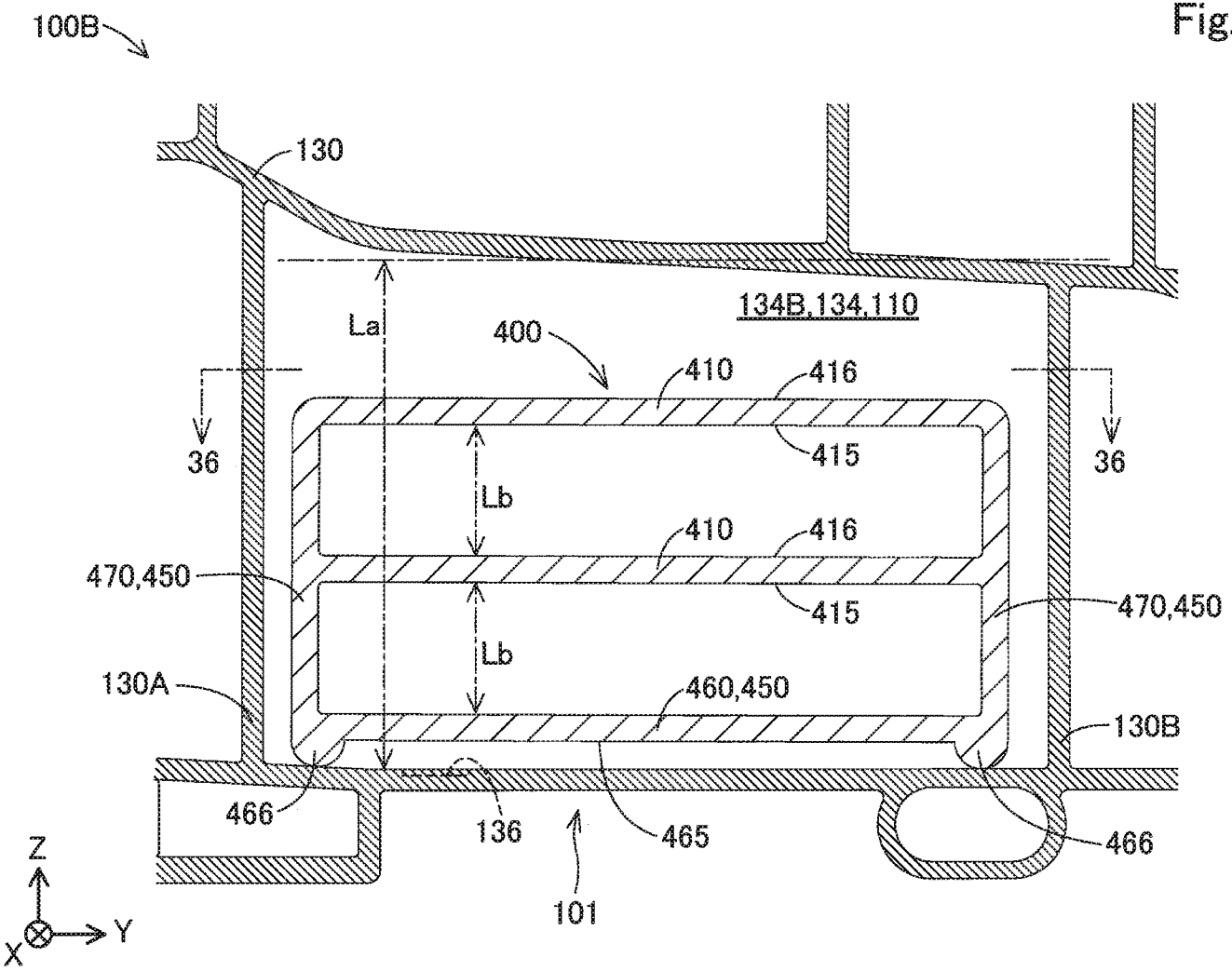
FIG. 35 is a first schematic cross-sectional view of the liquid storage portion in the second embodiment.

The function of the undulation reduction member 400 to reduce the undulation of the liquid will be described with reference to FIG. 35. FIG. 35 is a schematic cross-sectional view of the liquid storage portion 110 taken along line 35-35 shown in FIG. 32.

The undulation reduction member 400 is arranged such that the bottom plate portion 460 faces the bottom surface of the second storage chamber 134B in the liquid storage portion 110. The undulation reduction portions 410 are held above the bottom plate portion 460 by the coupling portions 470 such that the lower wall surfaces 415 thereof are arranged along the direction of reciprocation of the carriage 12 and are directed downward.

Here, the bottom plate portion 460 is not fixed to the liquid storage portion 110 and is arranged in a state where the bottom plate portion 460 is allowed to swing together with the liquid. Hence, the undulation reduction portions 410 which are coupled to the bottom plate portion 460 with the coupling portions 470 are interpreted to be supported by the support portion 450 in a state where the undulation reduction portions 410 are allowed to swing. In a state where the liquid is stored in the second storage chamber 134B, the liquid is present on the bottom plate portion 460. Hence, in the bottom plate portion 460, the movement of the bottom plate portion 460 along the direction of gravity is reduced by resistance received from the liquid present on the bottom plate portion 460 and the weight of the liquid, and the movement of the undulation reduction portions 410 along the direction of gravity is restricted.

The lower wall surfaces 415 of the undulation reduction portions 410 which are directed downward function to prevent the vertical movement of the liquid. In addition, as described above, the undulation reduction portions 410 are supported by the support portion 450 such that the movement of the lower wall surfaces 415 along the direction of gravity is restricted. Hence, as compared with a case where the undulation reduction portions 410 swing together with the liquid in a state where the undulation reduction portions 410 are not supported, the significant swinging of the lower wall surfaces 415 of the undulation reduction portions 410 together with the liquid is reduced, with the result that it is possible to effectively reduce the swinging of the liquid. Hence, the production of air bubbles in the liquid caused by the collision of the liquid and the inner wall surfaces of the liquid storage portion 110 is reduced, and thus a problem is reduced in which the liquid mixed with the air bubbles is supplied to the head 11 so as to cause a failure in the jetting of the liquid.

As described above, the undulation reduction portions 410 are allowed to swing together with the liquid. Hence, even when the liquid is adhered to the surfaces of the undulation reduction portions 410, the falling off of the liquid from the undulation reduction portions 410 is facilitated by the swinging thereof. Thus, a failure is reduced in which the liquid remains adhered to the undulation reduction portions 410 and is thus left in the liquid storage portion 110. Since the support portion 450 included in the undulation reduction member 400 is also allowed to swing together with the liquid, it is possible to obtain the same effect.

In addition, since the undulation reduction portions 410 swing so as to agitate the liquid within the liquid storage portion 110, the occurrence of unevenness of the density of the liquid caused by the precipitation of a precipitation component is reduced. Hence, the nonuniformity of the density of the liquid supplied to the head 11 is reduced, and thus the degradation of quality of the printed image caused by the nonuniformity of the density of the jetted liquid is reduced.

In the liquid container 100B, the downward movement of the wall surfaces 415 of the undulation reduction portions 410 beyond the heights when the bottom plate portion 460 is in contact with the bottom surface of the liquid storage portion 110 is restricted. In other words, the downward movement of the wall surfaces 415 of the undulation reduction portions 410 beyond predetermined height positions is restricted. In this configuration, when the liquid is consumed in the liquid consumption device 10 such that the position of the surface of the liquid in the liquid storage portion 110 is lowered beyond the lower limit positions described above to which the wall surfaces 415 are able to be moved, the undulation of the liquid is able to be held down by the wall surfaces 415 from above the surface of the liquid. Hence, even when the amount of liquid in the liquid storage portion 110 is reduced, the undulation of the liquid is effectively reduced.

In the liquid container 1008, it is possible to effectively reduce the undulation of the liquid with the undulation reduction portions 410 which are simply configured as plate-shaped members and the undulation reduction member 400 which has a simple configuration where such plate-shaped parts are combined. In the undulation reduction member 400, at least the undulation reduction portions 410 and the coupling portions 470 preferably have such strength as to prevent deformation caused by the swinging of the liquid when the undulation reduction member 400 is arranged in the liquid. In this way, the posture of the undulation reduction portions 410 is kept, and thus it is possible to more effectively reduce the undulation of the liquid.

The specific gravity of the undulation reduction member 400 is preferably lower than that of the liquid stored in the liquid storage portion 110. The specific gravity here may be with reference to water. In this way, the undulation reduction member 400 is able to be floated in the liquid storage portion 110 by buoyancy which the undulation reduction member 400 receives from the liquid. In this way, at least part of any one of the upper and lower undulation reduction portions 410 is able to be located higher than the position of the surface of the liquid. Hence, it is possible to effectively reduce the movement of the undulation of the surface of the liquid with the lower wall surfaces 415 of the undulation reduction portions 410.

The thicknesses of the undulation reduction portions 410, the bottom plate portion 460, and the coupling portions 470 are preferably minimized. In this way, it is possible to reduce a decrease in the amount of liquid stored in the liquid storage portion 110 caused by the arrangement of the undulation reduction member 400 in the liquid storage portion 110.

In the liquid container 100B, the undulation reduction portions 410 are arranged so as to be aligned vertically. Hence, even when the position of the surface of the liquid in the liquid storage portion 110 is lowered as the liquid is consumed in the liquid consumption device 10, it is possible to effectively reduce the swinging of the liquid with the undulation reduction portions 410 whose lower wall surfaces 415 are located at heights close to the position of the surface of the liquid. Thus, the change of the effect of reducing the undulation of the liquid with the undulation reduction portions 410 caused by a change in the amount of liquid stored in the liquid storage portion 110 is reduced.

As described previously, in the undulation reduction member 400, the interval between the upper and lower undulation reduction portions 410 is substantially equal to the interval between the lower undulation reduction portion 410 and the bottom plate portion 460. As described above, the undulation reduction portions 410 are arranged at regular intervals, and thus it is possible to reduce a variation in the magnitude of the effect of reducing the undulation of the liquid with the undulation reduction portions 410 caused by the position of the surface of the liquid in the liquid storage portion 110.

Here, it is assumed that the average value of a distance between the upper surface and the bottom surface of the liquid storage portion 110 in which the undulation reduction portions 410 are arranged is La, and that a distance between the upper and lower undulation reduction portions 410 and a distance between the lower undulation reduction portion 410 and the bottom plate portion 460 are Lb. Here, the distance Lb is preferably less than or equal to one third of the distance La. In this way, it is possible to more effectively reduce the change of the effect of reducing the undulation of the liquid with the undulation reduction portions 410 caused by a change in the amount of liquid stored in the liquid storage portion 110.

In the liquid container 100B, the undulation reduction portions 410 are arranged in the third liquid chamber 134 in which the amount of liquid stored is the largest among the multiple liquid chambers 132 to 134 configuring the liquid storage portion 110. Hence, in the liquid container 100B, by reducing the undulation of the liquid with the undulation reduction portions 410, a large effect is obtained. In the liquid container 100B, the undulation reduction portions 410 are arranged in the third liquid chamber 134 which is closest to the liquid supply portion 112 among the multiple liquid chambers 132 to 134 configuring the liquid storage portion 110. Hence, the supply of the liquid containing air bubbles produced by the swinging of the liquid to the liquid supply portion 112 is reduced.

In the liquid storage portion 110, the wall surfaces 415 of the undulation reduction portions 410 are preferably extended in a direction along the horizontal direction so as to cover a wider range so that the wall surfaces 415 are able to reduce the undulation of the liquid in the wider range. The area of the wall surfaces 415 of the undulation reduction portions 410 is preferably more than or equal to 50% of the horizontal cross-sectional area of the liquid storage portion 110 in positions where the wall surfaces 415 are arranged and is more preferably more than or equal to 80% thereof.

As described previously, on the lower surface 465 of the bottom plate portion 460, the leg portions 466 are formed. The bottom plate portion 460 includes the leg portions 466, and thus when the bottom plate portion 460 is located in the lowest position in the second storage chamber 134B, gaps are formed between the bottom plate portion 460 and the bottom surface of the second storage chamber 134B. Hence, a failure is reduced in which the bottom plate portion 460 is stuck to the bottom surface of the second storage chamber 134B so as not to swing together with the liquid. Since spaces through which the liquid is able to be circulated are secured between the bottom plate portion 460 and the bottom surface of the second storage chamber 134B, the inhibition of the flow of the liquid in the liquid storage portion 110 is reduced. In addition, the blocking of the residue prevention groove 136 provided below the undulation reduction member 400 by the lower surface 465 of the bottom plate portion 460 is reduced.

In the liquid container 100B, the undulation reduction member 400 is inserted in the +X direction from an opening of the main body portion 125B on the side of the −X direction so as to be arranged, and thus the undulation reduction portions 410 are installed in a state where the undulation reduction portions 410 are supported by the support portion 450. Hence, it is possible to simply provide, in the liquid storage portion 110, a structure for reducing the undulation of the liquid which is configured with the undulation reduction portions 410 and the support portion 450 thereof. Thus, it is possible to simplify steps of manufacturing the liquid container 100B and to reduce the manufacturing cost.

Figure 36:
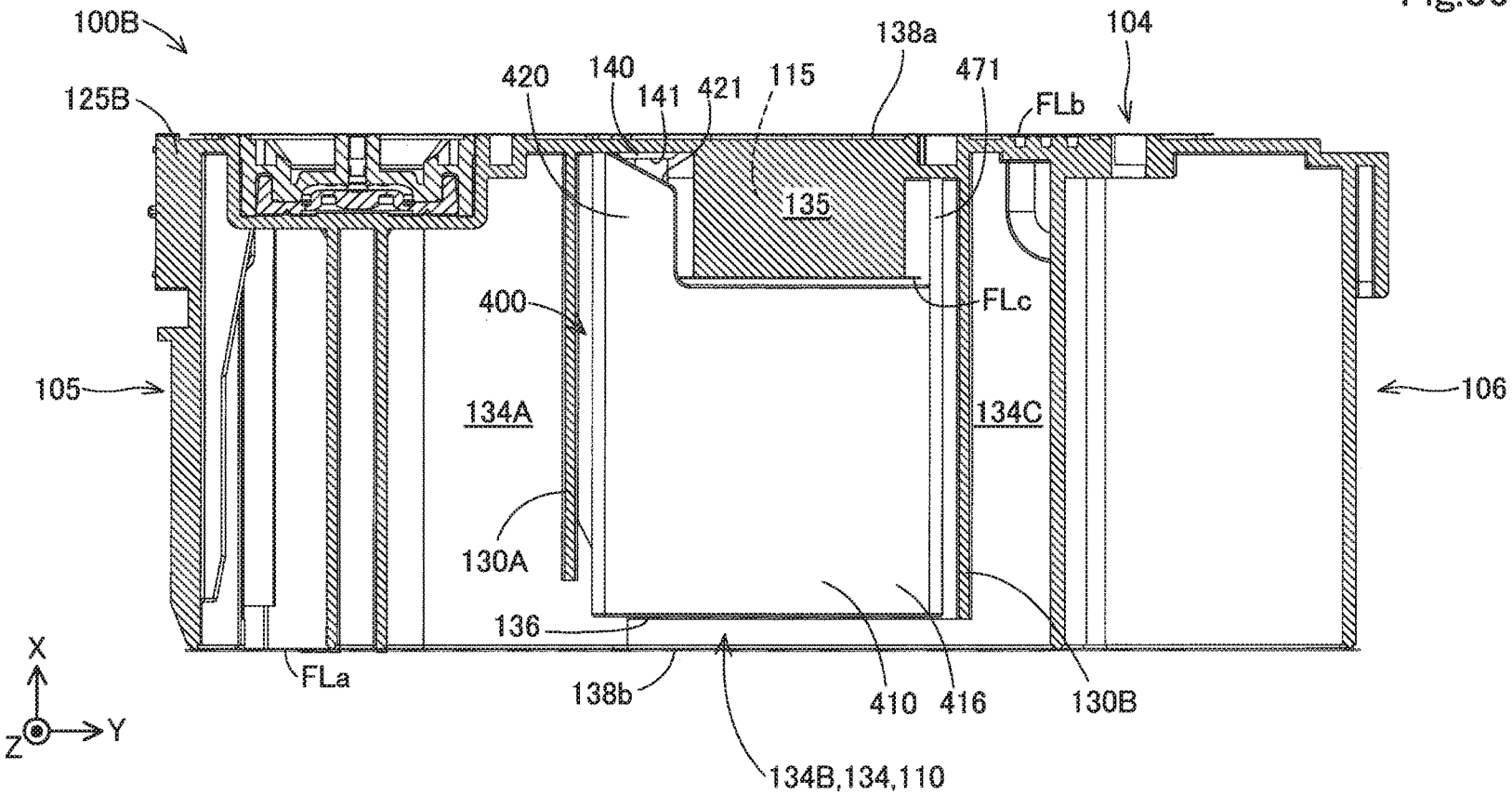
FIG. 36 is a second schematic cross-sectional view of the liquid storage portion in the second embodiment.

FIG. 36 is a schematic cross-sectional view of the liquid storage portion 110 taken along line 36-36 shown in FIG. 35. The liquid container 100B includes a first side wall portion 138*a* and a second side wall portion 138*b* which are opposite each other through the undulation reduction portions 410 in a direction along the wall surfaces 415 of the undulation reduction portions 410. In the second storage chamber 134B in which the undulation reduction member 400 is arranged, the liquid detection chamber 135 is provided in an end portion on the side of the first side wall portion 138*a*. The liquid detection chamber 135 is provided so as to protrude from the first side wall portion 138*a* toward the second side wall portion 138*b*.

On the first side wall portion 138*a*, a convex structure 140 is provided which protrudes toward the second side wall portion 138*b* in a position adjacent to the liquid detection chamber 135 when seen in the −Z direction. The convex structure 140 is formed as, for example, the relief portion of a gate through which a resin material is made to flow in when the main body portion 125B is injection molded. The convex structure 140 includes an end face 141 along a YZ plane.

When the undulation reduction portions 410 are seen in the −Z direction extending from the undulation reduction portions 410 toward the bottom surface of the liquid storage portion 110, the undulation reduction portions 410 have a shape which does not overlap the liquid detection chamber 135 where the liquid detection portion 115 is stored. When the extension portions 420 of the undulation reduction portions 410 are seen in the −Z direction, on the side of the convex structure 140 with respect to the liquid detection chamber 135, the extension portions 420 are arranged so as to extend toward the convex structure 140. When the extension portions 420 of the undulation reduction portions 410 are seen in the −Z direction, the extension portions 420 are located on the side of the −Y direction with respect to the liquid detection chamber 135. Parts which are located on the side of the +Y direction with respect to the extension portions 420 of the undulation reduction portions 410 are located on the side of the −X direction with respect to the extension portions 420 and face the liquid detection chamber 135 in the X axis direction. As described above, when the undulation reduction portions 410 are seen in the −Z direction, the outer peripheral edge thereof includes part which extends along the outer periphery of the liquid detection chamber 135. In this way, while the liquid detection chamber 135 which is the arrangement region of the liquid detection portion 115 is being avoided, the area of the wall surfaces 415 is able to be increased by only the extension portions 420. Hence, it is possible to reduce the undulation of the liquid in a wider range while securing the region for the liquid detection chamber 135. The extension portions 420 may be interpreted to be parts which extend in a position adjacent to the liquid detection chamber 135 along the X axis direction so as to avoid the liquid detection chamber 135 which is one of the convex structures in the liquid storage portion 110.

When the inclination surface 421 of the extension portion 420 of the undulation reduction portion 410 is seen in the −Z direction, the inclination surface 421 is inclined with respect to the end face 141 of the convex structure 140. In this way, it is possible to increase the area of the wall surfaces 415 of the undulation reduction portions 410 while reducing a range in which the undulation reduction portions 410 make contact with the convex structure 140. Hence, it is possible to reduce the undulation of the liquid in a wider range while reducing the damage of the undulation reduction portions 410 caused by contact with the convex structure 140. Even when the extension portions 420 make contact with the convex structure 140, gaps are formed between the end face 141 of the convex structure 140 and the inclination surfaces 421. Hence, with the undulation reduction portions 410, it is possible to reduce the prevention of the flow of the liquid in the liquid storage portion 110.

In the undulation reduction member 400, in a state where the protrusion portion 471 of the coupling portion 470 and the extension portions 420 of the undulation reduction portions 410 are in contact with the first side wall portion 138*a*, the undulation reduction portions 410 are configured so as not to reach the position of the liquid detection chamber 135. Hence, a failure is reduced in which, when the undulation reduction member 400 swings in the X axis direction, the undulation reduction portions 410 make contact with the film FLc sealing the liquid detection chamber 135 so as to damage the film FLc.

2-6. Summary of Second Embodiment:

In the liquid container 100B of the second embodiment, with the undulation reduction portions 410 in which the movement in the direction of gravity is restricted by the support portion 450, it is possible to effectively reduce the swinging of the liquid in the liquid storage portion 110. The undulation reduction portions 410 are supported by the support portion 450 so as to be able to swing, and thus the liquid remains adhered to the undulation reduction portions 410, with the result that the liquid is left in the liquid storage portion 110. In the liquid consumption device 10 including the liquid container 100B of the second embodiment, the occurrence of a failure in the jetting of the liquid caused by air bubbles mixed in the liquid as a result of the swinging of the liquid is reduced. When the liquid consumption device 10 is a high-speed printer in which the carriage 12 is made to reciprocate at high speed, it is possible to obtain a higher effect. Moreover, in the liquid container 100B of the second embodiment and the liquid consumption device 10 including it, various operational effects described above in the first embodiment are able to be achieved.

3. Other Embodiments

For example, various configurations described in each of the embodiments discussed above may be changed as follows. The other embodiments which will be described below are considered as examples of aspects for practicing the disclosure as with the embodiments discussed above.

3-1. Another Embodiment 1:

The shape of the undulation reduction portions 200 in the first embodiment is not limited to the shape described in the first embodiment. The undulation reduction portions 200 do not need to have a long shape. In the first undulation reduction portion 210, the wall surfaces 215 and 216 may include projections and recesses or a curved surface or may include a through hole which penetrates in the thickness direction. In the second undulation reduction portion 220, the wall surface 225 and 226 may include projections and recesses or a curved surface other than the protrusion portions 228 and the leg portions 227 or may include a through hole which penetrates in the thickness direction. The second undulation reduction portion 220 may include the protrusion portions 228 and the leg portions 227 whose shapes are different from those in the first embodiment. For example, the protrusion portions 228 may be configured to have a hemispherical shape, or the leg portions 227 may be configured as convex thread portions. In the second undulation reduction portion 220, the protrusion portions 228 and the leg portions 227 may be omitted. When the second undulation reduction portion 220 is seen in the −Z direction, the second undulation reduction portion 220 may include part which overlaps the liquid detection portion 115

3-2. Another Embodiment 2:

In the configuration of the first embodiment described above, as the undulation reduction portion 200, only one of the first undulation reduction portion 210 and the second undulation reduction portion 220 may be provided. Alternatively, three or more undulation reduction portions 200 may be arranged vertically.

3-3. Another Embodiment 3:

In the configuration of the first embodiment described above, the support portion 300 may support both parts of the undulation reduction portions 200, i.e. the first undulation portion 210 and the second undulation portion 220 on the side of end portions, which are located respectively in a direction along the direction of gravity and parts thereof on the side of the other end portions. In the configuration of the first embodiment described above, the support portion 300 may support, for example, parts of the undulation reduction portions 200 on the side of end portions in the +Y direction and parts thereof on the side of end portions in the −Y direction. The support portion 300 may support at least parts of the undulation reduction portions 200 on the side of end portions in the X axis direction. In the configuration of the first embodiment described above, the upper and lower support portions included in the support portion 300 do not need to be formed as the ribs of the main body portion 125A. The upper and lower support portions may be formed as, for example, parts which have a columnar shape.

3-4. Another Embodiment 4:

The shape of the undulation reduction portions 410 in the second embodiment described above is not limited to the shape described in the second embodiment. The undulation reduction portions 410 may include, for example, projections and recesses or a curved surface in the surface thereof or may include a through hole which penetrates in the thickness direction. When the undulation reduction portions 410 are seen in the Z direction, the undulation reduction portions 410 do not need to include parts along the outer periphery of the liquid detection chamber 135. The shape of the undulation reduction member 400 in the second embodiment described above is not limited to the shape described in the second embodiment. The undulation reduction member 400 may include only one undulation reduction portion 410 or may include three or more undulation reduction portions 410. In the undulation reduction member 400, a plurality of undulation reduction portions 410 may be arranged at different arrangement angles, or undulation reduction portions having different shapes may be included. The two coupling portions 470 do not need to be provided, and only one side may be provided. The coupling portions 470 may be configured as columnar parts or may be configured to couple together the center portions of the undulation reduction portions 410 and the center portion of the bottom plate portion 460.

3-5. Another Embodiment 5:

The undulation reduction portions 200 of the first embodiment and the undulation reduction portions 410 of the second embodiment may be provided in the liquid storage portion 110 other than the second storage chamber 134B. The undulation reduction portions 200 of the first embodiment and the undulation reduction portions 410 of the second embodiment may be provided in a plurality of places within the liquid containers 100A and 100B.

3-6. Another Embodiment 6:

The configurations of the liquid containers 100A and 100B are not limited to the configurations described in the first and second embodiments. The liquid containers 100A and 100B may include a single liquid storage portion 110 which is not partitioned. The liquid containers 100A and 100B do not need to include the liquid detection portion 115 and the liquid detection chamber 135. The configurations of the liquid containers 100A and 100B do not need to include the differential pressure valve chamber 150. While the liquid containers 100A and 100B are receiving the supply of the liquid from an external liquid reservoir portion to the liquid storage portion 110 through a tube or the like in a state where the liquid containers 100A and 100B are fitted to the carriage 12, the liquid may be supplied to the head 11.

3-7. Another Embodiment 7:

In the liquid consumption device 10, only any one of the liquid container 100A of the first embodiment and the liquid container 100B of the second embodiment may be fitted. In the liquid consumption device 10, only one liquid container 100A of the first embodiment may be fitted, or a plurality of liquid containers 100B of the second embodiment may be fitted.

3-8. Another Embodiment 8:

The configurations of the undulation reduction portions 200 and 410 and the support portions 300 and 450 described in the first and second embodiments may be applied to liquid containers other than the liquid containers 100A and 100B which are fitted to inkjet printers. The configurations may be applied to, for example, liquid containers which are fitted to various types of liquid consumption devices as described below.

(1) An image recording device such as a facsimile device (2) A color material jetting device which is used in the manufacturing of an image display device color filter such as a liquid crystal display (3) An electrode material jetting device which is used in the electrode formation of an organic EL (Electro Luminescence) display, a surface-emitting display such as FED (Field Emission display) or the like (4) A liquid jetting device which jets a liquid containing a bioorganic substance used in the manufacturing of a biochip (5) A test jetting device used as a precision pipette (6) A lubricant jetting device (7) A resin liquid jetting device (8) A liquid jetting device which jets a lubricant to a precision machine, such as a watch or a camera, with pinpoint accuracy (9) A liquid jetting device which jets, onto a substrate a transparent resin liquid, such as an UV curable resin liquid, for the formation of an optical lens such as a micro-hemispherical lens used in an optical communication element or the like

(10) A liquid jetting device which jets an acidic or alkaline etchant for etching a substrate or the like

(11) A liquid jetting device which includes a liquid consumption head for discharging an arbitrary amount of microdroplet The "liquid" may be any material as long as the material is able to be consumed in the liquid jetting device. For example, the "liquid" may be any material as long as the substance of the material is in a liquid phase, and also includes a material whose viscosity is high or low and materials in a liquid state such as sol, gel water, an inorganic solvent, an organic solvent, a solution, a liquid resin, and a liquid metal which is a metal melt. The "liquid" is not limited to a liquid in one state of a substance, and the "liquid" also includes a compound obtained by dissolving, dispersing or mixing, in a solvent, the particles of a functional material formed of a solid material such as a pigment or metal particles. Typical examples of the liquid include the ink, the liquid crystal and the like as described in the embodiments discussed above. Here, the ink includes various types of liquid compositions such as a general water-based ink, a general oil-based ink, a gel ink, and a hot melt ink.

4. Other Aspects

The technology of the present disclosure is not limited to the embodiments and examples described above and is able to be realized in various aspects without departing from the sprit thereof. For example, the technology of the present disclosure is able to be realized as aspects below. The technical features in the embodiments described above corresponding to technical features in the individual aspects described below may be replaced or combined as necessary so that part or the whole of the object of the present disclosure is solved or part or the whole of the effects of the present disclosure is achieved. When in the present specification, the technical features are not described as necessary features, they may be removed as necessary.

In a first aspect, a liquid container is provided. A liquid container in this aspect is configured to be fitted to the carriage of a liquid consumption device that includes the carriage where a head is provided and that jets, while making the carriage reciprocate, a liquid from the head so as to consume the liquid and includes: a liquid storage portion configured to store the liquid inside; an undulation reduction portion provided in the liquid storage portion and including a wall surface configured to reduce the undulation of the liquid and configured to be directed in the direction of gravity in a fitting posture where the liquid container is fitted to the carriage; and a support portion configured to support the undulation reduction portion such that, in the liquid storage portion, the undulation reduction portion is allowed to swing together with the liquid and that the movement of the wall surface along the direction of gravity in the fitting posture is restricted.

In the liquid container in this aspect, the wall surface of the undulation reduction portion functions to prevent the movement of the liquid in a vertical direction along the direction of gravity, and thus it is possible to effectively reduce the undulation of the liquid. The movement of the wall surface of the undulation reduction portion along the direction of gravity is restricted, and thus the significant swinging of the wall surface of the undulation reduction portion together with the liquid is reduced. Hence, it is possible to effectively reduce the undulation of the liquid. In particular, when the liquid is consumed such that at least part of the wall surface of the undulation reduction portion is supported in a position higher than the surface of the liquid in the liquid storage portion, with part of the wall surface above the surface of the liquid, it is possible to effectively reduce the undulation of the liquid from above the surface of the liquid. Furthermore, in the liquid container in this aspect, the swinging of the undulation reduction portion is allowed, and thus the falling off of the liquid from the surface of the undulation reduction portion is facilitated by the swinging of the undulation reduction portion. Hence, a failure is reduced in which the liquid remains adhered to the undulation reduction portion and is thus left in the liquid storage portion. Moreover, for example, when the liquid container stores the liquid containing a precipitation component, such as a pigment, which is dispersed without being dissolved in the liquid and which is precipitated in a state where the liquid is left stationary, the precipitation component is agitated by the swinging of the undulation reduction portion, and thus the nonuniformity of the density of the liquid supplied to the liquid consumption device is reduced.

The liquid container in the aspect described above may include a plurality of the undulation reduction portions, and the support portion may support the plurality of the undulation reduction portions in the fitting posture in a state where the plurality of the undulation reduction portions are arranged in the direction of gravity.

In the liquid container in this aspect, even when the liquid is consumed so as to lower the position of the surface of the liquid, with the wall surface of any one of the undulation reduction portions, it is possible to reduce the undulation of the liquid.

In the liquid container in the aspect described above, the support portion may support the plurality of the undulation reduction portions in the fitting posture in a state where the wall surfaces of the plurality of the undulation reduction portions are arranged at regular intervals in the direction of gravity.

In the liquid container in this aspect, it is possible to reduce a variation in the magnitude of the effect of reducing the undulation of the liquid with the undulation reduction portions caused by the position of the surface of the liquid.

In the liquid container in the aspect described above, the liquid container may further include a liquid detection portion provided in the liquid storage portion and configured to guide light from a bottom surface of the liquid storage portion toward the liquid for detecting a remaining state of the liquid, and the undulation reduction portion may be shaped so as not to overlap the liquid detection portion when the liquid container is seen in a direction extending from the undulation reduction portion toward the bottom surface of the liquid storage portion.

In the liquid container in this aspect, with the undulation reduction portion, it is possible to increase the area of the wall surface while avoiding a region in which the liquid detection portion is formed.

In the liquid container in the aspect described above, the liquid storage portion may include a first side wall portion and a second side wall portion that are opposite each other through the undulation reduction portion in a direction along the wall surface, the first side wall portion may include, in the liquid storage portion, a convex structure that protrudes toward the second side wall portion, and the undulation reduction portion may include an extension portion that extends in a position adjacent to the convex structure when the liquid container is seen in the direction of gravity in the fitting posture and that includes part of the wall surface.

In the liquid container in this aspect, it is possible to increase the area of the wall surface of the undulation reduction portion by only the wall surface included in the extension portion while avoiding the convex structure within the liquid storage portion, with the result that it is possible to reduce the undulation of the liquid in a wider range.

In the liquid container in the aspect described above, the liquid storage portion may include a first side wall portion and a second side wall portion that are opposite each other through the undulation reduction portion in a direction along the wall surface, the liquid detection portion may be provided in an end portion of the liquid storage portion on the side of the first side wall portion, the first side wall portion may include a convex structure that protrudes toward the second side wall portion in a position adjacent to the liquid detection portion when the liquid container is seen in the direction of gravity in the fitting posture, the undulation reduction portion may include an extension portion that extends toward the convex structure on the side of the convex structure with respect to the liquid detection portion when the liquid container is seen in the direction of gravity in the fitting posture and that includes part of the wall surface, and in a tip end of the extension portion that is directed toward the first side wall portion, an inclination surface is provided that is inclined with respect to an end face of the convex structure when the liquid container is seen in the direction of gravity in the fitting posture.

In the liquid container in this aspect, it is possible to increase the area of the wall surface of the undulation reduction portion by only the wall surface included in the extension portion while avoiding the region in which the liquid detection portion is formed. The extension portion includes the inclination portion so as to reduce the range of contact between the convex structure and the extension portion, and thus it is possible to reduce the damage of the undulation reduction portion caused by contact with the convex structure. In addition, when the convex structure makes contact with the extension portion, a gap is formed between the inclination portion and the end face of the convex structure, and thus the prevention of the flow of the liquid within the liquid storage portion by the undulation reduction portion is reduced.

In the liquid container in the aspect described above, the support portion may include: a lower support portion that is located below part of the undulation reduction portion on the side of an end portion thereof in a direction intersecting the direction of gravity in the fitting posture; and an upper support portion that is located above the part of the undulation reduction portion on the side of the end portion in the fitting posture, and in the support portion, an interval between the upper support portion and the lower support portion may be greater than the thickness of the part of the undulation reduction portion on the side of the end portion such that the support portion allows the undulation reduction portion to swing together with the liquid and that the support portion restricts a range of the movement of the wall surface in a direction along the direction of gravity in the fitting posture.

In the liquid container in this aspect, the range of the movement of the wall surface of the undulation reduction portion along the direction of gravity is restricted, and thus the swinging of the wall surface is reduced, with the result that it is possible to more effectively reduce the swinging of the liquid.

In the liquid container in the aspect described above, the support portion may include: a bottom plate portion that is arranged below the wall surface so as to face a bottom surface of the liquid storage portion in a state where the bottom plate portion is allowed to swing together with the liquid; and a coupling portion that extends upward from the bottom plate portion in the fitting posture and that couples together the bottom plate portion and the undulation reduction portion arranged in a position away from the bottom plate portion.

In the liquid container in this aspect, the movement of the undulation reduction portion along the direction of gravity is restricted by the resistance and weight of the liquid present on the bottom plate portion. Hence, the following of the undulation of the liquid by the wall surface of the undulation reduction portion is reduced, and thus it is possible to effectively reduce the undulation of the liquid.

In the liquid container in the aspect described above, the bottom plate portion may include a leg portion on a surface on the side of the bottom surface of the liquid storage portion, the leg portion may protrude toward the bottom surface, and when the bottom plate portion is located in the lowest position in the liquid storage portion, the leg portion may form a gap between the bottom plate portion and the bottom surface.

In the liquid container in this aspect, with the leg portion, the intimate contact of the bottom plate portion with the bottom surface of the liquid storage portion is reduced, and thus it is possible to reduce the prevention of the swinging of the undulation reduction portion. A gap through which the liquid is able to be moved is formed between the bottom plate portion and the bottom surface of the liquid storage portion, and thus it is possible to reduce a failure in which the liquid is left in the liquid storage portion.

In a second aspect, a liquid container is provided. A liquid container in this aspect is configured to be fitted to the carriage of a liquid jetting device that includes the carriage where a head is provided and that jets, while making the carriage reciprocate, a liquid from the head and includes: a liquid storage portion configured to store the liquid inside; an undulation reduction portion provided in the liquid storage portion and including a wall surface configured to reduce the undulation of the liquid and configured to direct in the direction of gravity in a fitting posture where the liquid container is fitted to the carriage; and a support portion configured to support the undulation reduction portion such that, in the liquid storage portion, the undulation reduction portion is allowed to swing together with the liquid and that a movement of the wall surface along the direction of gravity in the fitting posture is restricted, and the support portion includes a bottom plate portion arranged below the wall surface so as to face a bottom surface of the liquid storage portion in a state where the bottom plate portion is allowed to swing together with the liquid, and a coupling portion extending upward from the bottom plate portion in the fitting posture and that couples together the bottom plate portion and the undulation reduction portion arranged in a position away from the bottom plate portion.

In the liquid container in this aspect, the upward movement of the undulation reduction portion is restricted by the resistance and weight of the liquid present on the bottom plate portion, and thus the following of the undulation of the liquid by the wall surface of the undulation reduction portion is reduced, with the result that it is possible to effectively reduce the undulation of the liquid. In particular, when the liquid is consumed such that the position of the surface of the liquid in the liquid storage portion is lowered beyond at least part of the wall surface of the undulation reduction portion, with part of the wall surface of the undulation reduction portion located above the surface of the liquid, the undulation of the liquid is held down form above the surface of the liquid, with the result that it is possible to more effectively reduce the undulation of the liquid. In the liquid container in this aspect, the falling off of the liquid from the surface of the undulation reduction portion is facilitated by the swinging of the undulation reduction portion. In addition, when the liquid container stores the liquid containing a precipitation component, the precipitation component is agitated by the swinging of the undulation reduction portion, and thus the nonuniformity of the density of the liquid supplied to the liquid consumption device is reduced.

In the liquid container in the aspect described above, the coupling portion may be configured to restrict a downward movement of the wall surface beyond a predetermined height in the fitting posture.

In the liquid container in this aspect, when the position of the surface of the liquid is lowered beyond the lower limit position of the wall surface of the undulation reduction portion in the direction of the height, the undulation of the liquid is able to be held down with the wall surface of the undulation reduction portion from above the surface of the liquid.

In a third aspect, a liquid consumption device is provided. A liquid consumption device in this aspect includes: a head configured to jet a liquid; a carriage including the head and configured to reciprocate; and a liquid container configured to be fitted to the carriage and store the liquid to be supplied to the head. The liquid container includes: a liquid storage portion configured to store the liquid inside; an undulation reduction portion provided in the liquid storage portion and including wall surface configured to reduce undulation of the liquid and configured to be directed in the direction of gravity in a fitting posture where the liquid container is fitted to the carriage; and a support portion configured to support the undulation reduction portion such that the undulation reduction portion is allowed to swing together with the liquid, the movement of the wall surface of the undulation reduction portion along the direction of gravity is restricted, and that, when in the fitting posture, the position of the surface of the liquid in the liquid storage portion is lowered beyond a predetermined position, at least part of the wall surface is located higher than the surface of the liquid.

In the liquid consumption device in this aspect, the movement of the wall surface of the undulation reduction portion in the direction of gravity is restricted, and thus the significant swinging of the wall surface of the undulation reduction portion together with the liquid is reduced, with the result that it is possible to effectively reduce the undulation of the liquid. In particular, when the liquid is consumed such that at least part of the wall surface of the undulation reduction portion is supported in a position higher than the surface of the liquid in the liquid storage portion, with part of the wall surface above the surface of the liquid, it is possible to effectively reduce the undulation of the liquid from above the surface of the liquid. Hence, the occurrence of a failure in the jetting of the liquid from the head caused by air bubbles produced in the liquid as a result of the undulation of the liquid is reduced. In the liquid consumption device in this aspect, since the falling off of the liquid from the surface of the undulation reduction portion is facilitated by the swinging of the undulation reduction portion, a failure is reduced in which the liquid remains adhered to the undulation reduction portion and is thus left in the liquid storage portion. Moreover, when the liquid containing a precipitation component is jetted from the head, the precipitation component is agitated within the liquid storage portion by the swinging of the undulation reduction portion, and thus the nonuniformity of the density of the jetted liquid is reduced.

The present disclosure is also able to be realized by various aspects other than the liquid container and the liquid consumption device including it. For example, the present disclosure is able to be realized by aspects such as a liquid undulation reduction member, a structure for reducing the undulation of a liquid, and a method of reducing the undulation of a liquid.

What is claimed is:

1. A liquid container configured to be fitted to a carriage of a liquid consumption device that comprises the carriage, which is configured to reciprocate, and a head located on the carriage and configured to jet a liquid, the liquid container configured to store the liquid to be supplied to the head, the liquid container comprising:

a liquid storage portion configured to store the liquid;

an undulation reduction portion provided in the liquid storage portion and comprising a wall surface configured to reduce undulation of the liquid and configured to be directed in a vertical direction in a fitting posture in which the liquid container is fitted to the carriage of the liquid consumption device in a normal usage posture; and a support portion configured to support the undulation reduction portion such that the undulation reduction portion is allowed to swing together with the liquid in the liquid storage portion, and such that movement of the wall surface along the vertical direction in the fitting posture is limited to a predetermined range, wherein the support portion supports the undulation reduction portion such that the undulation reduction portion is allowed to float in the liquid storage portion by buoyancy exerted on the undulation reduction portion by the liquid, the undulation reduction portion thereby reducing undulation of the liquid.

2. The liquid container according to claim 1, comprising:

a plurality of the undulation reduction portions, wherein the support portion supports the plurality of the undulation reduction portions in the fitting posture in a state in which the plurality of the undulation reduction portions are arranged in the vertical direction.

3. The liquid container according to claim 2, wherein the support portion supports the plurality of the undulation reduction portions in the fitting posture in a state in which the wall surfaces of the plurality of the undulation reduction portions are arranged at regular intervals in the vertical direction.

4. The liquid container according to claim 1, further comprising:

a liquid detection portion provided in the liquid storage portion and configured to guide light from a bottom surface of the liquid storage portion toward the liquid for detecting a remaining state of the liquid, wherein the undulation reduction portion is shaped so as not to overlap the liquid detection portion when the liquid container is seen in a direction extending from the undulation reduction portion toward the bottom surface of the liquid storage portion.

5. The liquid container according to claim 4, wherein the liquid storage portion comprises a first side wall portion and a second side wall portion that are opposite each other through the undulation reduction portion in a direction along the wall surface, the liquid detection portion is provided in an end portion of the liquid storage portion on a side of the first side wall portion, the first side wall portion comprises a convex structure that protrudes toward the second side wall portion in a position adjacent to the liquid detection portion when the liquid container is seen in the vertical direction in the fitting posture, the undulation reduction portion comprises an extension portion that extends toward the convex structure on a side of the convex structure with respect to the liquid detection portion when the liquid container is seen in the vertical direction in the fitting posture and that comprises part of the wall surface and in a tip end of the extension portion that is directed toward the first side wall portion, an inclination surface is provided that is inclined with respect to an end face of the convex structure when the liquid container is seen in the vertical direction in the fitting posture.

6. The liquid container according to claim 1, wherein the liquid storage portion comprises a first side wall portion and a second side wall portion that are opposite each other through the undulation reduction portion in a direction along the wall surface, the first side wall portion comprises, in the liquid storage portion, a convex structure that protrudes toward the second side wall portion and the undulation reduction portion comprises an extension portion that extends in a position adjacent to the convex structure when the liquid container is seen in the vertical direction in the fitting posture and that comprises part of the wall surface.

7. The liquid container according to claim 1, wherein the support portion comprises:

a lower support portion that is located below part of the undulation reduction portion on a side of an end portion thereof in a direction intersecting the vertical direction in the fitting posture; and an upper support portion that is located above the part of the undulation reduction portion on the side of the end portion in the fitting posture, and in the support portion, an interval between the upper support portion and the lower support portion is greater than a thickness of the part of the undulation reduction portion on the side of the end portion such that the support portion allows the undulation reduction portion to swing together with the liquid and that the support portion restricts a range of the movement of the wall surface in a direction along the vertical direction in the fitting posture.

8. The liquid container according to claim 1, wherein the support portion comprises:

a bottom plate portion that is arranged below the wall surface so as to face a bottom surface of the liquid storage portion in a state in which the bottom plate portion is allowed to swing together with the liquid; and a coupling portion that extends upward from the bottom plate portion in the fitting posture and that couples together the bottom plate portion and the undulation reduction portion arranged in a position away from the bottom plate portion.

9. The liquid container according to claim 8, wherein the bottom plate portion comprises a leg portion on a surface on a side of the bottom surface of the liquid storage portion, the leg portion protrudes toward the bottom surface and when the bottom plate portion is located in a lowest position in the liquid storage portion, the leg portion forms a gap between the bottom plate portion and the bottom surface.

10. A liquid container configured to be fitted to a carriage of a liquid jetting device that comprises the carriage, which is configured to reciprocate, and a head located on the carriage and configured to jet a liquid, the liquid container configured to store the liquid to be supplied to the head, the liquid container comprising:

a liquid storage portion configured to store the liquid;

an undulation reduction portion provided in the liquid storage portion and comprising a wall surface configured to reduce undulation of the liquid and configured to be directed in a vertical direction in a fitting posture in which the liquid container is fitted to the carriage of the liquid jetting device in a normal usage posture; and a support portion configured to support the undulation reduction portion such that, in the liquid storage portion, the undulation reduction portion is allowed to swing together with the liquid in the liquid storage portion, and such that movement of the wall surface along the vertical direction in the fitting posture is restricted, and the support portion comprises:

a bottom plate portion arranged below the wall surface so as to face a bottom surface of the liquid storage portion in a state in which the bottom plate portion is allowed to swing together with the liquid; and a coupling portion extending upward from the bottom plate portion in the fitting posture and that couples together the bottom plate portion and the undulation reduction portion arranged in a position away from the bottom plate portion.

11. The liquid container according to claim 10, wherein the coupling portion is configured to restrict a downward movement of the wall surface beyond a predetermined height in the fitting posture.

12. A liquid consumption device comprising:

a carriage configured to reciprocate;

a head located on the carriage and configured to jet a liquid; and a liquid container configured to be fitted to the carriage and store the liquid to be supplied to the head, wherein the liquid container comprises:

a liquid storage portion configured to store the liquid;

an undulation reduction portion provided in the liquid storage portion and comprising a wall surface configured to reduce undulation of the liquid and configured to be directed in a vertical direction in a fitting posture where the liquid container is fitted to the carriage of the liquid consumption device in a normal usage posture; and a support portion configured to support the undulation reduction portion such that the undulation reduction portion is allowed to swing together with the liquid in the liquid storage portion, such that movement of the wall surface of the undulation reduction portion along the vertical direction is limited to a predetermined range, and such that, when in the fitting posture, a position of a surface of the liquid in the liquid storage portion is lowered beyond a predetermined position, at least part of the wall surface is located higher than the surface of the liquid, wherein the support portion supports the undulation reduction portion such that the undulation reduction portion is allowed to float in the liquid storage portion by buoyancy exerted on the undulation reduction portion by the liquid, the undulation reduction portion thereby reducing undulation of the liquid.

* * * * *